US007938097B2

(12) United States Patent
Sparling

(10) Patent No.: US 7,938,097 B2
(45) Date of Patent: May 10, 2011

(54) LOW SPEED VALVELESS HORIZONTALLY OPPOSED PISTON ROTARY INTERNAL COMBUSTION ENGINE

(76) Inventor: James Douglas Sparling, Denver, CO (US)

( * ) Notice: Subject to any disclaimer, the term of this patent is extended or adjusted under 35 U.S.C. 154(b) by 404 days.

(21) Appl. No.: 12/221,524

(22) Filed: Aug. 4, 2008

(65) Prior Publication Data

US 2010/0024763 A1 Feb. 4, 2010

(51) Int. Cl.

| | |
|---|---|
| ***F02B 53/00*** | (2006.01) |
| ***F02B 53/08*** | (2006.01) |
| ***F02B 53/04*** | (2006.01) |
| ***F02B 75/26*** | (2006.01) |
| ***F02B 57/00*** | (2006.01) |
| ***F02B 57/08*** | (2006.01) |
| ***F02B 57/10*** | (2006.01) |
| ***F01B 3/00*** | (2006.01) |
| ***F01B 13/04*** | (2006.01) |
| ***F01B 13/06*** | (2006.01) |

(52) U.S. Cl. ..... 123/200; 123/212; 123/214; 123/223; 123/43 A; 123/43 B; 123/43 C; 123/43 R; 123/43 AA; 123/44 A; 123/44 B; 123/44 C; 123/44 D; 123/44 E; 123/44 R

(58) Field of Classification Search ..... 123/200, 123/212, 214, 223, 44 R, 44 A, 44 B, 44 C, 123/44 D, 44 E, 43 R, 43 A, 43 AA, 43 B, 123/43 C See application file for complete search history.

*Primary Examiner* — Thomas E Denion
*Assistant Examiner* — Michael Carton

(57) ABSTRACT

Presented is a very low speed, high torque, horizontally opposed, rotary, valveless, Otto cycle piston engine producing four power strokes per revolution, the engine consisting of a fixed engine case assembly having upper and lower plates, the engine rotor assembly having upper and lower plates, sandwiching a single, closed ended cylinder assembly, the cylinder containing intake and exhaust-intake ports, independently reciprocating power and head pistons, each piston being reciprocally controlled by its vertically projecting piston bearing sets contacting respective sets of upper and lower, inner and outer peripheral cam plates, the engine being thus rotated, the cylinder being lubricated by a sealed, recirculating air-oil mist system, the engine rotor assembly having a lower, vertically projecting gear box housing containing a gas porting cap, a vertical drive shaft, two counter rotating output shafts, intake and exhaust pipes, and an exhaust gas filter canister.

4 Claims, 37 Drawing Sheets

608
609
129
166
131
272
276
242

266
274

268
272
270
286
266
188
104
290
282

276
280
288
292
278
190
274
450
284

FIG 13A
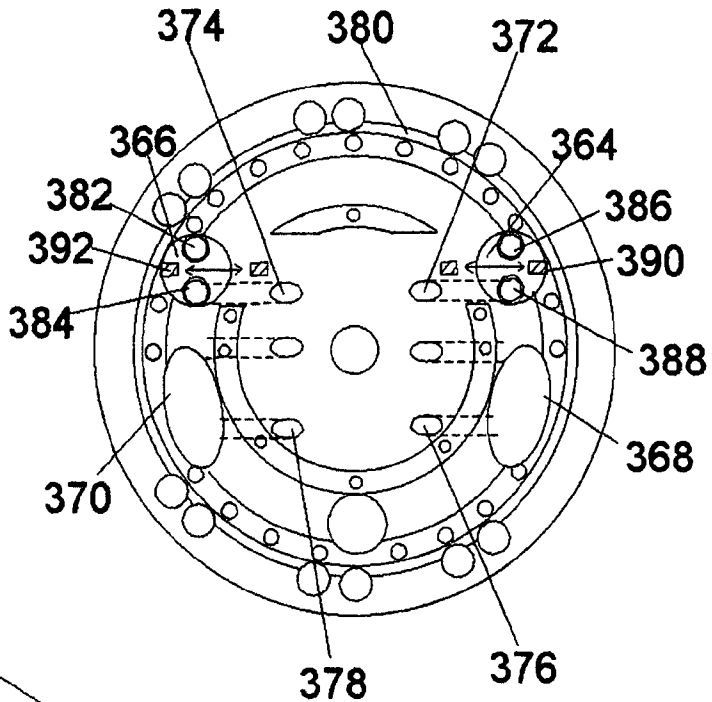
FIG 13
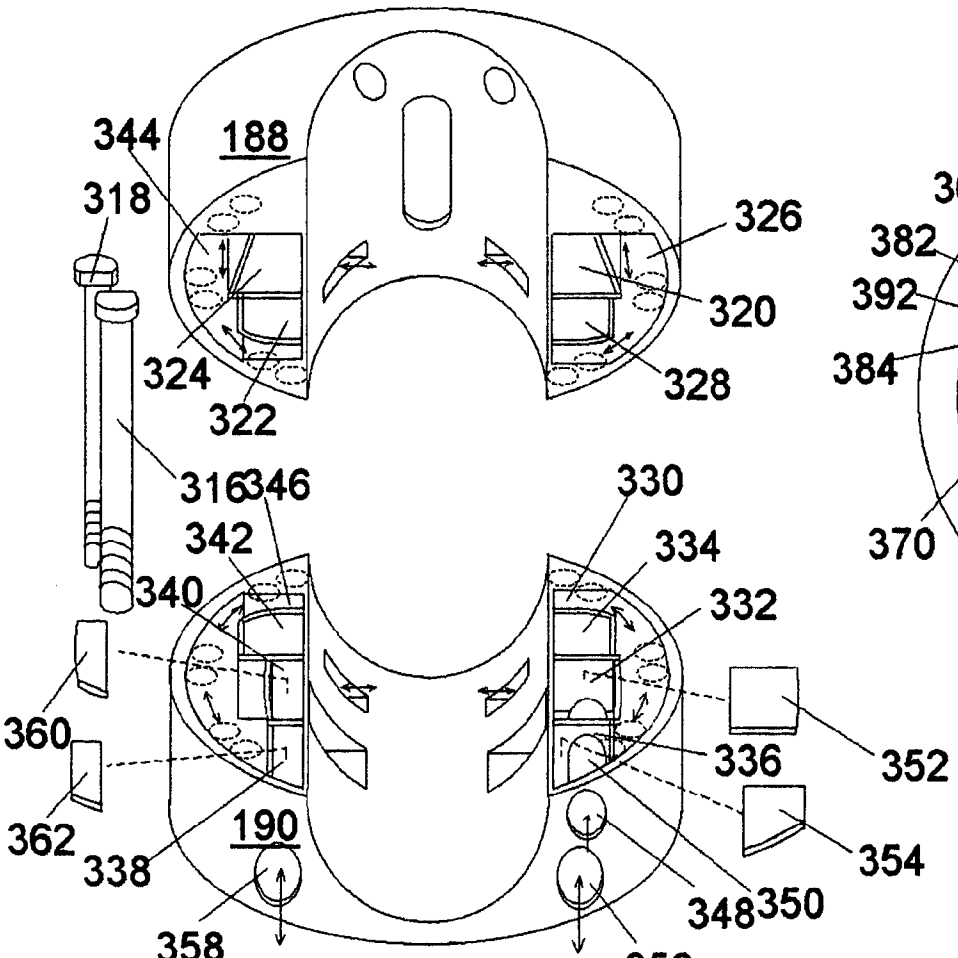
FIG 13B

LOW SPEED VALVELESS HORIZONTALLY OPPOSED PISTON ROTARY INTERNAL COMBUSTION ENGINE

CROSS-REFERENCE TO RELATED APPLICATIONS

Not applicable

FEDERALLY SPONSORED RESEARCH

Not applicable.

SEQUENCE LISTING OR PROGRAM

Not applicable.

BACKGROUND

Field of Invention

The invention relates to a low speed valveless horizontally opposed piston rotary internal combustion engine, the power piston and head pistons moving independently, each being controlled by a set of upper and lower outer peripheral power piston cam plates and upper and lower inner peripheral head piston cam plates, the inward motion of the pistons controlled by the slopes of the cams. A single, closed ended rotating piston houses the axially disposed pistons while internal cylinder compartments provide exhaust-intake port cooling air, and provides for the creation and recirculation of air-oil mist which is recirculated between the power piston and head piston and mid barrel assembly which has internal passages for the lubrication system.

BACKGROUND OF THE INVENTION

The invention is a truly strategic change in how the standard internal cylinder pressures are utilized to convert heat energy into mechanical energy in that the need to escape the high engine revolutions of the prior art designs. It is a machine that is inherently slow in revolutions. By addressing the high revolutions subject, the now fully antiquated means of establishing marginal torques by high revolutions has been utterly abandoned. The high revolution operational designs of engines in the prior are therefore irretrievably committed to high fuel consumption, unnecessary need for cooling using conventional air or liquid cooling techniques, subject to engine failures with any lubrication system failure, high exhaust temperatures and internal combustion engines that have many moving parts such as standard intake and exhaust valves, all of which are subject to failure in an environment of high revolutions.

Further, the preceding designs have universally failed to address the environmental issues of air pollution and have totally ignored the need for an engine design that was all-encompassing in its approach to exhaust emissions thereby committing to the usual, add-on exhaust muffler or catalytic converters that are both expensive and operate at high exhaust gas temperatures. Further still, the prior art has utterly ignored the large radiational heat losses that continue to plague internal combustion engines and by ignoring the issue radiational losses the problem remains unsolved.

PRIOR ART

Before the prior art is discussed in more detail for this subclass, there must be broader observations of the prior art subject in general which will cross some conventional boundaries. For those who are not skilled in the art of developing new engine technology, there is the common sense understanding by the general public that when each new engine design is brought forth, it is assumed that it will provide more power, simplicity of construction and reliability of operation than any of its predecessors. Indeed, this is the very essence of the marketplace. In 2008, the cost of fuel is constantly being spurred by the increased sales of personal automobiles in India and Communist China which has created a new and increasing competitiveness for global fuel resources. There can be little doubt that fuel costs to American consumers will not go down, but up. Thus, the creation of new powerplants that will power the near-future domestic automotive and commercial vehicle market must be fully capable of producing more power than what is presently at hand and employ the more fugal use of available fuel sources, particularly gasoline, which becomes a priority subject for everyone who depends on every aspect of the ground and air transportation industry.

If new engine designs are more inferior than their forerunners then there must be a mandatory rethinking of the terms of basic engine design that will transcend the conventional piston engine which is by now, some one hundred and thirty years old, so much so, that repackaging an antique concept is an exercise in futility. Measuring power output for any new piston engine design must be based on torque output at the drive shaft and the old PLANK power formula used by prior piston art engines now becomes obsolete by default.

Torque vs. PLANK. Anyone visiting a car dealership will see engines that presently have a top revolution range of 5,000 to 6,000 RPM. The published torque for engines of that design will produce their maximum torque at about the two thirds point or about 3,500 to 4,000 RPM. At the low end of the operational range, specifically the idle speed which is about 600 RPM, torque output is at a very low value. Therefore, any prior art engines that produce very low engine torque either at the low or high end of their operation have not kept pace with the industry demands. Particularly so when torque is produced at the inordinate expense of high engine revolutions. Certainly, gas turbine engines have long since replaced the multi-row radial piston engines that were once the standard for the last piston phase of the commercial aircraft industry. By average standards, the gas turbine engine has a self-sustaining speed of about 15,000 RPM and a top range of 35,000 RPM, thereby producing enormous amounts of thrust that would require the total redesign of commercial and military aircraft. In a phrase, the gas turbine engine has far surpassed the reciprocating engine by wide power margins which mandated a considerable change in the aviation industry. From the standpoint of the automotive and commercial vehicle industry, there has been no equivalent resurgence of new terms or technology.

A square stroke piston engine is defined as an engine that has a piston width that is equal to the length of the crank arm, thus, it can be readily seen that of the forty three patents issued in this subclass, CCL/123/45a, there is a long list of patented engines that have effective crank arms less than the width of the piston, specifically those designs which have a wide variety of rotating pistons and shafts. Consequently, the following U.S. patents have horizontally opposed piston engine designs that have effective crank arms of one half the diameter of the pistons: U.S. Pat. No. 1,545,925, Nov. 9, 1923, U.S. Pat. No. 1,801,633, Jan. 9, 1926 U.S. Pat. No. 1,736,833, Jun. 23, 1927; U.S. Pat. No. 3,129,669, Apr. 21, 1964; U.S. Pat. No. 3,388,603, Jun. 18, 1965; U.S. Pat. No. 3,757,748, Sep. 11, 1973;U.S. Pat. No. 5,152,257, Oct. 6, 1992;U.S. Pat. No.

5,156,115, Oct. 20, 1992; U.S. Pat. No. 5,301,637, Apr. 12, 1994; U.S. Pat. No. 5,433,176, Jul. 18, 1995 and U.S. Pat. No. 6,145,482.

Moreso, the torque output of patented engines whereby the pistons rotate along a longitudinal threaded shaft are glaring cases of even more inefficient designs in that the effective crank arm dimension would be one half the diameter of the threaded shaft, these examples being: U.S. Pat. No. 4,554,787, Nov. 26, 1985; U.S. Pat. No. 5,622,142, Apr. 22, 1997; U.S. Pat. No. 5,850,810, Dec. 22, 1998 and U.S. Pat. No. 6,125,819, Oct. 3, 2000. Clearly, the history of patents issued as far back as 1923 with respect to effective crank arms one half the piston diameter have been overshadowed by the patents issued as far back as 1985 for engines that have effective crank arms one half the diameter of the threaded shafts, all being numerous examples of prior art that have absolutely no improvements above the torque capabilities of the long-obsolete reciprocating engine which employs a connecting rod and crankshaft. There can be little doubt that the cited patents are engines that have a substantially lower torque output which dearly militates against the various and sundry claims of engine improvements, regardless of the wide range of mechanical designs.

Further, the continual mechanical piston stresses on a threaded shaft engine are enormous which are not only subject to early wear and malfunctions, it is also obvious that any shaft that penetrates the central portion of a reciprocating piston is also subject to substantial internal pressure losses, something that was epidemic for the Wankel engine, one of the main reasons for its commercial demise.

High versus low engine revolutions per minute. There are a series of technical considerations for engines that have high operational ranges for revolutions. (a) First is the fact that an engine that has high revolutions is a dead giveaway that it has low torque capabilities. In terms of rethinking the problem, the one exception to the conventional approach was the Wankel engine, U.S. Pat. No. 3,174,466 which was patented in 1961. Although the Wankel was essentially a blip on the radar screen, it did have some limited commercialization with the Japanese automobile market. Thereafter, it experienced a long series of technical problems in that it was essentially an amalgam of a piston and a turbine engine, so in terms of increased engine revolutions, the Wankel went completely in the wrong direction. The patent history of the fixes for the Wankel is extensive and detailed and in the near half century since, it has become totally irrelevant and has most recently emerged as a very small power plant for ultralight aircraft. (b). Fuel consumption during high engine revolutions is an obvious deficit that needs no elaboration. (c) Lubrication becomes critical when all of the internal engine parts are moving with great speed and under high temperature and any interruption in the numerous lubrication locations within the machine spells an early engine failure which is both dangerous and very expensive to repair. (d) Conversant with lubrication is the communality of internal engine parts and their high wear rates at elevated revolutions. (e) Engine vibrations become a major problem at high revolutions and in most cases, most large aircraft reciprocating engines have very heavy dynamic engine vibration dampeners as part of the main crankshaft. (f) Mechanical reliability is the bottom line and it is seriously deteriorated by lubrication failures and independent part malfunctions, something that was common with the Wankel.

Weight vs. torque computation. The design target for aircraft engines during World War II was one pound of engine for each brake horsepower produced, more specifically a 1:1 ratio was the best that could be achieved at that time. Engines patented after 1945, for example, had to have come up with a weight to horsepower ratio greater than 1:1 or they could not be considered as viable prior art examples. Today, in 2008, any patented piston type engine must have a torque to pound ratio that is greater than 1:1 and it appears that the prior art in this subclass falls substantially below the design mark set back in 1945. Particularly so when it is clear that the torque output of conventional piston engines during the idle range is virtually nil. Patented horizontally opposed piston engines that have effective crank arms less than the conventional piston engine are even less powerful when it comes to the modern torque output standard of measurement.

Power strokes per engine revolution capability. Prior art examples in this subclass are designed essentially along the lines of the four stroke, five event Otto engine cycle. There are examples of prior art examples in this subclass where there are two power strokes per for each movement of the piston which seems to be the most effective limitation for those designs, however, when compared to the subaverage torque performances, particularly during the idle range, the net result is a range of prior art engines that have clearly not surpassed the standards of the conventional reciprocating piston engine.

The number of power strokes within a fixed period of time, in this case, one minute, is normally a direct measurement of the heat output of the engine. Cylinder head temperature is one common measurement in aircraft engines and liquid cooling temperature in ground vehicles is another. It is a long established fact of the operational characteristics of the piston engine that a very large percentage of the heat energy produced by the combustion process is lost to the atmosphere and the key design feature addressing is problem is not observed by the abstracts or drawings submitted by the particular design of any prior art engine. The only reference to the heat production issue is the mention of either air cooling or liquid cooling which essentially ignores the radiational loss problem. Further, should the number of power strokes be very high in the prior art engines, particularly during high power settings, the problems caused by the combustion particulates and other ozone causing discharges are also disregarded by the abstracts and the patent drawings. In both the cases of radiational heat losses and the filtration of exhaust gas particulates, there is no mention to be found in any of the forty three prior art disclosures.

Self sustaining speed. Also known as idling speed, the low operational RPM range of an engine using either the Brayton Cycle for gas turbine engines or the Otto Cycle for gasoline powered piston engines are all based on the combustion pressures produced within the engine to produce the requisite mechanical movements to make the machine operate. As an example, in a twin spool gas turbine engine, the N2 compressor spool, which provides compressed air to the core engine, must operate around 15,000 RPM so as to produce the minimum air flow through the core combustion section of the engine before fuel can be introduced and ignition provided. Should the N2 core compressor spool only operate at, let's say, 2,000 RPM and fuel and ignition introduced, the resulting combustion would violently flash in a reverse direction through the N2 compressor and into the area forward of the inlet cowl. Clearly, the gas turbine would not operate as designed. In the case of a gasoline powered engine, the normal 600 RPM and 5,000 RPM ranges are the designed operational envelope and any piston engine attempting to operate at, let's say, the 100 RPM to 450 RPM range would equally fail to operate because it would never have enough mechanical energy to move the minimum air flow through the engine. In the forty three prior art engines, there is no mention, whatsoever, of any progressive design that would actually operate at that low operational RPM range.

Cost of fabrication. Reviewing the specific mechanical aspects of the forty three prior art examples, it is most evident that virtually all of the mechanical parts under review are simply not capable of being quickly formed on a punch press machine, something that increases the initial and repair costs significantly. A viable prior art engine in this subclass would be one that could extensively employ punch press manufactured parts and there are no examples of this mechanical design improvement since 1925. Punch press formed parts can be of proper strength while being substantially lighter than castings or forgings that are always heavier, thus, an engine largely manufactured of punch press parts will be lighter making it a viable candidate for aircraft industry applications.

BRIEF SUMMARY OF THE INVENTION

The invention is a horizontally opposed piston engine, the pistons operating independently and moved inward by upper and lower cam plates, each set of cam plates pressing the pistons inward while spring mechanisms within the dosed ended cylinder, in conjunction with centrifugal force, cause the pistons outward so that they bear on their respective cams. Each piston has its own upper and lower cam bearings that reciprocate with its own respective piston. A centralized mid barrel assembly is the mechanically condensed focal point for engine instrumentations, fluid, electrical and ignition system installations along with a vacuum system that supports the vacuum sleeve that is installed in the cylinder area of the power piston so as to address the heat radiational loss problem. The rotating closed ended cylinder consumes interior engine vapors and directs them to the exhaust-intake port to cool that section of the mid barrel assembly as well as to provide additional air during the intake stroke. An exhaust gas filter canister is an integral part of the overall engine design for the simple reason that it is capable of addressing exhaust gas pollutants in a low engine revolutions situation, the entire design package considering the on-going problem of air pollution.

Accordingly, besides the detailed discussions of the invention, the objects and advantages of the low speed, high torque horizontally opposed piston engine described in my above patent, several additional objects and advantages of the present invention are:

Additional objects and advantages of the invention are Simplicity of construction—three power producing moving parts.

Additional objects and advantages of the invention are four stroke, five event Otto cycle that does not need a high compression ratio.

Additional objects and advantages of the invention are can be powered by either a carburetor for a normally aspirated engine or a fuel control unit that would support a fuel injection system.

Additional objects and advantages of the invention are fuel injector primer units near each spark plug.

Additional objects and advantages of the invention are low RPM operational envelope of approximately 100 RPM idle and 450 RPM maximum rotations.

Additional objects and advantages of the invention is the torque output as the measurement of power output as opposed to the obsolete PLANK formula continually used by piston engines employing connecting rods and a crankshaft.

Additional objects and advantages of the invention are an air-oil mist recirculation system operating internally within connecting cylinder chambers for the power piston and head piston and in connecting chambers in the mid barrel assembly.

Additional objects and advantages of the invention is an outer periphery power cam plate set for the power piston having appropriate cam slopes which will produce the power, exhaust, intake and compression strokes that are compatible with the Otto cycle for piston engines, the power cam plate set working in proper cycle concert with the head cam plate set, the power cam plate set having a matching cam top plate and cam bottom plate, each upper and lower plate having precisely the identical profiles and each plate having its profiles precisely vertically aligned with its matching cam plate, the power cam plate set working in proper cyclical order with the head cam plate set so as to produce at least four Otto cycles per revolution of the engine rotor.

Additional objects and advantages of the invention is an inner periphery head cam plate set for the head piston having appropriate cam slopes which will produce the power, exhaust, intake and compression strokes that are compatible with the Otto cycle for piston engines, the head cam plate set working in proper cycle concert with the piston cam plate set, the head cam plate set having a matching cam top plate and cam bottom plate, each upper and lower plate having precisely the identical profiles and each plate having its profiles precisely vertically aligned with its matching cam plate, the head cam plate set working in proper cyclical order with the power cam plate set so as to produce at least four Otto cycles per revolution of the engine rotor.

Additional objects and advantages of the invention is an outer periphery power cam plate set for the power piston having appropriate cam slopes which will produce the power, exhaust, intake and compression strokes that are compatible with the Otto cycle for piston engines, the descending power cam slope having a power stroke travel at least equal to the diameter of the piston while causing the engine rotor to rotate at least twenty-four degrees, the ascending exhaust stroke having an exhaust stroke travel at least the diameter of the piston, the descending intake stroke having a travel at least the diameter of the piston and causing the engine rotor to rotate at least twenty degrees and a compression stroke having a travel at least the diameter of the piston, the compression stroke cam portion comprised of a curved ascending slope and final ascending low angle, generally flattened slope, the flatten slope portion working in concert with the final low ascending angle, generally flattened slope portion of the head cam plate.

Additional objects and advantages of the invention are the primary rotational torque produced by the power stroke as it descends upon its cam portion and a secondary rotational torque produced by the intake stroke as the power piston descends upon its cam portion, the torque of the intake stroke being communally produced by the power cam spring extension and the centrifugal force imposed on the power piston as the rotor rotates.

Additional objects and advantages of the invention is the capability of the engine to produce four power strokes per revolution of the engine rotor, the result being the ability of the engine to idle at around 100 RPM and have an idealized maximum RPM of around 450 RPM.

Additional objects and advantages of the invention is the capacity of the engine to produce very great amounts of torque in that the beginning and end of the power cam slope can produce an effective arm length of 16.5 inches to 20.5 inches as measured from the vertical centerline of rotation of the engine rotor.

Additional objects and advantages of the invention is that the design diameter of the engine can be decreased or increased to decrease or increase torque output as required by any specific request for amending engine size and torque output.

Additional objects and advantages of the invention is the ability to choose from a variety of materials for its construction. As to parts that are in direct contact to elevated temperatures being steel, aluminum or specialty nylon and to engine parts that are not in direct contact to elevated temperatures being the cam plates and engine case and engine rotor plate, stamped sheet metal or injection molded nylon, the materials cited not being specifically limited as cited.

Additional objects and advantages of the invention is the ability to choose from a variety of parts not conducive to forming on punch presses would be castings, forgings, injection molded parts or precision investment castings in any combination thereof.

Additional objects and advantages of the invention is the capability of the sealed vacuum sleeve which is placed around the power piston portion of the cylinder assembly to curtail radiational energy losses by having the vacuum sleeve and other high temperature environment parts to have a highly polished chrome plated finish to further inwardly reflect the heat radiation emissions created by the internal combustion process.

Additional objects and advantages of the invention is the capability of the mid barrel assembly to have vacuum chambers and connecting internal holes to the vacuum sleeve to maintain the system of minimizing radiational losses around the power piston segment of the cylinder assembly.

Additional objects and advantages of the invention is the capability of the attachment of an exhaust gas canister to the engine exhaust pipe, the canister having multiple internal filter stages to screen out exhaust particulates and other ozone creating pollutants.

Additional objects and advantages of the invention is the low idle and low maximum RPM range of the engine which substantially lowers the operating temperature of the engine case assembly, the engine exhaust pipe and exhaust gas canister.

Additional objects and advantages of the invention are dual centrifugal force oil levers which controls the flow of lubricating oil into the air-oil mist recirculation system located in the mid barrel assembly.

Additional objects and advantages of the invention are a redundant low oil electrical circuit for each oil chamber in the mid barrel assembly which controls an oil control valve or oil supply pump which will re-level the oil supply in the oil chambers.

Additional objects and advantages of the invention is the capability of the power piston portion of the cylinder to provide a separate chamber for the production of positive air pressure for cooling the exhaust-intake chamber in the mid barrel section, a separate chamber for the turbulent creation of the air-oil mist which circulates into the mid barrel chamber passages and into the head piston chamber which also creates the turbulent creation of the air-oil mist which circulates into the mid barrel chamber passages and back into the power piston air-oil chamber.

Additional objects and advantages of the invention is the capability to increase torque substantially by the small increases in piston and cylinder width, small increases in power stroke length and appropriate increases in the sizes of the power and head piston cam plate.

Additional objects and advantages of the invention is that because of the very low self sustaining and maximum revolutions of the engine, the need for speed reducing transmissions is eliminated.

Additional objects and advantages of the invention is the availability of the central bore of the vertical drive shaft portion of the engine, the bore allowing a mounting pin to be installed while attaching a similar engine in the inverted position and installing the projecting end of the pin into the central bore of the vertical drive shaft portion of the second engine, the installation providing (a) a cooperative combining of aligned drive shafts which would double the torque output of a single engine, and (b) the revolving of the second engine whereby the second set of drive shafts could point in a different direct from the direction of the drive shafts of the first engine.

Additional objects and advantages of the invention is that the piston heads that are pressed into place over the piston caps are easily replaceable in that the installation pins only need be removed. In this instance, replacement piston heads of an original design or those which have improved surface and contour designs can easily be reinstalled.

Additional objects and advantages of the invention is that the instrumentation systems, fuel, oil, vacuum, ignition, and electrical systems are all designed with a redundancy so that if one system fails, another is operative, making this horizontally opposed piston engine unique with respect to the prior art.

Additional objects and advantages of the invention is that the outer periphery power piston cam plate and inner periphery head piston cam plate can be manufactured in a mirror-image profile and once installed, will allow the engine to operate in a reverse direction from the counterclockwise direction cited for this invention.

Additional objects and advantages of the invention is the capacity of the engine case assembly to contain any minor oil seepages which makes the engine environmentally sound, the interior of the engine case being readily accessible for interior clean-outs at periodic maintenance visits.

Additional objects and advantages of the invention is the exhaust gas canister design feature, the ability of the canister to be configured internally with materials that are most suited for the interior filter stages, the result being a very low velocity, low pressure and low temperature exhaust gas flow which is not only a low cost solution for air pollution, but is environmentally sound, the entire exhaust gas canister being capable of being refitted with low cost, readily available materials for the internal filter stages. The cooling manifold is an additional design feature whereby an engine operating in a very hot, desert environment has the capacity to periodically wet down the internal filter stages to aid in exhaust gas flow.

Additional objects and advantages of the invention is the elimination of poppet type valves or other valving devices that have many moving parts, need lubrication and can fail which causes the engine to have lower operational reliability than the invention which has a valveless design for both the intake and exhaust gas flows.

BRIEF DESCRIPTION OF THE SEVERAL VIEWS OF THE DRAWINGS

In the drawings, closely related figures will have the same number but different alphabetic suffixes.

FIG. 7 provides various sectionalized views of the power piston components while

FIG. 13 is a proportional drawing of the interior bore and chamber details of the top portion of the mid barrel while FIG. 13A is a proportional drawing of the interior bore and chamber details of the bottom portion of the mid barrel. FIG. 13B is a top schematic view of the top bearing plate outlining many of its details

FIG. 19 is a combination cross sectionalized and proportional view of the commutator unit as it fits within the top bearing cover while

FIG. 22 is a proportionalized assembly drawing of the fixed components of the gear box while

FIG. 23 is a combination of cross sectionalized and proportional drawings of the porting cap and its drive shaft bearing while FIG. 23A is a proportionalized assembly drawing of the porting cap, bearing and the bearing compressor plate.

REFERENCE NUMBERS FOR PARTS

Figure 1:
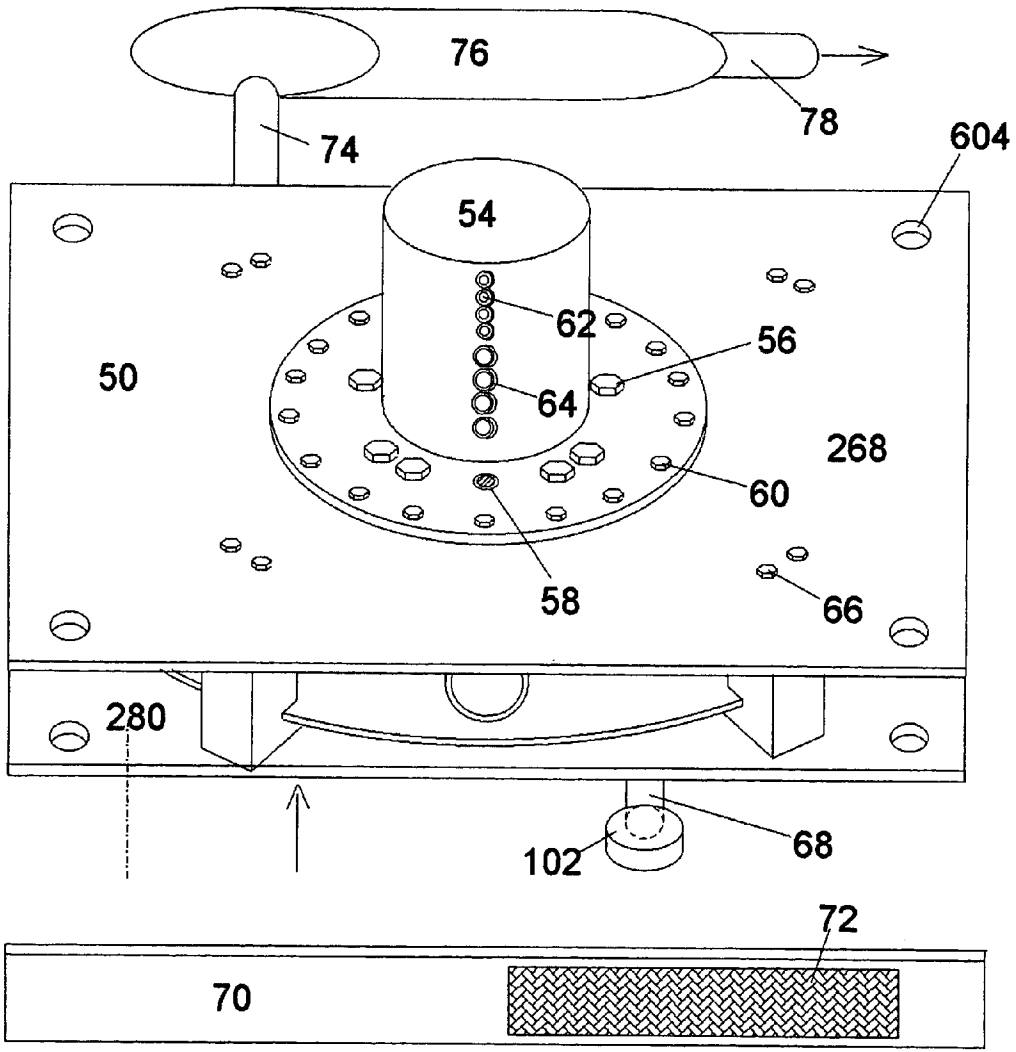
FIG. 1 is a perspective view of the engine case and upper bearing cover plate along with a partial view of the engine rotor and engine exhaust filter canister.

50. Engine case assembly.
52. Engine rotor assembly.
54. Upper bearing cover plate.
56. Upper bearing seat bolt.
58. Boroscope access inspection location.
60. Outer case upper plate perimeter bolts.
62. Ignition and electrical external attach fittings.
64. Fluid eternal attach fittings.
66. Attach bolts for rotor guide block.
68. Engine intake pipe.
70. Case side plate.
72. Case side plate air filter.
74. Engine exhaust pipe.
76. Engine exhaust filter canister.
78. Exhaust canister exhaust pipe.
80. Rotor guide block.
82. Rotor air vane—typical.
84. Rotor lower plate guide slot.
86. Rotor upper plate guide slot.
88. Cylinder power piston end cap.
90. Closed ended cylinder.
92. Head piston cylinder slot—typical.
94. Head piston upper cam bearing.
96. Power piston cylinder slot—typical.
98. Upper power piston cam bearing.
100. Rotor upper plate boroscope access hole.
102. carburetor or fuel control unit.
104. Top bearing plate.
105. Top bearing plate lower surface recess.
106. Centralized vertical axis of rotation.
108. Cylinder head piston end cap.
110. Cylinder support block for head piston end.
112. Horizontal attach bolt—support block for head piston end.
114. Cylinder support block for power piston end.
116. Annular recess for vacuum sleeve.
118. Vacuum sleeve.
120. Horizontal attach bolt—support block for power piston end.
122. Cylinder boss for boroscope access bolt.
124. Cylinder barrel assembly.
126. Barrel upper key.
128. Barrel air-oil mist upper slot—lower right—typical.
129. Cylinder air-oil mist upper slot—upper right.
130. Barrel air-oil mist lower slot—upper right—typical.
131. Cylinder air-oil mist upper slot—lower right.
132. Barrel exhaust port cutout.
134. Barrel intake port cutout.
136. Barrel spark plug cutout—right.
138. Barrel spark plug cutout—left.
139. Cylinder air-oil mist upper slot—upper left.
140. Cylinder power piston cooling air outlet port.
141. Cylinder air-oil mist upper slot—lower left.
142. Barrel port for power piston air-oil mist—right.
143. Cylinder port for power piston air-oil mist
144. Barrel port for power piston air-oil mist—left.
145. Cylinder port for power piston air-oil mist.
146. Cylinder slotted exhaust-intake port.
148. Cylinder slotted intake port.
150. Cylinder spark plug hole—right.
152. Cylinder spark plug hole—left.
154. Bolt hole—power piston internal spring retainer—typical.
156. Bolt hole—head piston internal spring retainer—typical.
158. Hole—vertical attach bolt—typical.
160. Attach bolt for support blocks—typical.
162. Chamber—exhaust-intake port cooling air.
164. Power piston air-oil mist creation area.
166. Head piston air-oil mist creation area.
168. Internal bore—air-oil mist recirculation.
170. Concaved pressure seal cutout—mid block end.
172. Pressure seal.
174. Concaved pressure seal cutout—support block end.
176. Pressure seal.
178. Connecting pipe exhaust-intake chamber air cooling.
180. Sealing bolt—boroscope inspection port.
182. Gasket—boroscope bolt.
184. Internal air check valve—exhaust-intake chamber air cooling.
186. Connecting pipe—air-oil mist recirculation. right side
187. Connecting pipe—air-oil mist recirculation. left side
188. Mid barrel—upper half.
190. Mid barrel—lower half.
192. Power piston piston rod.
194. Power piston—piston head.
196. Piston rings in grooves in power piston—typical.
198 Power piston, intake port web.
200. Surface—power piston.
202. Non-abrasive spring sleeve.
204. Power piston spring.
206. Neck portion—power piston rod.
208. Power piston interior cup.
210. Weld location—interior cup to power piston rod.
212. Power piston—spring retainer.
214. Power piston—piston head.
215. Power piston bearing retainer assembly.
216. Cup portion—bearing retainer assembly.
218. Power piston lower cam bearing.
220. Sleeve—power piston bearing pin—typical.
222. Power piston assembly.
224. Pressure pad insert—typical.
226. Cam bearing location—typical.
228. Head piston assembly—without bearing retainer assembly.
230. surface—head piston.
232. Head piston—web cutout portion.
234. Head piston—exhaust—intake port cutout.
236. Piston rings in grooves in head piston—typical.
238. Head piston lower cam bearing.
240. Sleeve—head piston bearing pin—typical.
242. Head piston assembly.
243 Pressure pad insert—typical.
244. Non-abrasive spring sleeve.
246. Head piston spring.

248. Neck portion—head piston rod.
250. Interior cup—head piston head.
252. Weld location—interior cup to head piston rod.
254. Head piston spring retainer.
256. Head piston piston rod.
258. Head piston piston head.
259. Head piston bearing retainer assembly.
260. Lock pin—typical.
262. Threaded end—piston rod—typical.
264. Nut—piston rod end—typical.
266. Upper bearing clamp ring—bearing inner race.
268 Engine case upper plate.
270. Upper roller bearing—rotor.
272. Engine rotor upper plate.
274. Lower bearing clamp ring—bearing inner race.
276. Engine rotor lower plate.
278. Lower roller bearing—rotor.
280. Engine case lower plate.
282. Bolt—upper clamp bearing ring—typical.
284. Bolt—lower clamp bearing ring—typical.
286. Hole—assembly bolt—mid barrel upper portion—typical.
288. Hole—assembly bolt—mid barrel lower portion—typical.
290. Threaded hole—commutator unit mounting—typical.
292. Nut—assembly bolt—typical.
294. Space—vacuum area between blinder and vacuum sleeve.
296. Cutout area—commutator unit mounting boss.
298. Commutator unit mounting boss.
300. Hole—vacuum supply to vacuum chamber in mid barrel upper portion.
302. Vacuum chamber in mid barrel upper section—typical.
304. Hole—vacuum supply communicating with vacuum space in sleeve.
306. Hole opening—alternate side vacuum supply.
308. Mid barrel raised land portion.
310. Slot—barrel upper key.
312. Spark plug as installed—right.
313. Spark plug as installed—left.
314. Machined clearance cutout—oil supply chamber plug.
316. Assembly bolt—typical.
318. Assembly bolt special head with flat—typical.
320. Vacuum chamber—right side—upper mid barrel.
322. Oil chamber—left side—upper mid barrel.
324. Vacuum chamber—left side—upper mid barrel.
326. Passage, right side—air-oil recirculation system—upper mid barrel.
328. Oil chamber—right side—upper mid barrel.
330. Chamber—exhaust-intake port area—lower mid barrel.
332. Oil chamber—right side—lower mid barrel.
334. Passage, left. side—air-oil recirculation system—upper mid barrel.
336. Chamber—right entry point-air-oil recirculation system—lower mid barrel.
338. Chamber—left entry point-air-oil recirculation system—lower mid barrel.
340. Chamber—intake port area—lower mid barrel
342. Oil Chamber—left side—lower mid barrel.
344. Passage, right side—air-oil recirculation system—lower mid barrel.
346. Passage, left side—air-oil recirculation system—lower mid barrel.
348. Hole—access for exhaust-intake port cooling system—lower mid barrel.
350. Pipe—exhaust-intake port cooling system communicating with chamber.
352. Cover—exhaust-intake chamber.
354. Cover—right entry chamber for air-oil recirculation system.
356. Access hole—air-oil system pipe—right side—lower mid barrel.
358. Access hole—air-oil system pipe—left side—lower mid barrel.
360. Cover—intake chamber—lower mid barrel.
362. Cover—entry chamber for air-oil recirculation system.
364. Top plug—right side oil chambers—top bearing plate.
366. Top plug—left side oil chambers—top bearing plate.
368. Hole—clearance for right spark plug—top bearing plate.
370. Hole—clearance for left spark plug—top bearing plate.
372. Hole—oil resupply for right side oil chambers—top bearing plate.
374. Hole—oil resupply for left side oil chambers—top bearing plate.
376. Hole—fuel primer/fuel injection port-right spark plug—top bearing plate.
378. Hole—fuel primer/fuel injection port-left spark plug—top bearing plate.
380. Land portion—inside race of upper roller bearing—rotor.
382. Oil tube—secondary oil level sense system—left side—top bearing plate.
384. Oil tube—primary oil level sense system—left side—top bearing plate.
386. Oil tube—secondary oil level sense system—right side—top bearing plate.
388. Oil tube—primary oil level sense system—right side top bearing plate.
390. Lever—oil dispensing valve—right side—top bearing plate.
392. Lever—oil dispensing valve—left side—top bearing plate.
394. Chamber—exterior portion of exhaust-intake port.
396. Port—exhaust-intake channel—lower mid barrel.
398. Transfer clearance—exhaust-intake chamber to exhaust-intake channel.
400. Exhaust port inner housing.
402. Inner surface for bearing—typical.
404. Land—bearing inner race—typical
406. Support pad—rotor plate—typical.
408. Hole, threaded—bearing seat bolt—typical.
410. Spacer—upper mid barrel to rotor upper plate.
412. Exhaust port—lower mid block.
414. Intake port—lower mid block.
416. Spacer—lower mid block to rotor lower plate.
418. Cutout—right spark plug.
420. Cutout—left spark plug.
422. Commutator assembly.
424. Commutator cover assembly.
426. Commutator top key.
428. Electrical exit points—typical.
430. Fluid line exit points—typical.
432. Bolt—commutator unit.
434. Commutator electrical slip ring—typical.
436. Commutator unit electrical slip ring—typical.
438. Commutator fluid line connection with commutator cover assembly.
440. Hose fitting—commutator fluid output port—typical.
442. Fluid hose—typical.
444. Cover with internal key portion—upper bearing cover plate.
446. Central electrical wire exit hole.
448. Fluid bore—typical.
450. Bottom bearing plate.

452. Land—rotor bearing inner race—bottom bearing plate.
454. Center shaft—bottom bearing plate.
456. Keyway for shaft mounted drive spur gear.
458. Key for center shaft.
460. Clearance for socket wrench for assembly bolt nut.
462. Spur drive gear.
464. Direction of engine rotation.
466. Bearing—center shaft—top location.
468. Bearing—center shaft—bottom location.
470. Nut—assembly bolt—typical.
472. Pipe—interior connecting to intake annulus.
474. Pipe—interior connecting to exhaust-intake annulus.
476. Pad portion—output shaft cover.
478. Gear box cover.
480. Bottom cover plate—output shaft.
482. Lock pin for cover plate—typical.
484. Hole—access for balancing pin or engine work stand mount.
486. Annulus—intake manifold connection.
488. Annulus—exhaust manifold connection.
490. Boss—output shaft—typical.
492. Bearing—output drive shaft—typical.
494. Bolt—vertical assembly.
496. Bolt—vertical assembly.
498. Spacer—bearing outer race.
500. Fixed porting cap—four engine cycle.
502. Exhaust port—typical.
504. Intake port—typical.
506. Flange—porting cap.
508. Bearing compressor plate.
510. Bearing—gearbox housing.
511. Center shaft clearance.
512. Hole—vertical assembly—typical.
514. Hole—horizontal assembly—typical.
516. Output shaft—left.
518. Output shaft—right.
520. Gearbox housing.
522. Outer tube portion—porting cap.
524. Mid tube portion—porting cap.
526. Inner tube portion—porting cap.
528. Recess—inner tube portion—bearing compressor plate.
530. Recess—Bearing—center shaft—bottom location.
532. Case—output gearbox.
534 Pad—case.
536. Boss exhaust port.
537. Boss intake port.
538. Lock pin—bottom cover—typical.
540. Output shaft boss portion—output gearbox
542. Oil tube—typical.
544. Fill hole—oil tube—typical.
546. Operating arm—oil needle valve.
548. Float—oil level sense—typical
550. Electrical contact cap—typical.
552. Counterweight—operating arm—typical.
554. Plug—lever arm clearance—oil chamber—typical.
556. Slot—operating arm swing clearance—oil chamber plug—typical.
558. Hole—oil tube—oil chamber plug—typical.
560. Redundant low oil level contactors and attached wires.
562. Remote oil resupply valve or oil resupply pump.
564. Electrical ground—oil resupply valve or oil resupply pump.
566. Pivot—operating arm.
568. Oil supply needle valve—typical.
570. Flat face—oil supply needle valve.
572. Oil needle valve—right.
573. Oil needle valve—left.
574. Oil inlet port—needle valve housing—typical.
576. Oil outlet port—needle valve housing—typical.
578. Adjusting nut—needle valve spring—typical.
580. Needle valve spring—typical.
582. Oil chamber area—typical.
584. Air-oil mist passage—typical.
586. Average internal compression pressures during air ingestion only.
588. Average ignition point—reciprocating gasoline engine.
590. Average retarded ignition point for reciprocating gasoline engine.
592. Top dead center average internal pressures—recip gasoline engine.
594. Cylinder internal pressure curve—low efficiency gasoline engine.
596. Cylinder internal pressure curve—high efficiency gasoline engine.
598. Average internal pressure—start of combustion.
600. Average internal pressure—end of combustion.
602. Crank arm lengths as reciprocating crank rotates.
604 Engine mount holes.
606. Outer periphery power piston cam plate.—upper
607. Outer periphery power piston cam plate.—lower
608. Inner periphery head piston cam plate—upper.
609. Inner periphery head piston cam plate.—lower
610. Start—power stroke—typical.
612. Power piston power stroke cam—typical.
614. End-power stroke cam slope/start exhaust cam slope-power piston—typical.
616. Power piston exhaust stroke cam—typical.
618. End-exhaust stroke cam slope/start intake cam slope-power piston—typical.
620. Power piston intake stroke cam—typical.
622. Power piston end of intake slope.
624. Power piston first stage mid compression slope cam—typical.
626. Power piston second stage compression stroke flat.
628. Power piston near end of compression slope—typical.
630. Head piston power stroke cam flat—typical.
632. Head piston end of power stroke cam slope—typical.
634. Head piston end of exhaust stroke cam slope—typical.
636. Head piston mid compression cam slope—typical.
637. Combustion event.
638. Exhaust-intake port open.
639. Intake port open.
640. Exhaust gas flow into canister.
642. Filter interstage exhaust temperature probe.
644. Electrical connection—exhaust temperature probe.
646 Exhaust port pipe attach studs.
648. Engine exhaust port—typical.
650. Canister—exhaust gas filter.
652. Canister water cooling manifold.
654. Manifold valve or water pump.
656. Electrical connection—manifold valve or water pump control.
658. Canister exhaust pipe.
660. Water supply tank with connective piping.
662. Heat sink filter stage—typical.
664. Exhaust gas heat absorptive filter stage—typical.
666. Canister interior cooling inlet locations.
668. Perforated internal tray—canister filter contents—typical.

BRIEF DESCRIPTION OF THE INVENTION

The invention is based on the need to not only break through the long established 1:1 design ratio of one pound of torque versus one pound of engine weight, particularly for aircraft engine designs, but to use a single closed ended cylinder that produced four power strokes per revolution and in the process, create a high rate of torque return the moment the engine reached its self sustaining speed. By achieving these fundamental technical goals, the invention would return very substantial savings in fuel consumption, act as a normally aspirated engine which would use a moderate compression ratio and completely avoid the operational pitfalls of a wide range of reciprocating engine designs that would employ supercharging and other more exotic means to extract the most power from a given volume of fuel-air mixture. Further, the invention was premised on the need to produce a machine that would address the high rate of radiational heat losses of conventional engine designs while, at the same time, employ an integral set of design features that would have an engine case that would have a cloistered, filtered access to the atmosphere while internally consuming its own vaporous products which all engines produce while, at the same time, address the cleanup of the low volume of exhaust gasses in that the inherently low self sustaining and maximum rotational speeds could be effectively taken advantage of by a specially designed exhaust gas canister system that would cheaply and simply give a scrubbing to exhaust gasses that were simply ignored by the prior art engines in this subclass.

DETAILED DESCRIPTION OF THE INVENTION

Before explaining the present invention in detail, it is to be understood that the present invention is not limited or restricted in any way in it application or uses relative to the details of construction and arrangement of parts as illustrated by the accompanying drawings, because the present invention is capable of other embodiments and variations and of being produced or carried out in various ways. Furthermore, it is to be understood that the phraseology or terminology employed here is for the purpose of description and illustration only, and not for the purpose of limitation or restriction. Further still, discussions of mechanical dimensions, angles and other various operative descriptive terms are for illustration only and are not for the purpose of limitation or restriction.

As an extended preliminary statement, the detailed description of the invention and its various operational characteristics reflects the stated preferred embodiments which will now follow, however, there are always contingent alternative embodiments which can be equally employed and easily integrated into the descriptive design that is to follow, thus, the preferred embodiment must not be limited or restricted in any manner.

Considering the fact that the forty three prior art patents have retrogressed in torque output as compared to the torque capabilities of the conventional reciprocating engine with its connecting rods and crankshaft, the present invention provides a novel and fully understandable horizontally opposed piston engine operating under the now-conventional Otto five event, four stroke engine. Because the invention has only three moving parts that produce the power output for the vertical drive shaft, it is a substantial step forward in the existing art, something that persons not skilled in the art can readily comprehend. Further, the attachment of a vacuum sleeve over power piston portion of the cylinder assembly is a means to lessen the radiational losses that were common with the prior art, Still further, the addition of an exhaust gas filter canister to the engine exhaust pipe is yet another step forward to producing an environmentally acceptable engine for the commercial ground vehicle and aviation markets.

Figure 2:
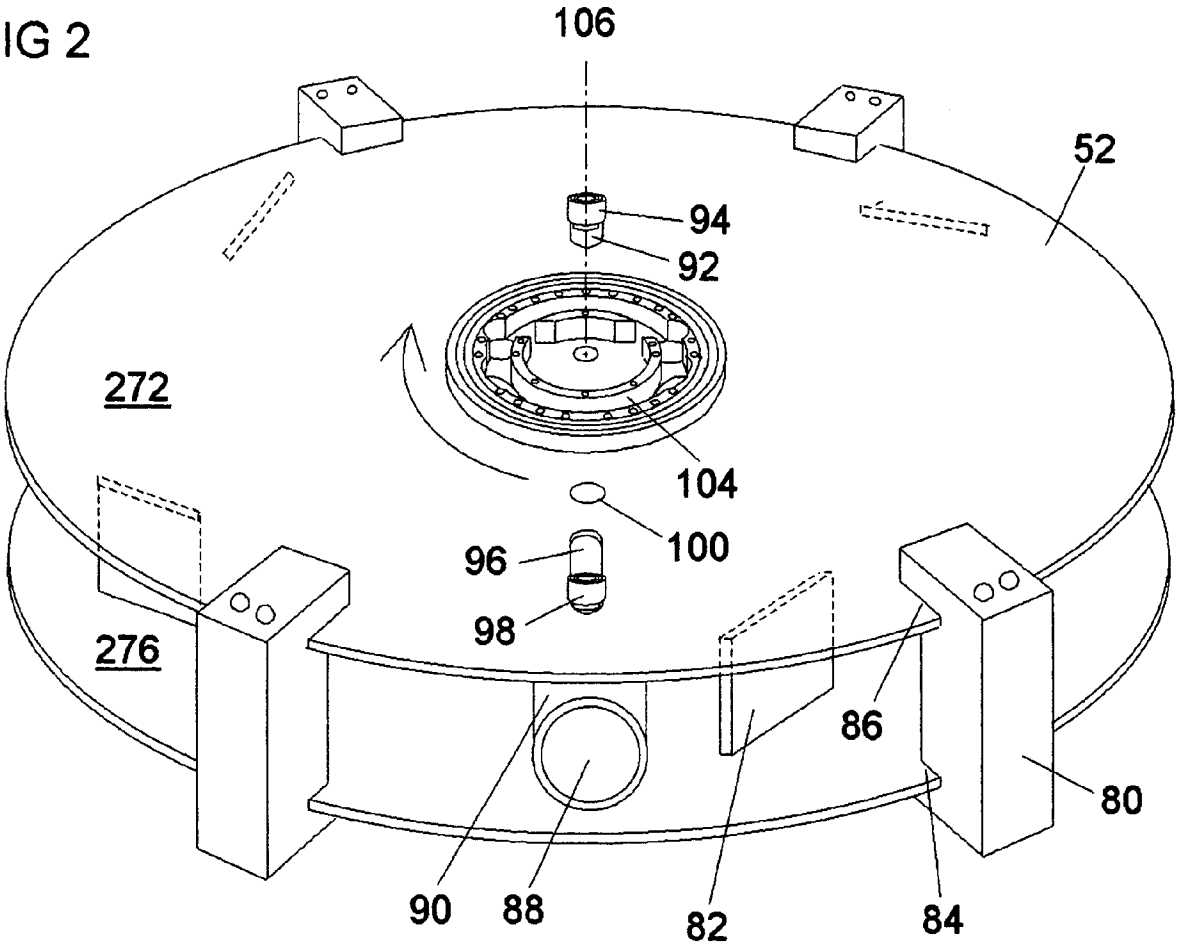
FIG. 2 is a perspective view of the engine rotor with its upper and lower plates, rotor guide blocks, air vanes, top rotor being, projecting power and head piston bearings and its top bearing plate.

The mechanical aspects of the invention are very simple as shown by FIG. 1 in that the fixed 50 engine case assembly houses the 52 engine rotor assembly which can be seen in more detail in FIG. 2. FIG. 1 is instructive in its cross view of the 268 engine case upper plate, 272 engine rotor upper plate, 276 engine case lower plate, 280 engine case lower plate, the plates, 268, 272, are cojoined by the 270 upper roller bearing for the rotor and the plates 276, 280 are cojoined by the 278 lower roller bearing for the rotor. The single 90 cylinder is mounted in the 52 engine rotor assembly as shown in FIG. 2, wherein the 94 upper head piston cam bearing and the 98 upper power piston respectively project through the 251 engine rotor upper plate by provision of the 92 head piston slot and the 96 power piston slot, the slots being more evident in FIG. 3A.

Figures 3, 3A, 3B:
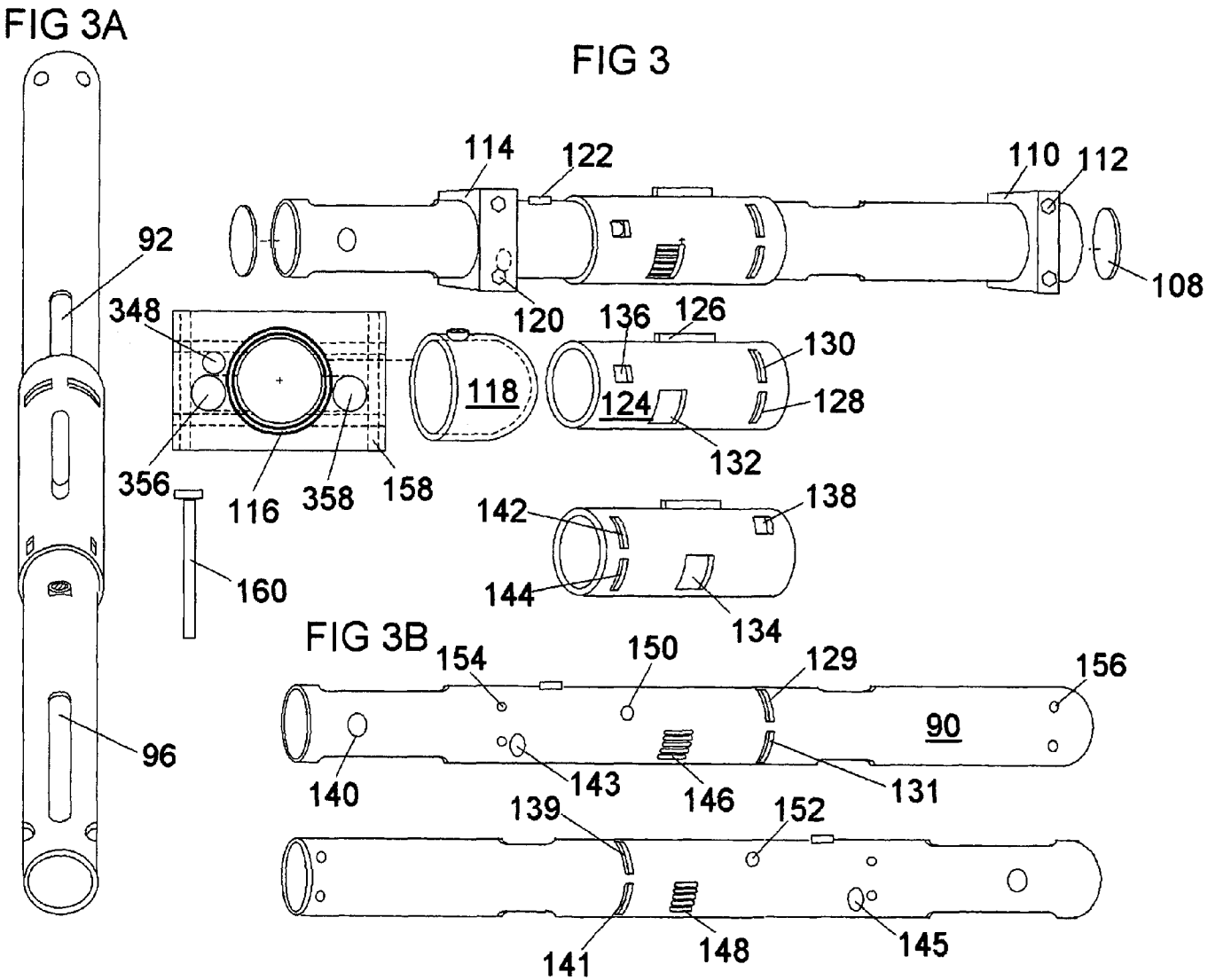
FIG. 3 is a perspective view of the cylinder assembly with its support blocks and various openings, along with the vacuum sleeve.
FIG. 3A is a top perspective view of the assembled cylinder assembly.
FIG. 3B is a right and left-hand view of the unassembled cylinder.
Figures 11, 11A:
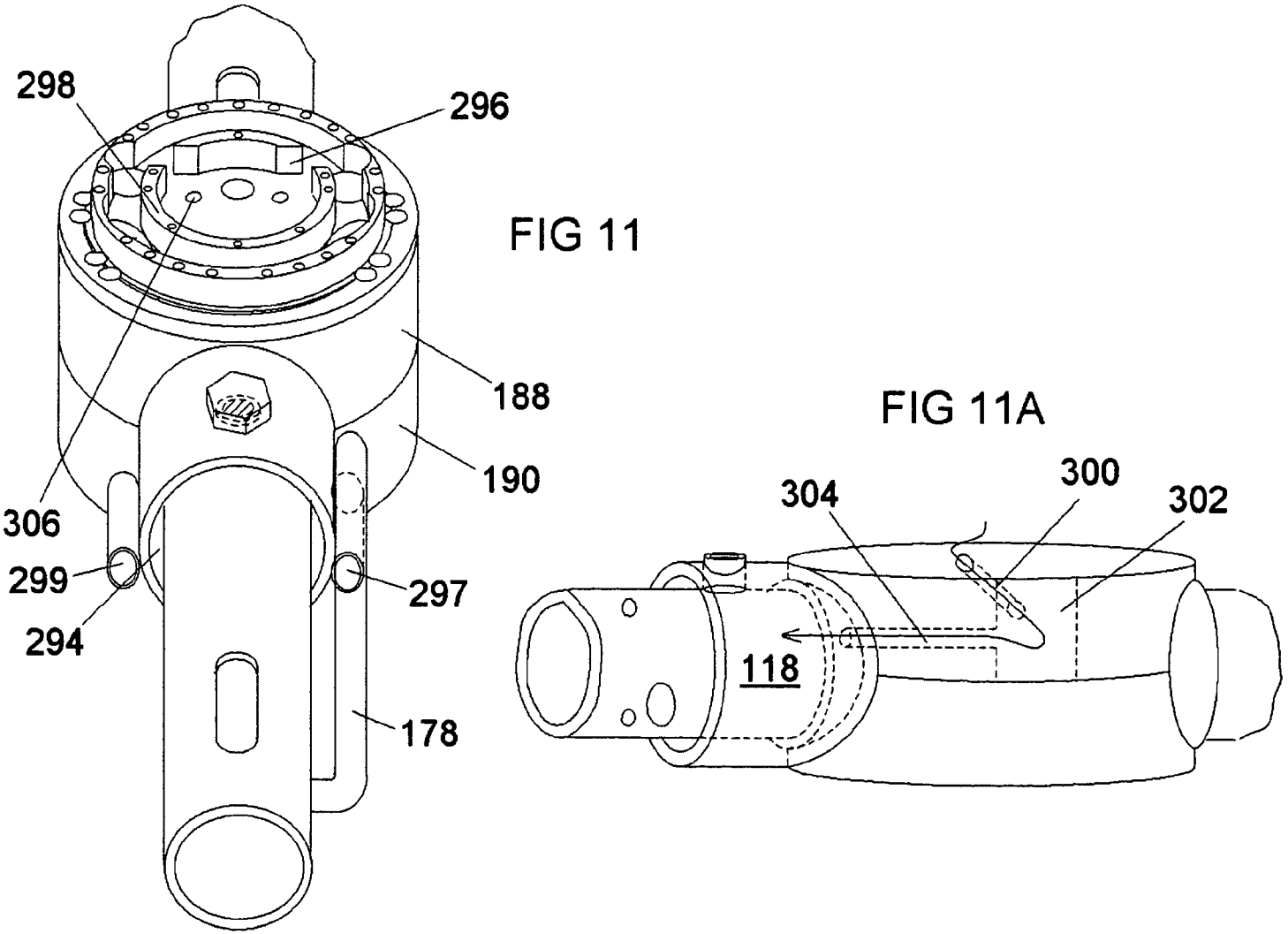
FIG. 11 is a proportionalized top view of the cylinder assembly as it is nested in the top bearing plate and mid barrel assemblies, the bottom bearing plate not shown for drawing simplicity.
FIG. 11A shows the vacuum flow through the mid barrel upper half.
Figure 20A:
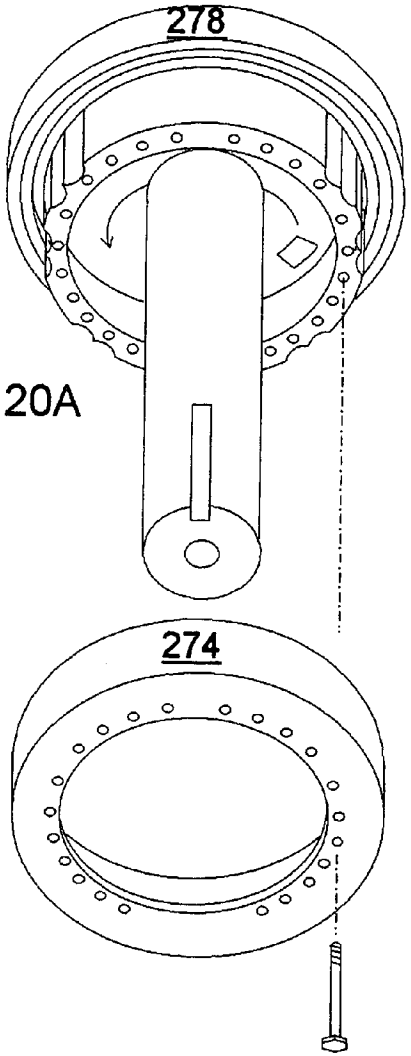
FIG. 20A is a proportional drawing of the bottom bearing plate with the lower rotor bearing installed and the lower bearing clamp ring as it would against the inner race portion of the bearing in the final installation.
Figure 20:
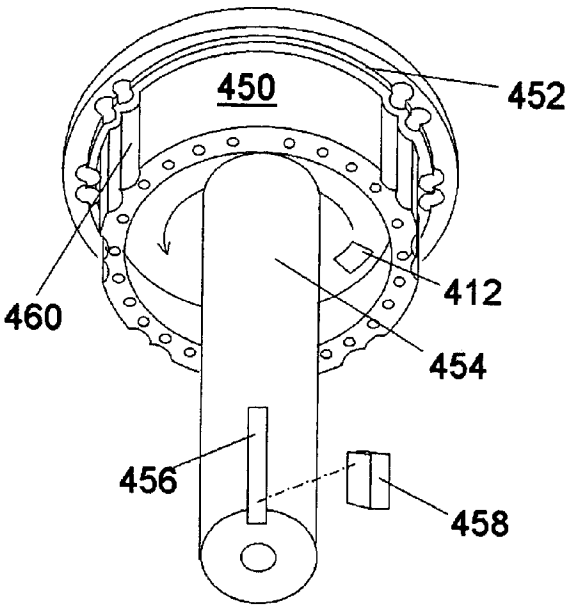
FIG. 20 is a proportionalized view of the bottom bearing plate with its projecting drive shaft portion.

FIG. 3 is a comprehensive view of the 90, 124 entire cylinder assembly which shows its mechanical attachments of 114 cylinder support block for the power piston end, the 110 cylinder support block for the head piston end. Centrally located, cylinder barrel assembly is a tight slip fit over the 90 cylinder and its 126 barrel upper key provides a precise linear location for the 90, 124 entire cylinder assembly is shown by FIG. 11 to be compressively sandwiched between the 188 mid barrel upper half and the 190 mid barrel lower half. In turn, the 188, 190 mid barrel halfs are compressively sandwiched between the 104 top bearing plate and the 450 bottom bearing plate which can be seen in more detail in FIG. 20. Further, the sandwiched construction feature of the cylinder assembly can also be reviewed in FIG. 6A.

Continuing with the overall perspective, FIG. 1 shows the 102 carburetor or fuel control unit as it is connected to the 68 engine intake pipe and once the combustion process is completed there is shown the 74 engine exhaust pipe which is attached to the 76 engine exhaust filter canister and its 78 exhaust canister exhaust pipe.

Before any other operational descriptions continue it is to be recognized that the invention has the capabilities for having instrumentation for its operation, has self contained oil storage chambers with automatic oil feed based on the speed of engine rotation, has an internal air-oil mist lubrication system for the power and head pistons, has an air cooled exhaust-intake port which provides additional airflows within the exhaust-intake chamber during both the exhaust and intake strokes. The invention also has the dual capability of providing the major torque during the combustion event and a lesser, secondary torque production during the intake stroke along with a vacuum sleeve and supporting vacuum system that assists in minimizing the loss of radiational heat during the combustion stroke. Further, the outboard end of the power piston is specifically chambered to first take in engine compartment atmosphere during the exhaust and compression strokes and to secondly, compress the chambered air and direct it through the appropriate piping into the exhaust-intake chamber during the power and intake strokes.

The unique internal air-oil turbulences created by the power and head pistons in their respective cylinder chambers cause the air-oil mist to continually recirculate through the redundant passages in the alternate sides of the mid barrel assembly. The engine design features also take in mind the importance of routine maintenance and easy accessibility to the various components including the power piston and head piston upper and lower bearings and all of the engine system aspects located on the top bearing block and mid block assembly.

Further, the lower gearbox area contains internal parts that are easily removable for inspection or replacement along with the capability to configure the engine drive shafts at various angles as a particular installation demands.

Because much of the internal operational activity centers around the 104 top bearing plate, the assembled 188,190 mid barrel assembly and the 450 bottom bearing plate, a logical starting point would be FIG. 3 where a more detailed breakdown of the component parts can be found.

The inside diameter of the 124 cylinder barrel assembly is a tight slide fit with the outside diameter of the 90 cylinder, while the outside diameter of the 124 cylinder barrel will be a tight compressive fit between the 188, 190 mid barrel assembly. Since the complete cylinder barrel fits compatibly with the 104 top bearing plate and the 450 bottom bearing plate, the 126 upper barrel key closely fits into the 310 key slot for the 104 upper barrel top bearing plate so as to finalize the locating and fitting the various parts mentioned.

FIG. 3 demonstrates that the barrel is manufactured with properly located rough size openings that coincide with the more precise openings in the 90 cylinder. Looking at the barrel from two sides, the 130 barrel air-oil mist upper slot, the 130 barrel air-oil mist lower slot for the right side and the 128 barrel air-oil mist lower slot and the 144 barrel air-oil mist upper slot for the left side align with the respective air-oil mist slots for the 90 cylinder shown in FIG. 3B. When the engine starts to heat up and come up to operating temperatures, the material expansions will tightly join the assembled parts into a leak tight unit.

Equally so, the rough 136 barrel spark plug cutout for the right side and the 138 barrel spark plug cutout for the left side aligns with the final 150 cylinder spark plug hole, right side and the 152 cylinder spark plug hole, left side. Finally, the 132 barrel exhaust port cutout and the 134 barrel intake port cutout aligns respectively with the 146 cylinder slotted exhaust-intake port and the 148 cylinder slotted intake port respectively.

Figure 26A:
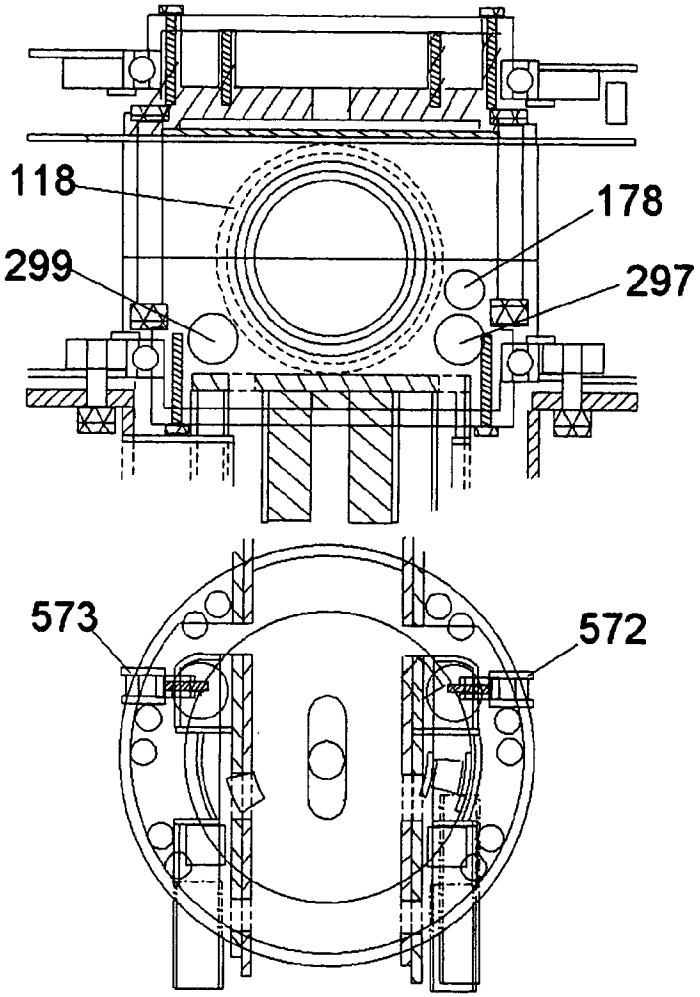
FIG. 26A are similar sectionalized view that have been rotated for the purpose of more detail.
Figure 26:
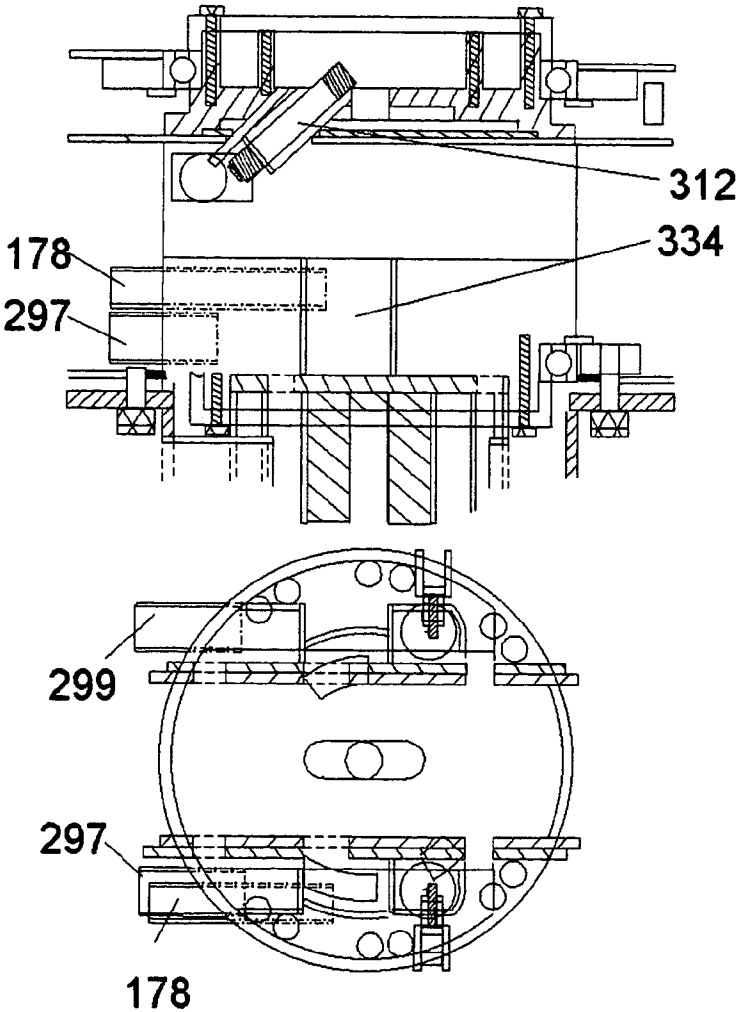
FIG. 26 is a combination of sectionalized views of the top and bottom bearing plates with their respective interior compartments while the lower sectionalized view of the top portion of the mid barrel with its interior compartments with installed air-oil recirculation pipes and exhaust-intake compartment air cooling pipe.

A top perspective view of the assembled 90,124 cylinder barrel assembly with its 92 head piston blinder slot and it 96 power piston cylinder slot is illustrated. The 114 blinder support block for the power piston end, shown in a revolved schematic view, shows the 116 annular recess for the 118 vacuum sleeve along with the matching pipe holes 345, 346, 358 which align with the pipe holes 345,346,358 depicted in FIG. 14 while FIG. 26 and FIG. 26A gives further schematic views of the pipes as they are assembled into the 190 mid barrel lower half.

Figure 4:
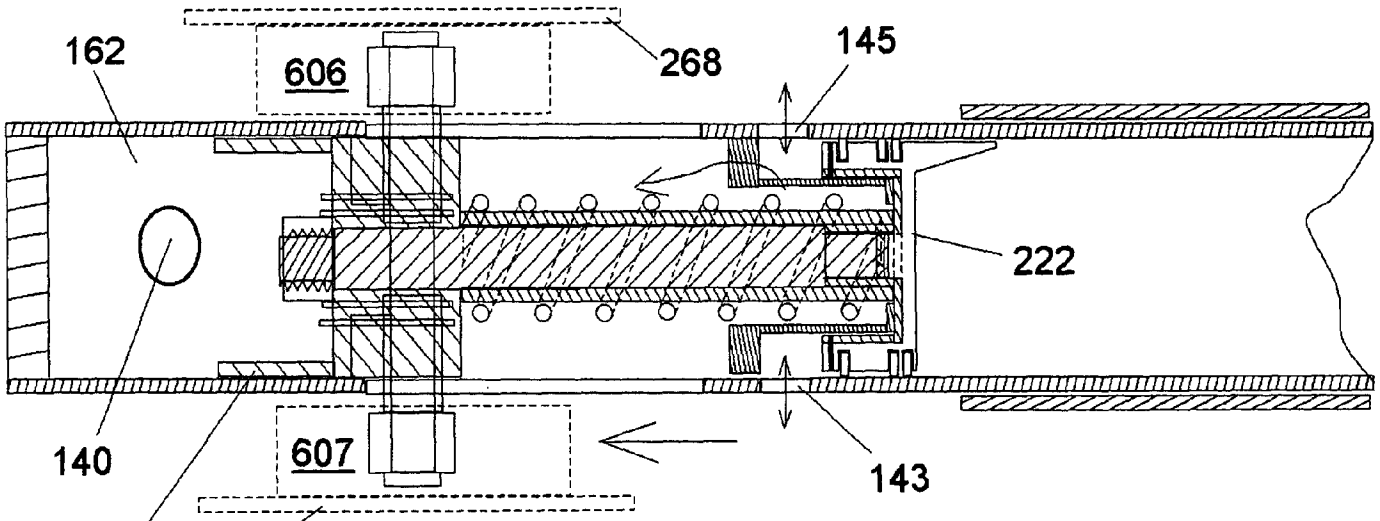
FIG. 4 is a cross sectionalized view of the power piston in its fully traveled position with notation of the cylinder air cooling compartment.
Figure 4A:
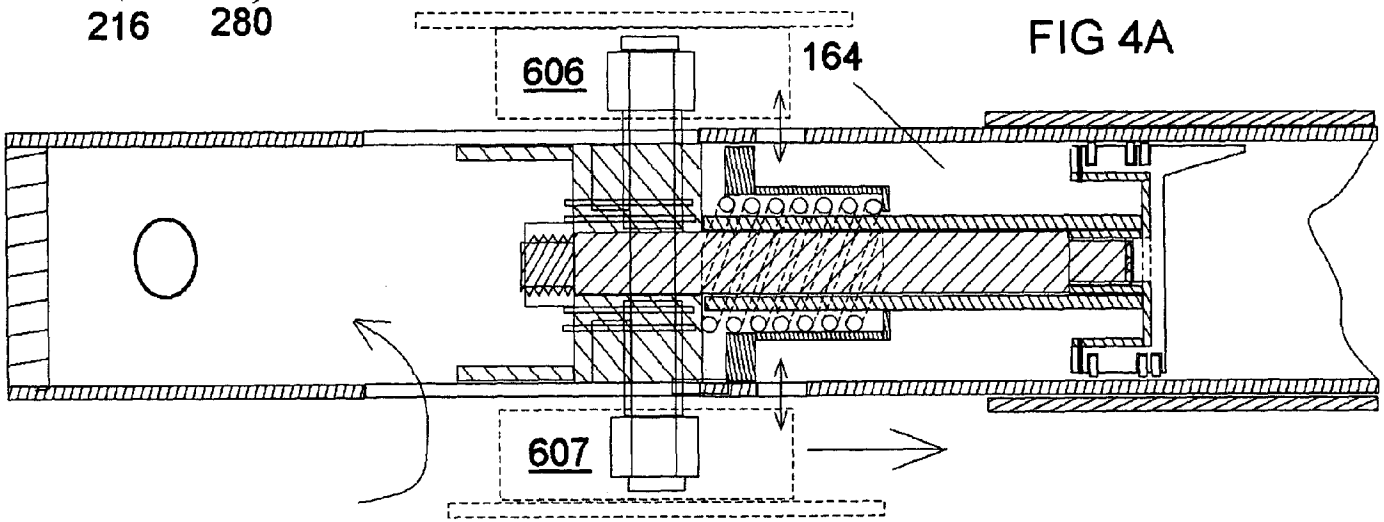
FIG. 4A is a cross sectionalized view of the power piston in its most retracted position. Both views show contact of the bearings with their respective upper and lower cams.
Figures 5, 5A:
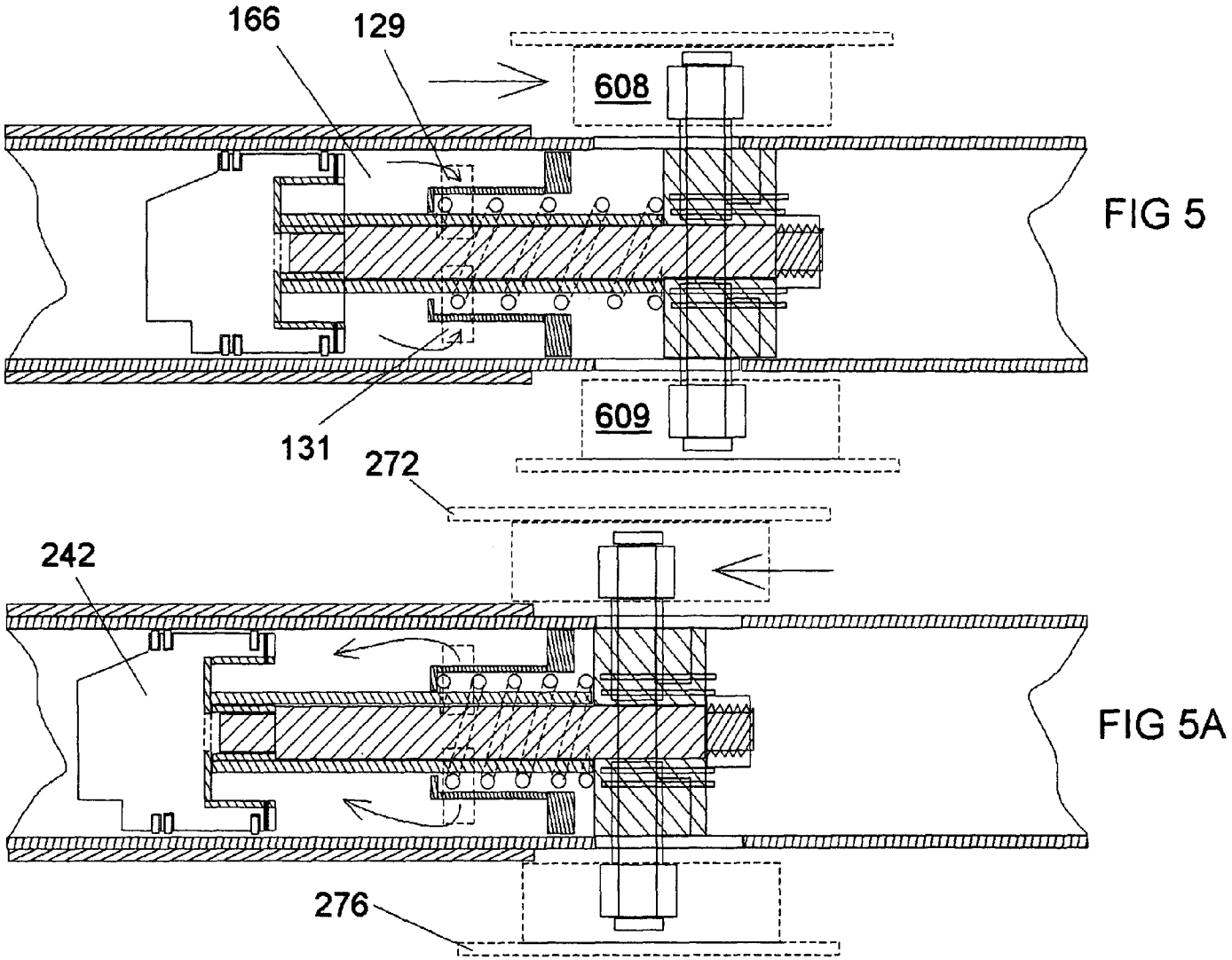
FIG. 5 is a cross sectionalized view of the head piston in its fully traveled position.
FIG. 5A is a cross sectionalized view of the head piston in is most retracted position. Both views show contact of the bearings with their respective upper and lower cams.

The 140 cylinder power piston cooling air outlet port in FIG. 3 is again shown in FIG. 4 and FIG. 4A where a cross sectional view of the 222 power piston is shown in its extreme travel extents within the 90 cylinder. The 162 chamber for the exhaust-intake port cooling air shows it circulations. When the details of the power piston construction in FIG. 7, FIG. 7A and the details of the head piston construction are discussed in FIG. 8, FIG. 8A, particularly the installation process which addresses the projecting piston bearings 94,96, 218, 238, the installed pistons will be finalized by the installation of the 88 cylinder power piston end cap and the 108 cylinder head piston blinder cap.

In terms of the final assembly procedure before installation in the 52 engine rotor assembly, the 118 vacuum sleeve is slid into place over the cylinder power piston end. The inboard side of the 118 sleeve compressively contacts the 188, 190 mid barrel assembly on its outside surface as seen in FIG. 26A by the indication of the dashed lines for the point of contact. The outboard end of the 118 sleeve fits mechanically into the inboard 116 annular recess for the 118 vacuum sleeve.

Figures 6, 6A, 6B:
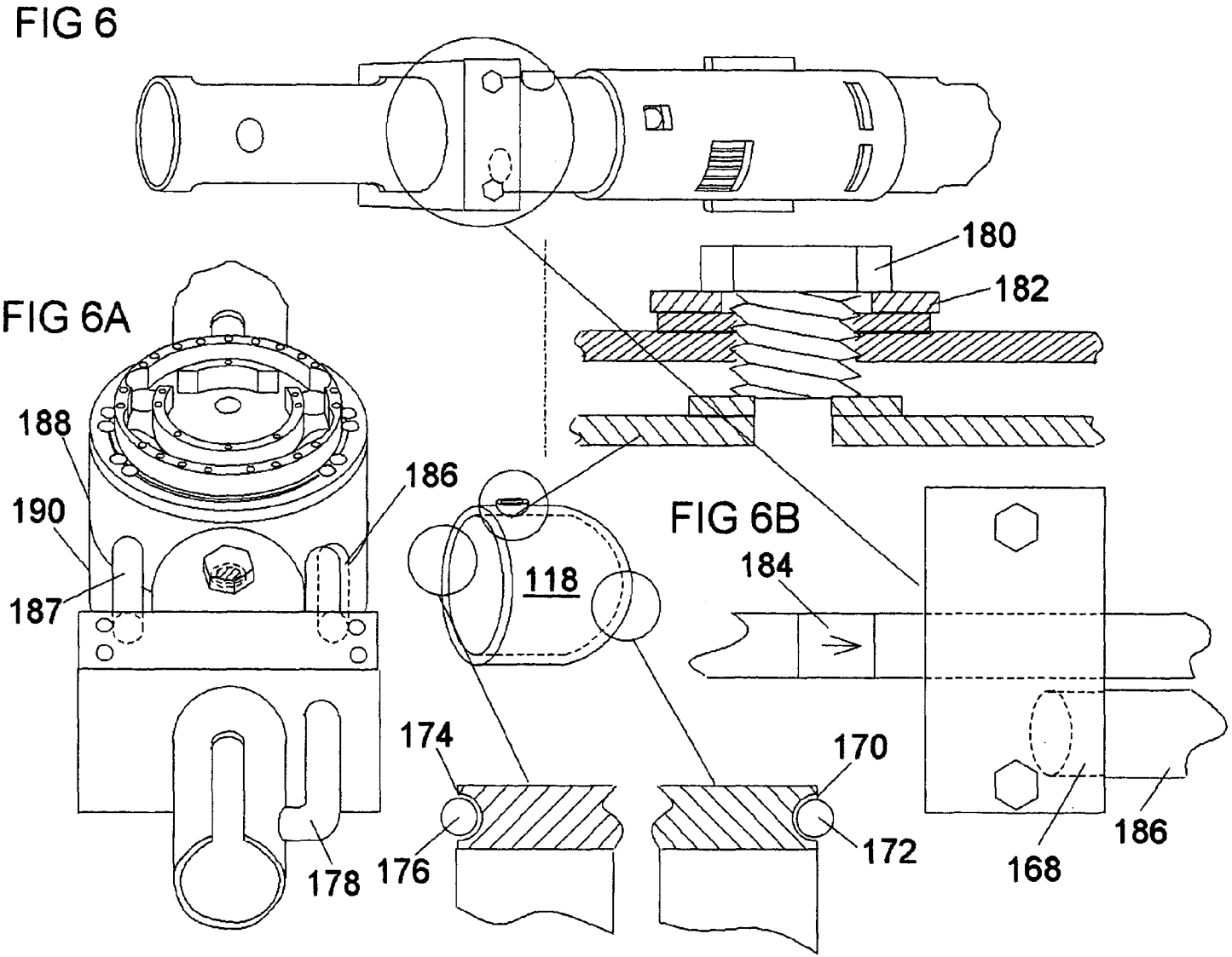
FIG. 6 is a partial perspective view of the power piston end with it support block.
FIG. 6A is a top perspective view of the cylinder assembly as it is installed in the top bearing plate and mid barrel assembly. The bottom bearing plate was omitted for simplicity.
FIG. 6B is a schematic composite view of the boroscope plug, the vacuum sleeve and its sealing details. Additional view of the power piston support block.

More 118 vacuum sleeve installation details are provided in FIG. 6B. The inboard and outboard ends of the 118 vacuum sleeve have a 170 concaved pressure seal cutout along its edge and a 174 concaved pressure seal contact along its edge as it nests into the 116 annular recess. Once the 114 support block is slid over the 90 cylinder, the respective seals 170, 174 compress and provide a sealed cylinder vacuum chamber to minimize the radiational heat losses of the engine. During assembly, the internal bore dimensions of the 114 support block is designed as a tight slip fit onto the cylinder outside diameter so as to minimize vacuum losses within the 118 sleeve.

Appropriately sized 160 attach bolts, typical, for the support blocks fit horizontally through the 112, 120 support block holes and through the cylinder, securing both support blocks 110, 114 into a proper location for the vertical attach bolts that will be eventually installed to secure the cylinder 90 between the 272 engine rotor upper plate and the 276 engine rotor lower plate. The typical horizontal bolt holes, 154, 156, for the cylinder are shown in FIG. 3. A typical 158 hole for the vertical attach bolt is depicted as well as a typical 160 bolt.

FIG. 6 and FIG. 6B provides some expanded constructional details of the 90 blinder and its 114 support block. Once the 118 vacuum sleeve is installed the 180 sealing bolt for the boroscope inspection port is threaded into the 118 sleeve, the 180 bolt seats on a 182 gasket. Being tightly secured and safetied, the cylinder internal pressure integrity is not compromised during engine operation. At inspection intervals, the engine being rotated by hand into a proper position, the 180 sealing bolt is removed allowing the insertion of the boroscope tube so as to inspect the cylinder walls and other surrounding internal features.

Figure 14A:
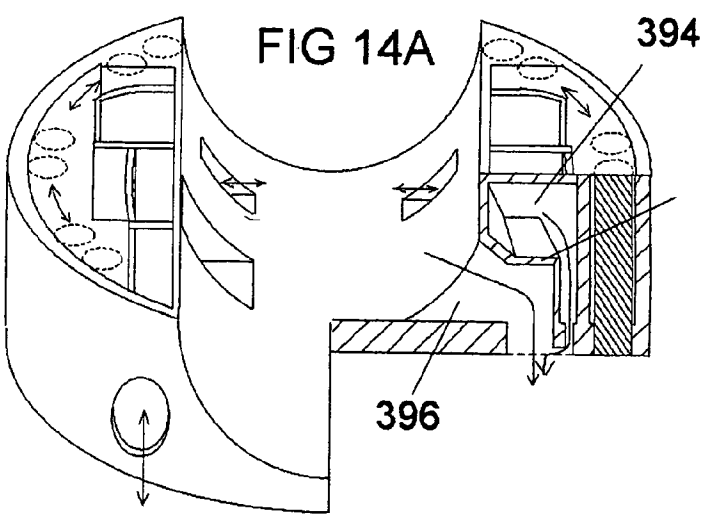
FIG. 14 is a proportional drawing of the interior bore and chamber details of the bottom portion of the mid barrel before sectioning which is detailed by FIG. 14A and FIG. 14B showing the exhaust-intake flows.
Figure 14B:
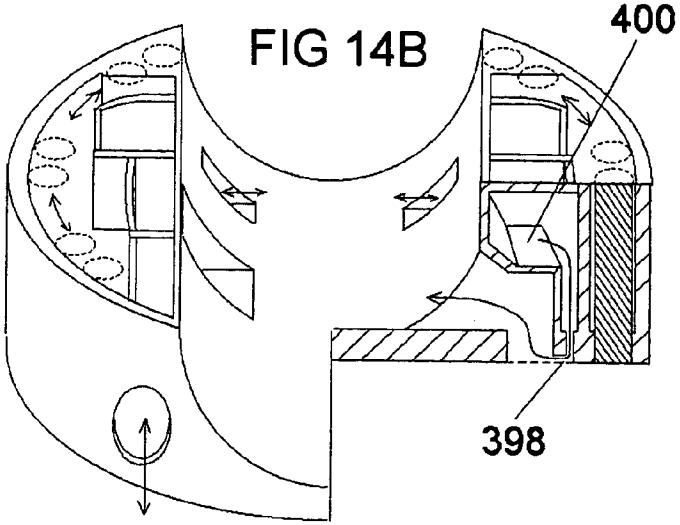
Figure 14:
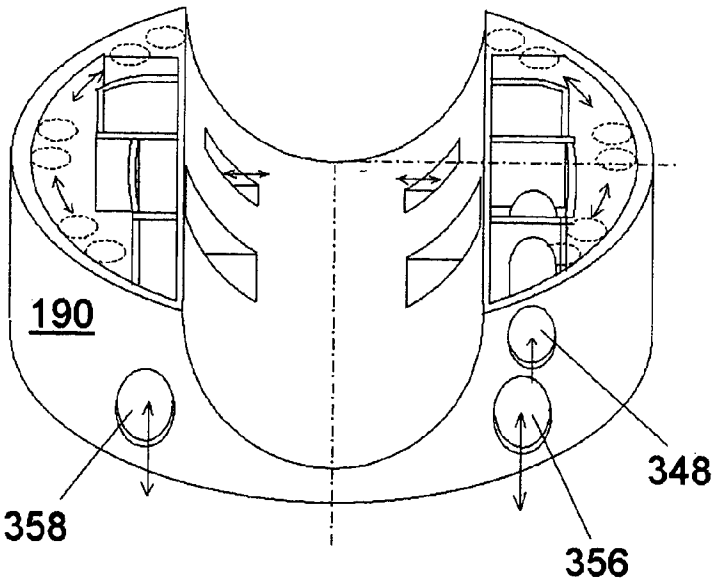

The 178 connecting pipe for the exhaust-intake chamber cooling air is passed through a provided hole in the 114 power piston cylinder support block and into its respective hole in the 190 mid block lower portion as shown in FIG. 14. FIG. 6 traces the starting point of the 143, 145 cylinder ports for the power piston air-oil recirculation output, each port connecting with the right-angle 168 internal bores that connect up with, respectively the short 186 connecting pipe, right, air-oil mist recirculation and 187, connecting pipe, air-oil mist recirculation, left. Internally, the 178 pipe, exhaust-intake chamber cooling air has an internal 184 air check valve that insures positive pressure in the 334 chamber for the exhaust-intake port area as shown by FIG. 13.

Internally, the 222 power piston and the 242 head piston have almost identical components with the exception of the length of the 192,256 piston rods which are of differing lengths. Besides the obvious external features of the actual piston head, the respective 215, 259 bearing retainer assemblies for the power and head pistons are almost identical. Operationally, each piston is moved inwardly by virtue of its own set of cam plates and are compelled to always contact the respective cam plates by their own spring mechanisms, something that has already been illustrated in FIG. 4, FIG. 4A, FIG. 5 and FIG. 5A. In any case, the inwardly facing pistons always operate independently and are mechanically arranged so that the two pistons never contact mechanically during any of the four Otto cycle strokes. Further, the internal cylinder pressures during the compression and exhaust strokes prevent the pistons from colliding in any manner.

Figure 7:
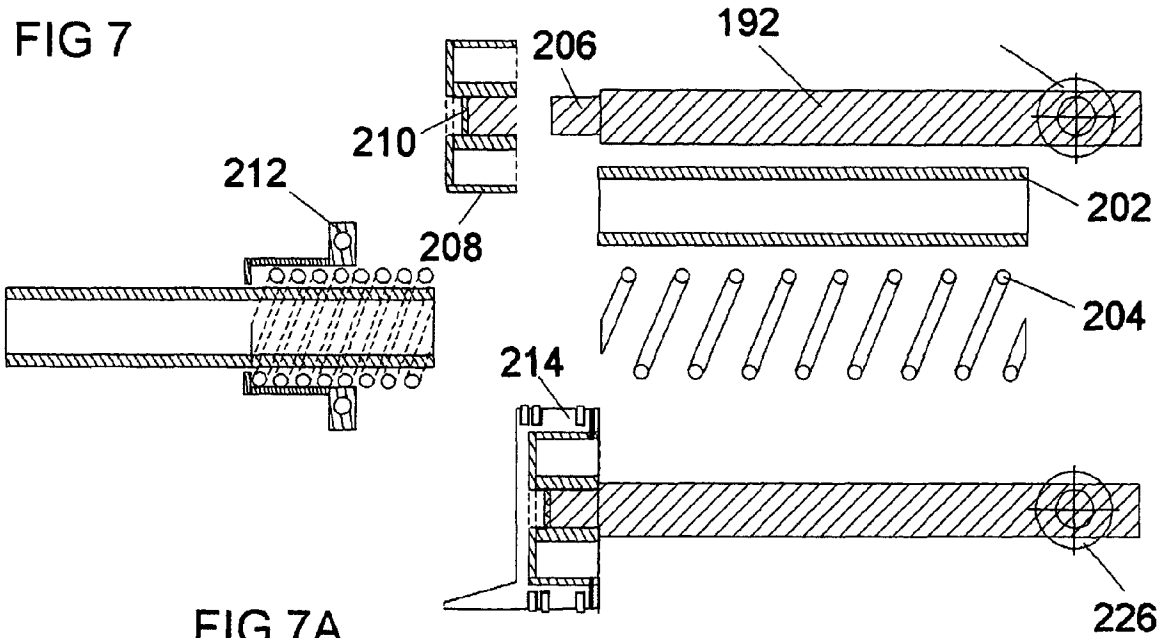
Figure 7A:
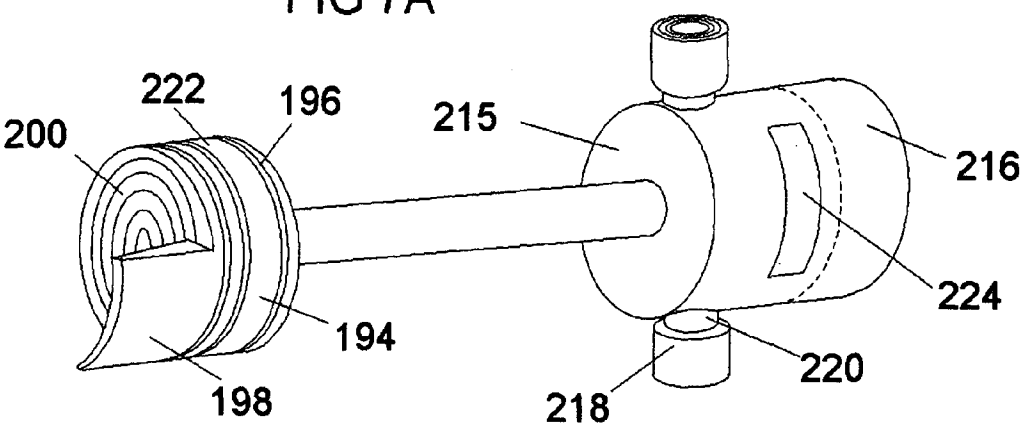
FIG. 7A is a proportional view of the power piston as assembled.

FIG. 7 illustrates the component parts of the power piston in cross sectional format, both unassembled and assembled as seen in FIG. 7A. 192 is the piston rod, power piston, 202 non-abrasive spring sleeve and the 204, spring for the power piston. Since the spring is going to compress and expand all during the life of the engine, the 202 non-abrasive spring sleeve can be manufactured of nylon or some other compatible material so as to prevent metal on metal abrasions of the 202 spring and the 192 piston rod. The 208 interior cup is press fitted to the 206 neck portion of the power piston rod. Once pressed into place the 206 neck portion of the piston rod is 210 welded to the 208 cup portion, the 192, 206, and 208 components preferably made of steel. A very important internal cylinder component is the 212 spring retainer for the power piston in that it serves two functions; (a) retain the spring during its compressed state, and (b) provide a pressure barrier for the outside portion of the power piston which creates the 164 chamber for the power piston air-oil mist creation area. 214 depicts the fully assembled power piston head in cross sectional view while FIG. 7A gives a proportional view of the entire power piston assembly.

The 200 surface of the piston head is particularly important in that it is desirable to create minor fuel-air turbulences in that area so as to improve combustion efficiency. Although a circular pattern was shown only for illustration purposes, any possible combinations of piston head surfaces can be created to produce the desired turbulences during the compression and power strokes. Again, not limiting the invention to the specifics of the drawings, the symbolic 196 compression and oil control piston rings are a basic standard for piston type engines and can be accordingly used here. The 194 piston head for the power piston and its 198 web, power piston for the intake port make it stand out from the head piston design. As it will be shown in FIG. 29 through FIG. 36, the web portion has the function to isolate the intake port during the last segment of the exhaust stroke causing all of the exhaust gasses to exit exclusively through the exhaust-intake port, something that is illustrated in FIG. 14A. The 216 cup portion of the 215 bearing retainer assembly acts as a piston as seen in FIG. 4 and FIG. 4A which are cross sectional drawings of the operational functions of the power piston. 218 is the lower cam bearing for the power piston, and its 220 sleeve.

Since the 94, 96 upper and 218, 238 lower bearings of the power and head pistons are sideloaded by the cam slopes during their cyclical operations, a 224 nylon pressure pad insert, typical, is installed on both sides of the bearing retainer assembly, and having air-oil mist lubrication, the 224 nylon pressure pads will minimize frictional losses as opposed to regular pistons where a metal to metal occurs with the side of the piston and the cylinder wall causing substantial frictional horsepower losses, especially at high engine revolutions.

Figure 8:
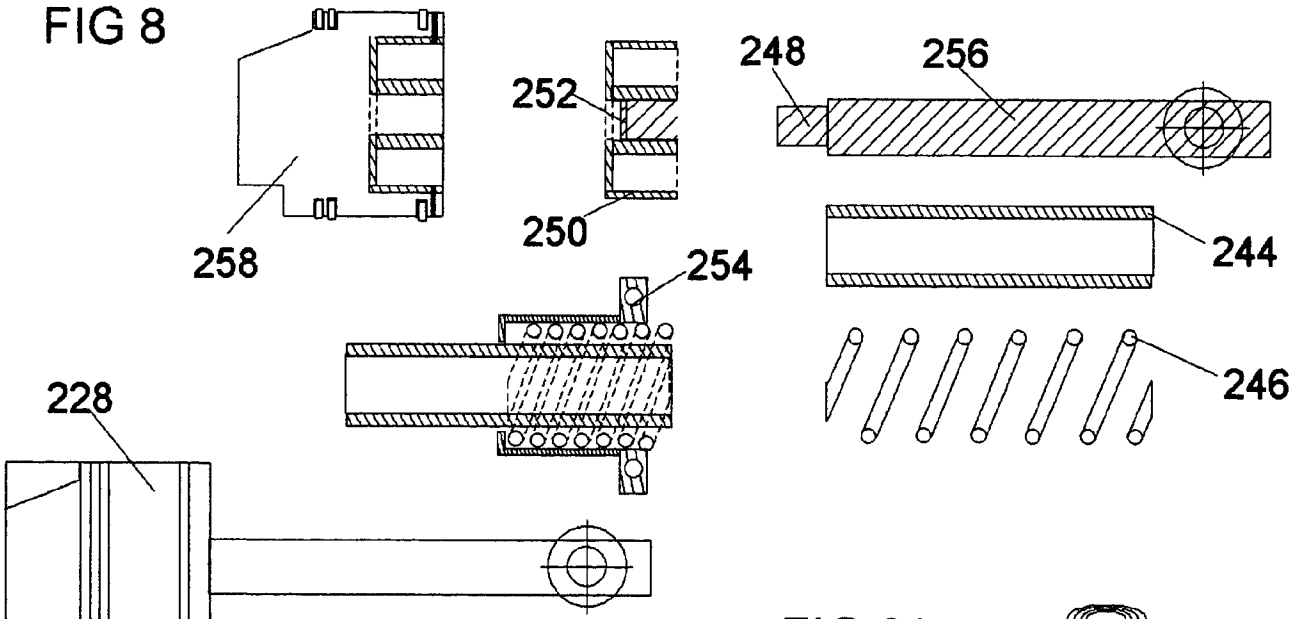
FIG. 8 provides various sectionalized view of the head piston components while FIG. 8A provides a proportional view of the head piston as assembled.
Figure 8A:
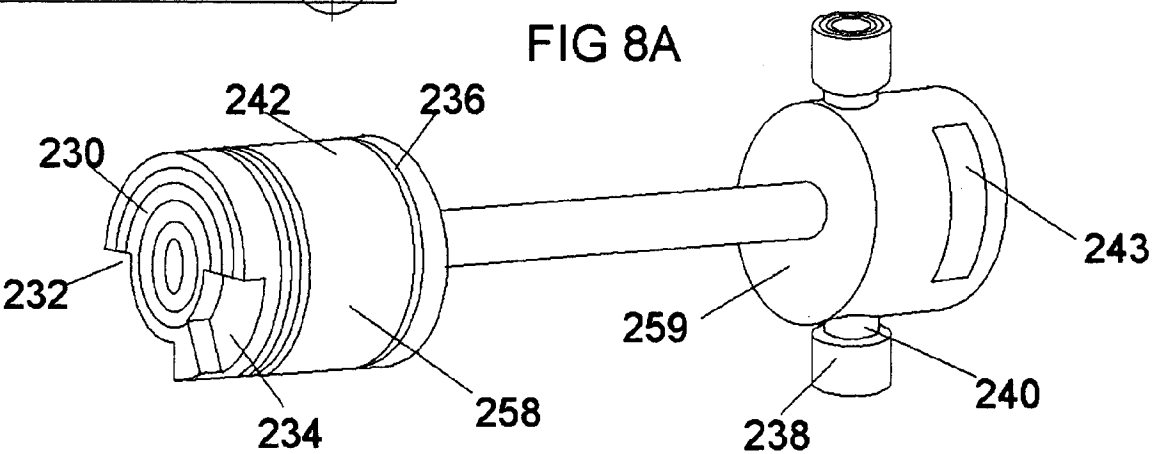

FIG. 8 illustrates the component parts of the power piston in cross sectional format, both unassembled and assembled as seen in FIG. 8A. 256 is the piston rod, head piston, 224 non-abrasive spring sleeve and the 246, spring for the head piston. Since the spring is going to compress and expand all during the life of the engine, the 224 non-abrasive spring sleeve can be manufactured of nylon or some other compatible material so as to prevent metal on metal abrasions of the 246 spring and the 256 piston rod. The 250 interior cup is press fitted to the 248 neck portion of the power piston rod. Once pressed into place the 248 neck portion of the piston rod is 252 welded to the 250 cup portion, the 256,248, and 250 components preferably made of steel. A very important internal cylinder component is the 254 spring retainer for the head piston in that it serves two functions; (a) retain the spring during its compressed state, and (b) provide a pressure barrier for the outside portion of the power piston which creates the 164 chamber for the power piston air-oil mist creation area. 214 depicts the fully assembled head piston in cross sectional view while FIG. 8A gives a proportional view of the entire head piston assembly.

The 230 surface of the piston head is particularly important in that it is desirable to create minor fuel-air turbulences in that area so as to improve combustion efficiency. Although a circular pattern was shown only for illustration purposes, any possible combinations of piston head surfaces can be created to produce the desired turbulences during the compression and power strokes. Again, not limiting the invention to the specifics of the drawings, the symbolic 236 compression and oil control piston rings are a basic standard for piston type engines and can be accordingly used here. The 242 piston head for the head piston and its 232 web cutout portion, head piston and its 234 exhaust-intake port cutout make it stand out as compared to the power piston. 238 is the lower cam bearing for the power piston, and its 240 sleeve.

Since the 94, 96 upper and 218, 238 lower bearings of the power and head pistons are sideloaded by the cam slopes during their cyclical operations, a 243 nylon pressure pad insert, typical, is installed on both sides of the bearing retainer assembly, and having air-oil mist lubrication, the 243 nylon pressure pads will minimize frictional losses as opposed to regular pistons where a metal to metal occurs with the side of the piston and the cylinder wall causing substantial frictional horsepower losses, especially at high engine revolutions.

Figure 9:
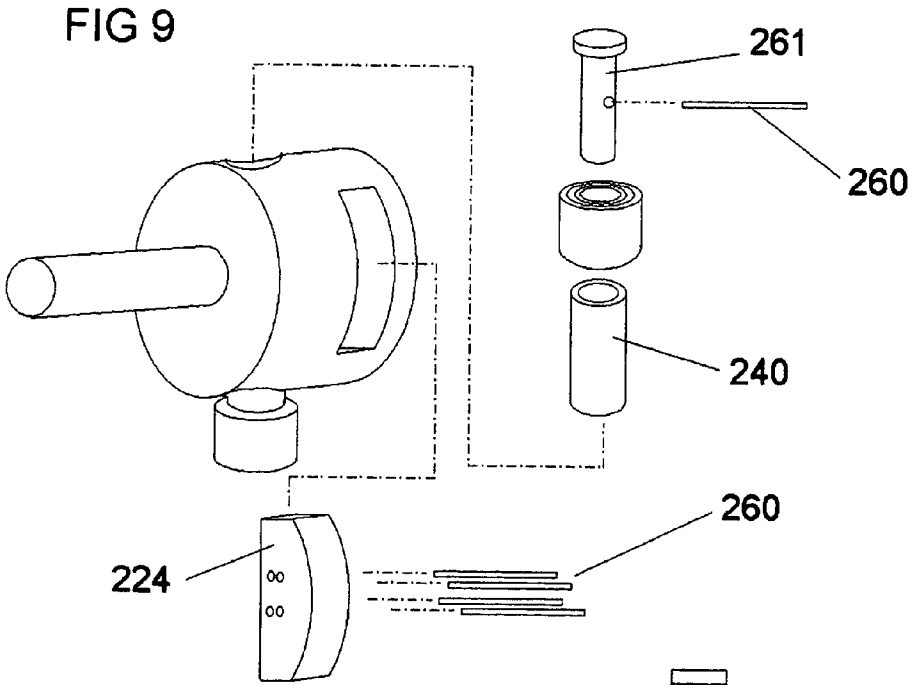
FIG. 9 is a proportional view of the bearing retainer assembly for the head piston.
Figure 9A:
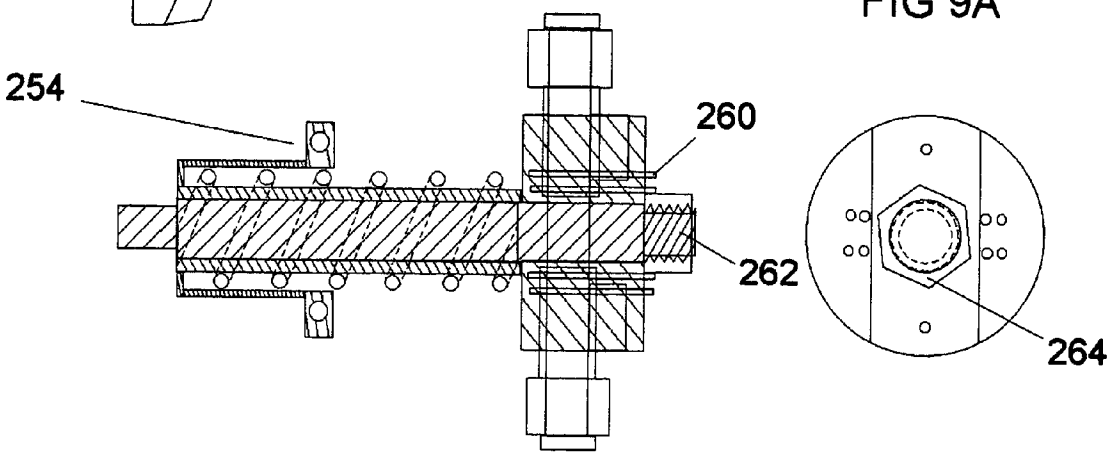
FIG. 9A is a sectionalized view of the component parts of the bearing retainer assembly.

From a mechanical installation point of view, FIG. 9 provides a proportional drawing showing a typical bearing installation which is simple and highly maintainable. The 222 power piston assembly and the 242 head piston assembly are fully assembled without any of the projecting bearings before installation into the cylinder. Procedurally, before the bearing retainer assembly. In this perspective, the typical bearing arrangement is shown as it is disassembled, the 261 pivot pin, bearing, typical, 260 lock pin, typical, 240 bearing sleeve, typical, and a typical bearing. Before piston assembly, all of the bearings are held aside until the assembled piston is finalized and slid into the cylinder. FIG. 9A is a pre-assembly head piston situation where the 254 spring retainer, 244 non-abrasive sleeve, 246 spring are all slid onto the 256 piston rod and then the 250 interior cup is pressed into place and welded at 252. At the other end, the bearing retainer assembly has already been secured by the 264 nut onto the 262 threaded end of the piston rod. Finally, the piston head is installed and pinned into place onto the 250 interior cup and all is now ready for insertion into the cylinder. Once installed, the assembled bearing, pin and sleeve are pressed into the bore of the 215, 259 bearing retainer assembly and pinned into location from the inside of the cylinder. The final horizontal attach bolts are installed in the horizontal mounting holes in the spring retainer and the piston installation is completed. Removal is the reverse of the description given here.

Figures 10, 10A, 10B:
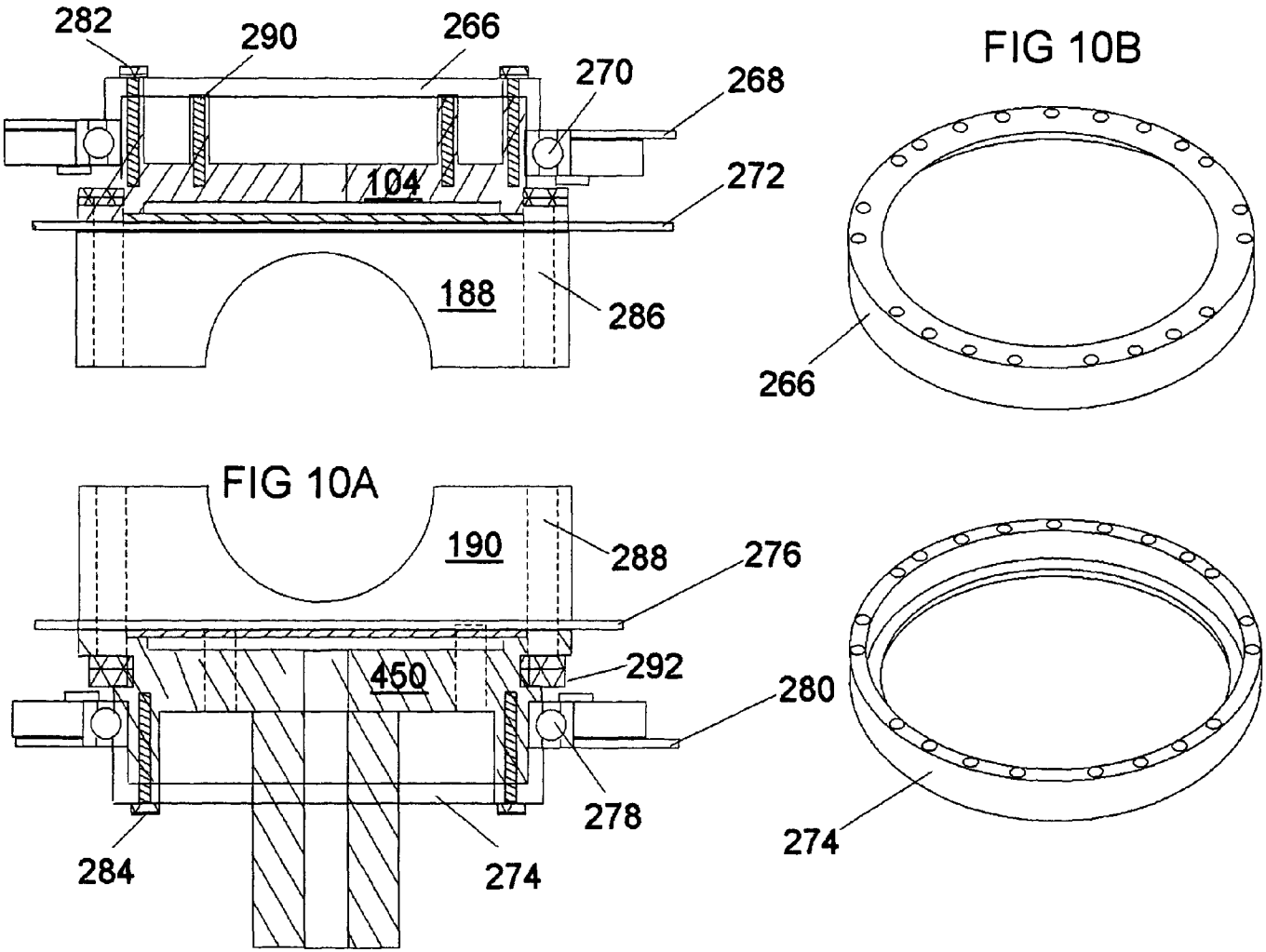
FIG. 10 is a cross sectionalized view of the top bearing plate and the top portion of the mid barrel.
FIG. 10A is a cross sectionalized view of the lower portion of the mid barrel and the lower bearing plate.
FIG. 10B is a top and bottom perspective view of the typical bearing clamp ring.

In terms of the sequence of assembly, FIG. 10, FIG. 10A and FIG. 10B provide all of the basic parts that clamp down on the 90, 124 cylinder barrel assembly. The 104 top bearing plate mechanically nests into the 188 mid barrel upper half while the 450 bottom bearing plate nests into the 190 mid barrel lower portion. When an assembly bolt is installed into the matching 286, 288 mid barrel holes, the entire assemblage is compressively installed firmly over the 90, 124 cylinder barrel assembly. 292 shows a typical assembly bolt nut. FIG. 10B gives a perspective view of the 266, 274 upper bearing clamp ring, lower clamp ring which are respectively bolted into place with 282, 284 bolts for the upper and lower bearing clamp rings.

From a systems operating point of view, FIG. 11 and FIG. 11A provides additional information on the air-oil mist recirculation system and the 118 vacuum sleeve support systems. FIG. 11 shows the final, compressively attached 90, 124 cylinder barrel as it is secured in place in the 188, 190 mid barrel assembly. Having removed the 114 power piston support block for the purposes of clarity, the 297, 299 right and left pipes for the air-oil mist recirculating system can be seen installed on the 190 lower mid barrel as well as the 178 pipe for the exhaust-intake chamber cooling air. The 294 space for the vacuum area between the 90 cylinder and the 118 is now evident. Also seen is 306 drilled hole opening for the alternate side vacuum source. Also shown is the 298 commutator unit mounting boss and the 296 cutout area in the commutator unit mount which allows electrical wires and other interior connections to feed out from under the 422, 424 commutator.

Looking at FIG. 11A, the full substance of the operation of the vacuum supply and storage is seen. 300 is the drilled hole opening for the right side vacuum source, while 302 is the vacuum chamber in the 188 upper mid barrel section, the chamber being connected by 304 drilled hole which communicates with the chamber vacuum supply with the vacuum sleeve, completing the description of the vacuum system. Not shown is an exterior vacuum pump located remotely in the vehicle and attached with the appropriate hosing which would connect up with one of the 64 fluid external attach fitting projecting from the 54 upper bearing cover plate.

Figure 12A:
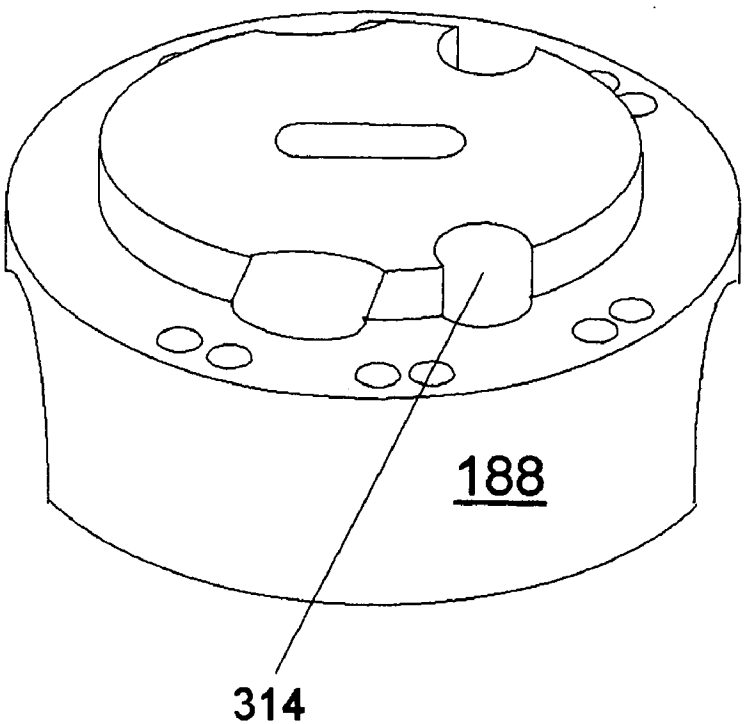
FIG. 12A is a rotated top proportional drawing of the surface details with the top portion of the mid barrel being rotated.
Figure 12:
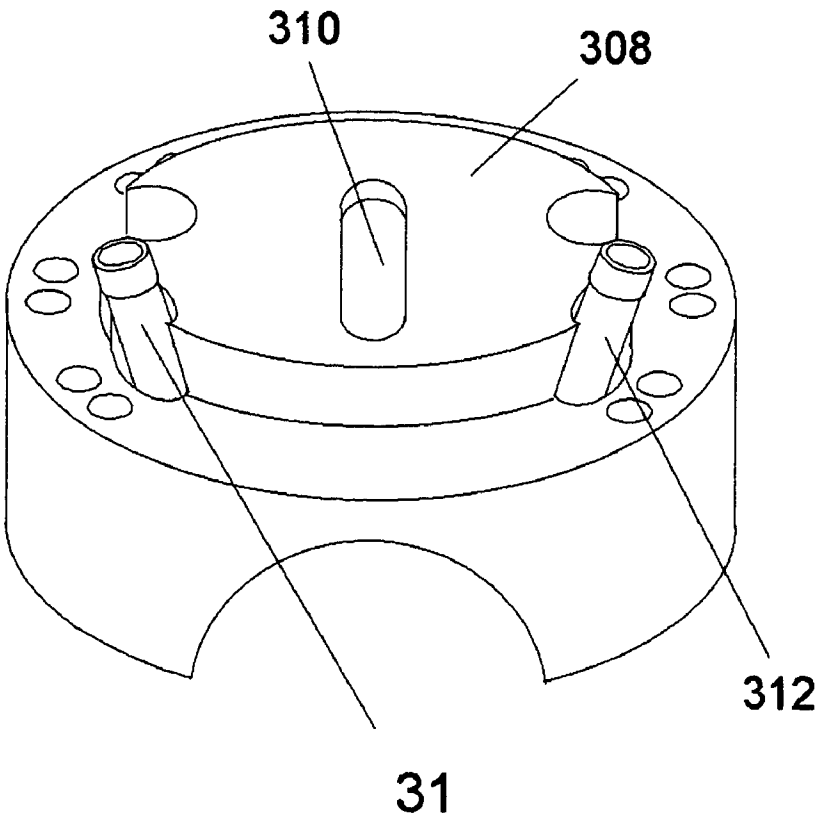
FIG. 12 is a top proportional drawing of the surface details of the top portion of the mid barrel with the two installed spark plugs.

Because the 188, 190 mid barrel assembly is so compact and has a variety of instrumentation, fluid and electrical feeds, the air-oil mist recirculating lubrication system and the fuel system along with the dual spark plugs, FIG. 12 through FIG. 14B will be collectively employed to cover all of these design considerations. FIG. 12 is a proportional drawing of the top portion of the mid barrel illustrating the 310 slot for the nesting of the barrel upper key, 308 mid barrel raised land portion along with the installation of 312 two spark plugs while FIG. 12A is a rotated view showing 314 machined clearance cutout for the 364, 366 oil supply top plug, typical.

When looking at FIG. 13, FIG. 13A, it must be understood that all of the instrumentations and systems that populate the 104 top bearing plate area, the interiors of the 188 mid barrel, upper half and the 190 mid barrel lower half all have redundant design features which provides a high degree of fail-safe features for the engine if one of the systems happens to become inoperative. For example, if one air-oil mist recirculation passage becomes clogged, for whatever remote reason, a second is still functioning, as is with the 572 needle valve fail, a second is working, the identical notion applies to the dual spark plugs, fuel primer lines, oil supply lines, vacuum supply lines and so forth.

Keeping this in mind, FIG. 13 clearly shows the right and left design redundancies of the exposed interior areas of the 188 mid barrel upper half and the 190 mid barrel lower half. Starting with the top, 326, 324 oil chambers, mid barrel, upper half, 328, 330 passage, air-oil mist recirculation system, mid barrel upper half, 320, 322 vacuum chamber, mid barrel upper half. As for the lower, 332, 342, oil chamber, mid barrel lower half, 336, 338 chamber, entry point for air-oil mist recirculation, mid barrel lower, 356, 358 hole, pipe access for air-oil mist recirculation, mid barrel, lower, 344, 346 passage, air-oil mist recirculation system, mid barrel, lower, 354, 362, cover, entry chamber, mid barrel, lower, 352, 360, cover, exhaust-intake chamber, intake chamber, mid barrel, lower, and the 316, assembly bolt pairs, mid barrel assembly. With the special bolts, each has a 318 flattened head which, when the bolt sets are installed, they can not revolve in their respective holes when the 292 nut is tightened for the final assembly procedure.

FIG. 13A is a top view of the 104 top bearing plate details, here, we once again see a design redundancy; 372, 374 hole, oil resupply for oil chambers, mid barrel assembly, 364, 366, top plug, oil chambers, mid barrel assembly, 382, 386, oil tube, secondary oil level sense system, mid barrel assembly, 384, 388 oil tube, primary oil level sense system, mid barrel assembly, 390, 392 lever, oil dispensing valve, mid barrel assembly, 376, 378 hole, fuel primer/fuel injection port, mid barrel assembly, 368, 370 hole, clearance for spark plugs, mid barrel assembly. As a notation, even though these design details appear on the 104 top plate assembly, they are all contained below in the 188, 190 mid barrel assembly. The 380 land portion fits the inside race of the upper roller bearing for the engine.

FIG. 14, FIG. 14A and FIG. 14B is an important, deeper look into one of the important operational features of the 190 mid barrel lower half, that being the exhaust-intake port feature. So as to address a potential hot spot in the lower mid barrel, particularly the exhaust port area, the entire concept of directing cooling air produced in the 162 power piston chamber, is to produce a continuous cooling airflow over the 400 exhaust port inner housing which is specifically designed to direct the exhaust gas flow out of the 502 exhaust port, while at the same time, mechanically separate the walls of the 400 exhaust port housing physically away from the walls of the 394, chamber, exterior portion of exhaust-intake port. During the time interval when the 502 exhaust port is open to the 400 exhaust port housing, a venturi effect cooling air stream will travel in a parallel fashion from the 398 transfer clearance in the exhaust-intake chamber to the exhaust-intake channel. along with the exhaust gasses, expediting their exit while substantially lowering the exhaust gas temperature. In most gasoline powered engines, the exhaust gas temperature is around 1450 degrees Fahrenheit as the exhaust gas enters the average exhaust stack. Objectively, by the injection of cooling air into the exhaust gas stream, temperatures are also lowered on the engine components that are all downstream of the 502 exhaust port.

A secondary operational feature of the 398 transfer clearance in the exhaust-intake chamber is that when the 502 exhaust port is dosed to any gaseous flow, the cooling air pressure that is existent in the 394 chamber, exterior portion of the exhaust-intake port is forced in a reverse direction as depicted by FIG. 14B, the advantage being that additional airflow is directed from both the intake port and the exhaust-intake port during the intake stroke. Understanding that additional air will normally lean out the input fuel-air mixture, a simple 102 carburetor or fuel control mixture adjustment can be made to slightly enrichen the mixture in the 68 intake pipe.

Figure 15:
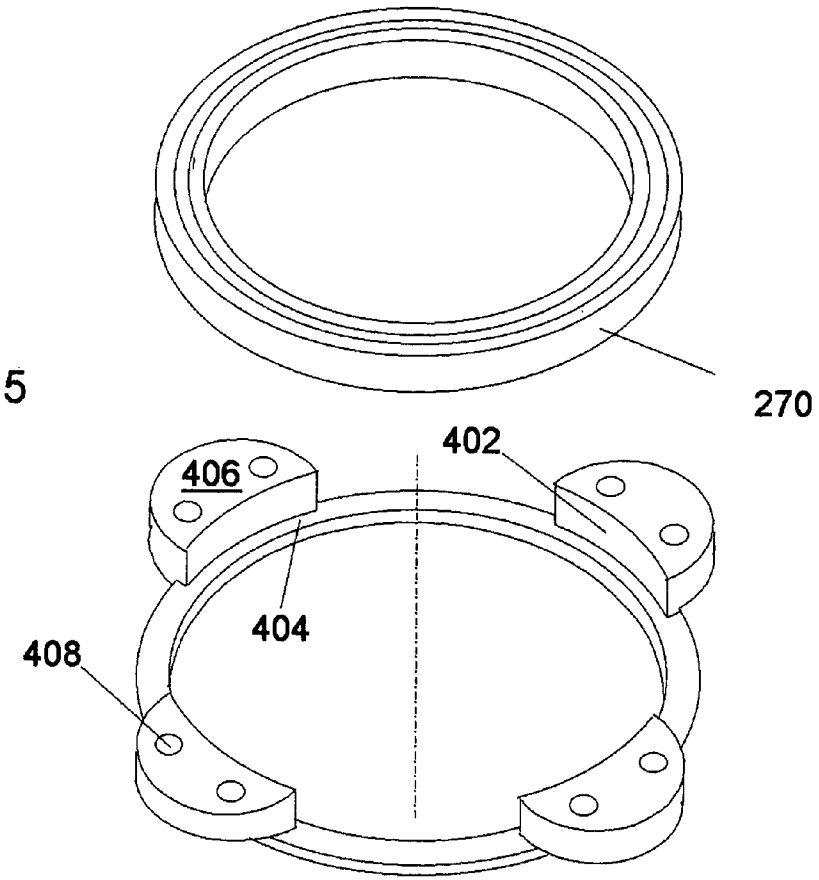
FIG. 15 is a proportionalized drawing of the top engine bearing and its relative insertive fit into the top bearing support pad.
Figure 16:
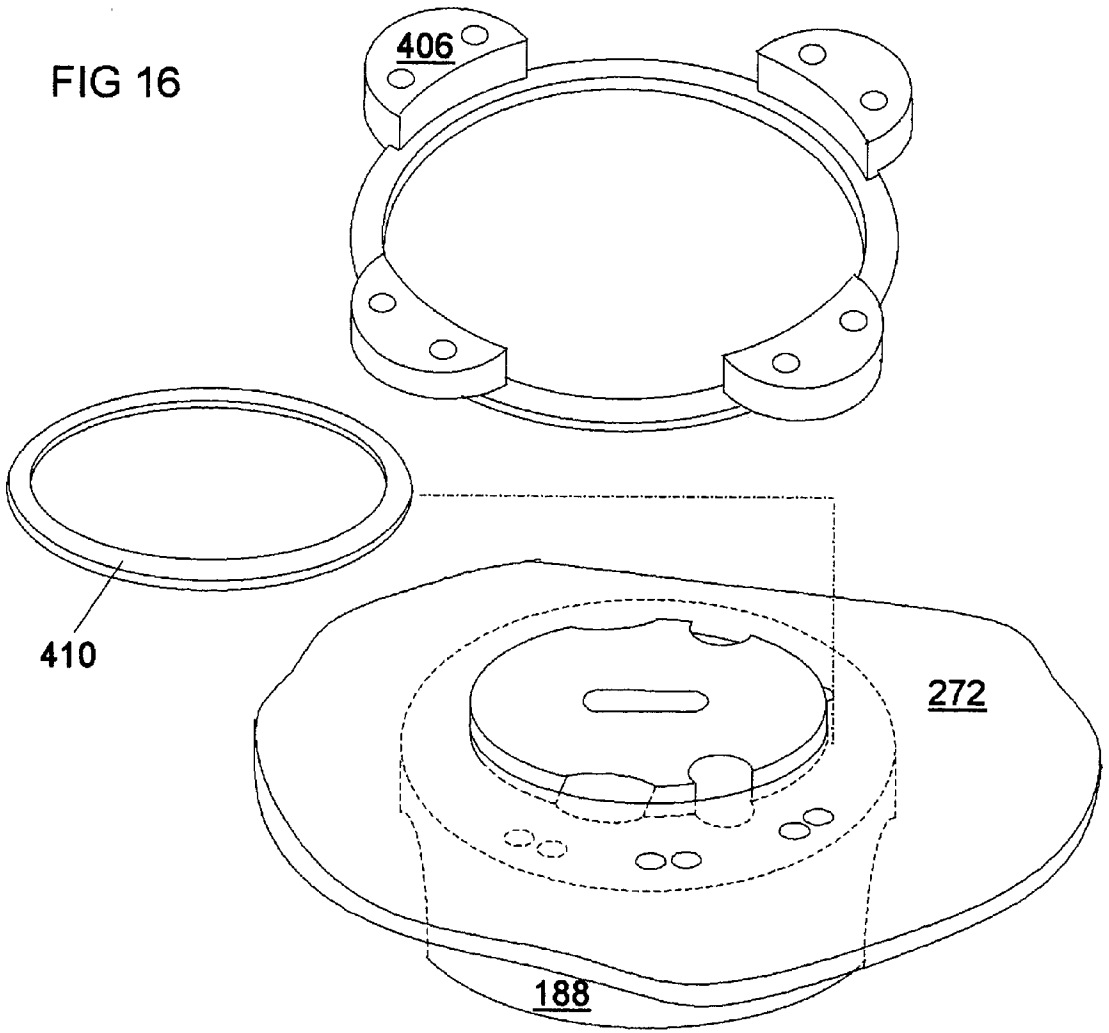
FIG. 16 is a proportionalized drawing of the bottom bearing support pad and the spacer that fits under it on the top portion of the top portion of the mid barrel

FIG. 15 through FIG. 18A are various views of the engine bearing details for the upper and lower mid barrel halfs. FIG. 15 depicts a typical 270, 278 engine bearing as it would fit into a 406 support pad for a rotor plate, 402 being the inner surface into which the bearing nests, the 404 being the support pad land which contacts the outer race of the 270, 278 engine bearing. FIG. 16 is a progressive illustration on just how 406 support pad has an 410 spacer for the upper mid block to rotor upper plate. 408 is a typical hole, threaded for the bearing block bolt.

Figure 17:
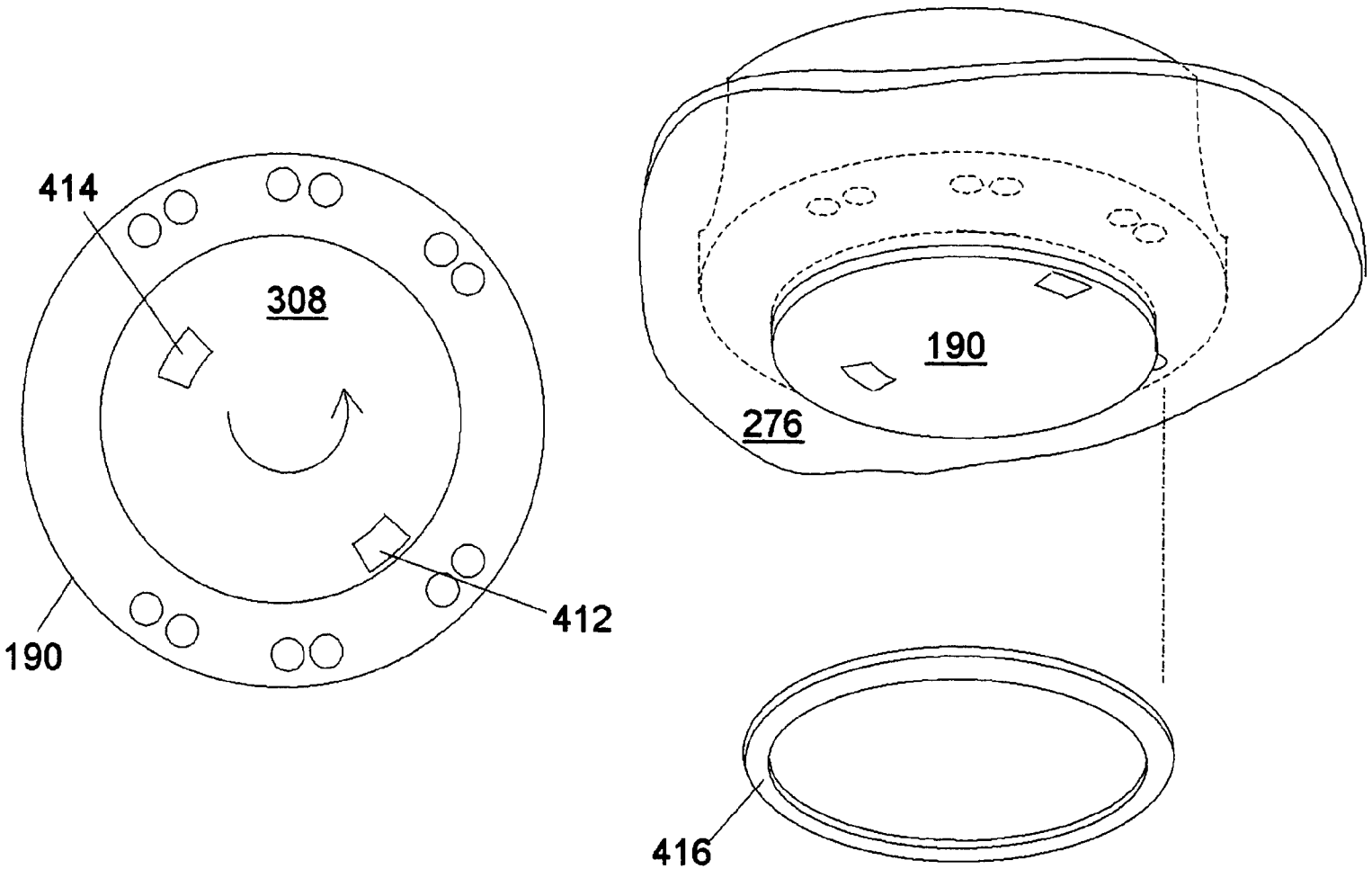
FIG. 17 is a combination bottom view for the bottom portion of the mid barrel with its intake and exhaust gas cutouts along with the spacer and its final position on the mid barrel.

FIG. 17 is an assembly view of the bottom of the lower 190 mid barrel with its centralized, attached 276 engine rotor lower plate. A flat plan view of 190 mid barrel lower half shows the direction of rotation as viewed from the bottom. Since the lower mid barrel is firmly attached by twelve 316 barrel assembly bolts to the equally rotating 450 bottom bearing plate, the 414 intake port, lower mid barrel and the 414 exhaust port, lower mid barrel are exactly machined openings that locationally match the intake port and exhaust port found in the 450 bottom bearing plate. Further, when assembly occurs, the 416 spacer, lower mid block to rotor lower plate firmly compresses upon the rotor lower plate and the 308 mid barrel land portion, typical, provides accurate centering of the 276 engine rotor lower plate.

Figure 18:
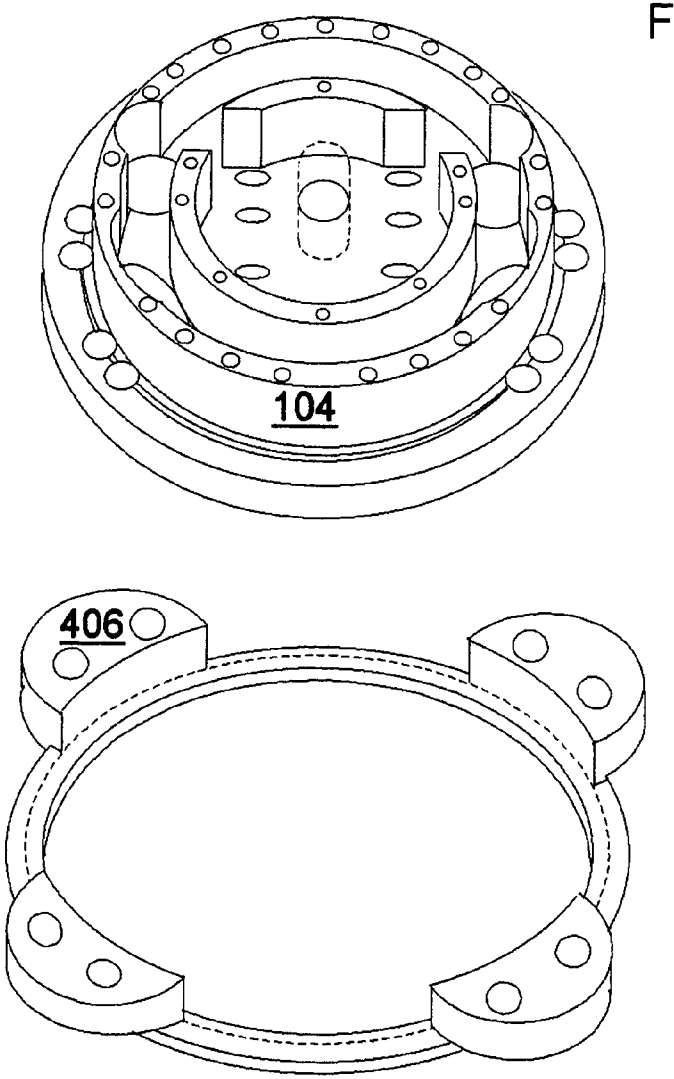
FIG. 18 is yet another proportional view of the top bearing plate as it nests into the top bearing support pad.
Figure 18A:
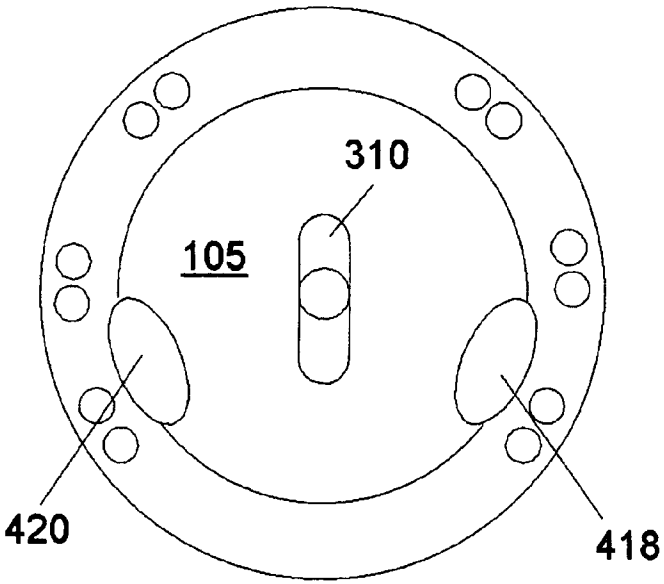
FIG. 18A is a bottom view of the cutout and hole details for the top bearing plate.

FIG. 18 is yet another proportional view of the 106 top bearing plate and the 406 support pad, rotor plate, typical with the 270 engine upper roller bearing removed for clarity. FIG. 18A is a bottom view of the 106 top bearing plate showing its machined recess which accepts the 308 mid barrel land portion as well as the 310 slot which accepts the 126 barrel upper key along with the 418, 420 cutouts for the right and left spark plugs.

Figure 19A:
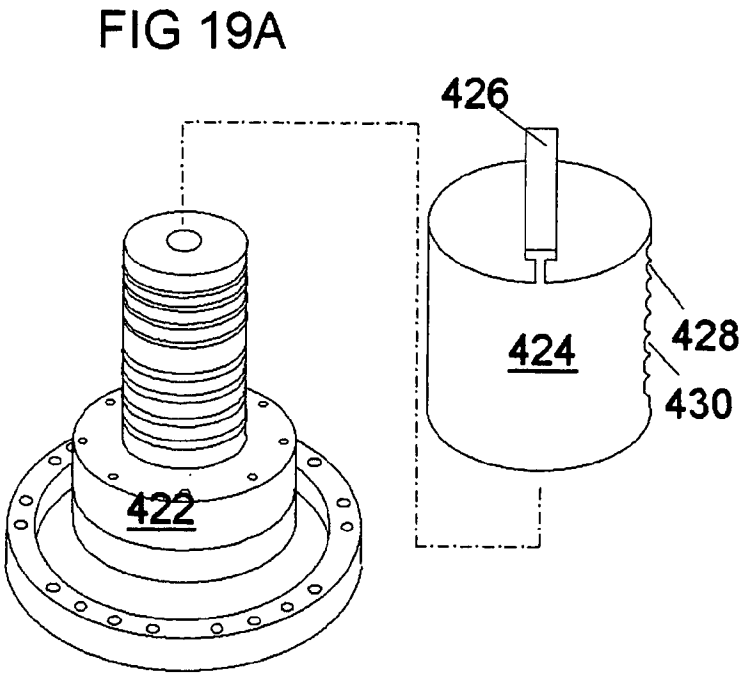
FIG. 19A is a more detailed proportionalized view of the internal commutator unit and its cover unit.
Figure 19:
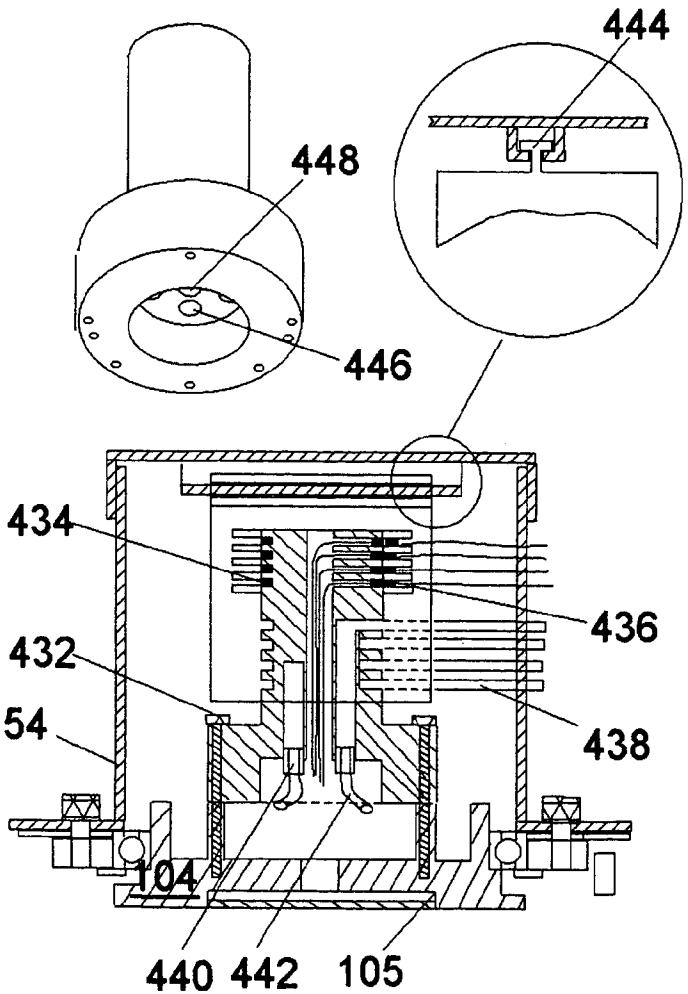

Looking to FIG. 19 and FIG. 19A, the important component of the invention shows the various commutator units. Since the engine rotor is always in motion and the engine case is fixed and attached to the vehicle frame by any number or devices which are not detailed here, the transmission of electrical signals, ignition pulses for the spark plugs and the various fuel, oil, and vacuum sources must go through the commutator units without leakages of any kind or without any electrical shorts or other malfunctions. It must be recognized that the specifics of the various details of the commutator units are presented for instructional and discussional purposes only and are not to be considered to limit the scope of the invention. Various commutator units can be fashioned to achieve the same purposes discussed here. Further, the number of electrical, instrumentation and other fluid and vacuum lines are solely for informational purposes only and a commutator unit can have as many or as little commutator components based on the needs of a particular engine design. compressively secured as will be outlined in FIG. 21, it will be understood that the outer races of both the upper and lower bearing races are always held in a stationary position and the inner races of both the upper and lower bearing will be the ones that rotate during engine operation.

Figure 21:
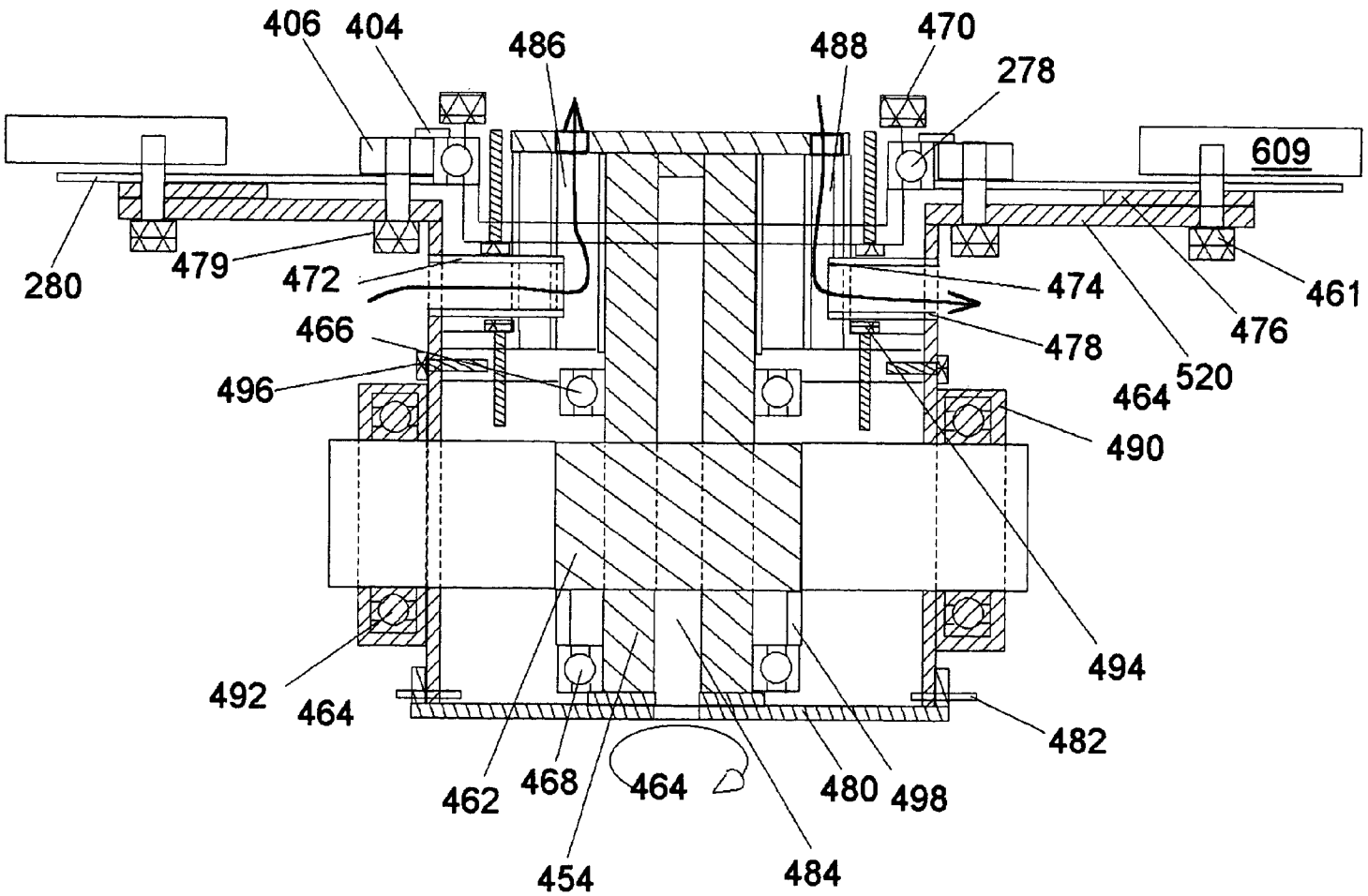
FIG. 21 is a detailed cross sectionalized view of the bottom bearing plate with its porting features along with the internal component features of the gearbox section of the engine.

FIG. 21 is a comprehensive sectioned side view of the 478 output gear box cover and its attachment to the 280 engine case lower plate. The 470 nut for the mid barrel assembly bolt is shown in a recessed position beneath the 278 lower roller bearing for the engine. With both the upper and lower roller bearings for the engine, the principle of tensioning the inner and outer bearing races by independent mechanical structures is the means by which the engine is held together. With either the 478 output gear box or the 54 upper bearing cover plate, the tensioning of the respective engine bearing inner and outer races is the primary means of securing the 268, 280 fixed engine upper and lower plates and the 272, 276 rotor upper and lower plates. The principle is best illustrated where the 479 gear box plate bolt is threaded into the 406 support pad which has its 404 land for the bearing inner race. As the 479 bolt is tightened, the 520 gear box attach plate is drawn down on its outer 476 pad portion for the attach plate. Additional 461 gear box attach plate periphery bolt which attaches to select points within the 632 outer circumference areas of the head piston plate. completes the assembly for the 280 engine lower plate. As the 454 center shaft of the bottom bearing plate rotates, it does so within the confines of a number of assembled parts within the fixed 478 output gear box cover. 494 vertical assembly bolts, typical and the 496 horizontal assembly bolts, typical, are the attachments that will explain the internal components later in FIG. 22 and FIG. 23.

The ultimate objective of any engine design is to complete the combustion process and thereafter send the results to some sort of output drive shaft where it can be used for any number of uses. Here, the 462 spur drive gear is meshed with two 464 output drive shafts, each counter-rotating to each other. Because of this counter-rotation, the end user of the invention will have a choice of drive shaft rotations without the need to further add a gearbox to add any counter-rotational feature. The 468 bearing, center shaft bottom location and the 466 bearing, center shaft top location provides sturdy locational support of the center shaft under high torque loading. Each end of 464 each output drive shaft is supported by its own set of 510 bearings, located within in the gear box housing. Each 492 bearing is installed in its respective 490 boss for the output shaft, typical.

As the engine breathes in and expels gasses during its operational cycle, shows the 486 interior annulus, intake manifold connection provides the passage for the incoming fuel-air mixture and the 488 interior annulus, exhaust manifold connection provides the passage for the outgoing exhaust gas and exhaust-intake chamber cooling air. The interior 472 pipe, connects the annulus to the intake port on the gear case exterior while the interior 474 pipe connects its annulus to the exhaust port on the gear case exterior.

For maintenance purposes, the interior components are always accessible by the provision of a 480 bottom cover plate for the output shaft. By pressing the bottom cover plate into place, it compresses the 468 bearing against the 498 spacer, which presses on the outer race of the 468 bearing, the 498 spacer also contacting the 462 spur gear holding it in position on the center shaft of the lower bearing plate. Once positioned, the 480 bottom cover plate for the output shaft is secured into place by a number of 482 lock pins that can be removed as required. Although lock pins are fully workable, there are other means of securement such as bolts or other mechanisms, thus, the invention is not limited to lock pins in this particular application.

Figure 22A:
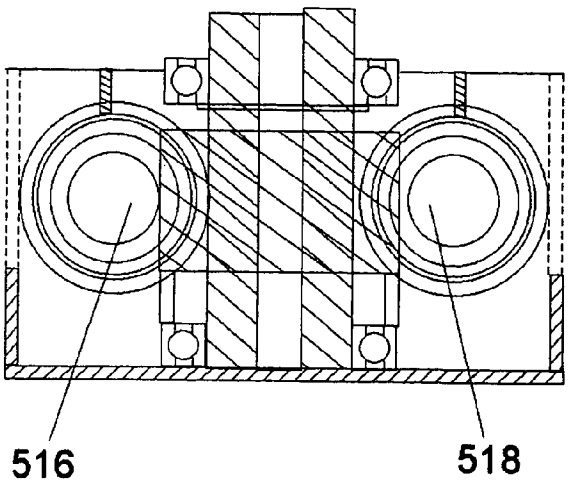
Figure 22:
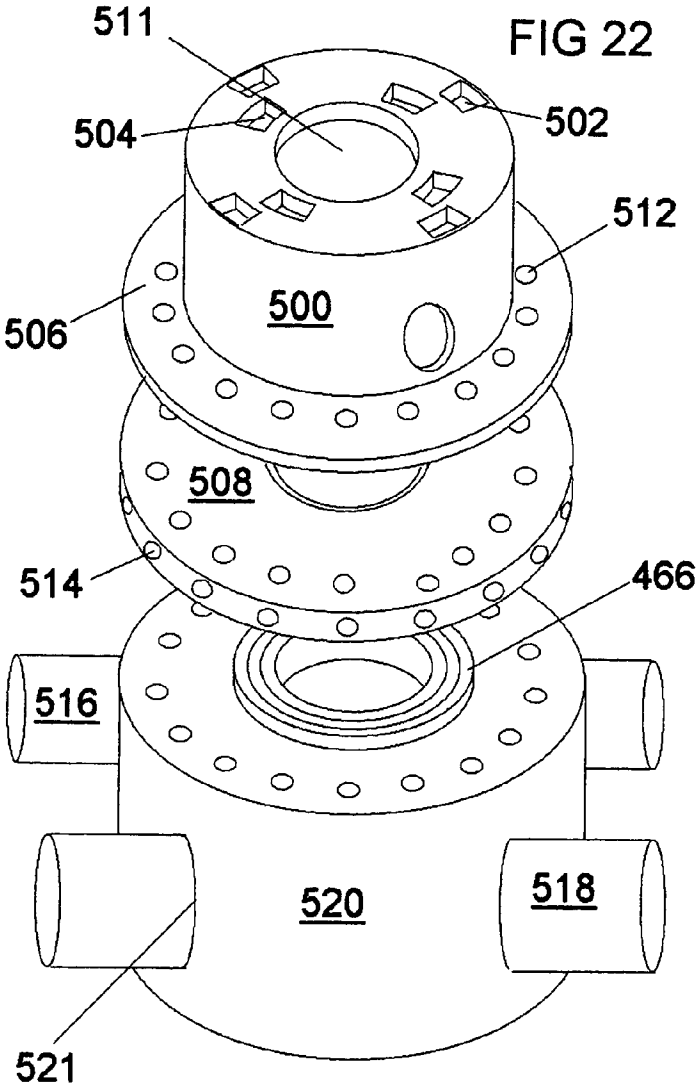
Figure 23A:
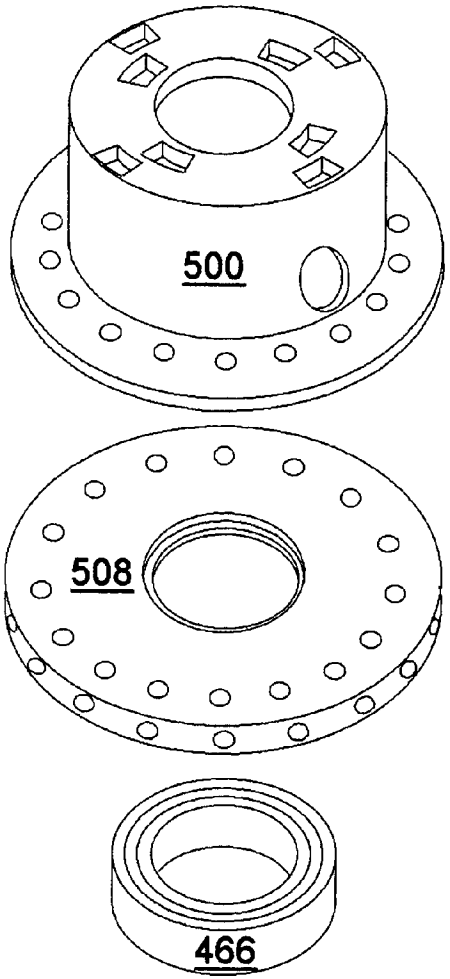
FIG. 23A is a cross sectionalized view of the two counter-rotating output drive shafts.)
Figure 23:
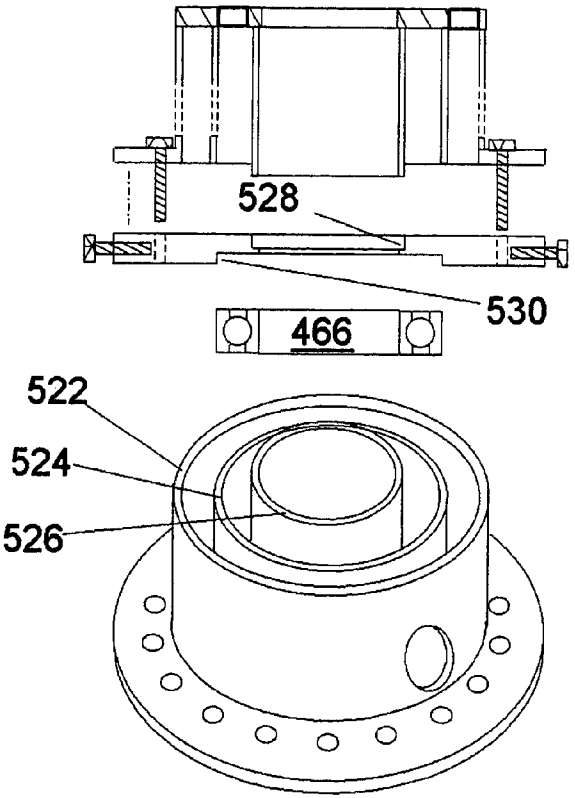

FIG. 22 through FIG. 23A are a series of proportional views of the fixed interior components surrounding the 454 center shaft of the bottom bearing plate.

FIG. 22 shows the component stack of fixed interior parts within the 450 bottom bearing plate; 511 being the provided hole in the 500 fixed porting cap for a four Otto cycle design, the series of intake and exhaust ports being evident. Since the assembled 190 lower mid barrel and the 450 bottom bearing plate have a single 504 intake port and a single 502 exhaust port machined into them, it can be seen that as the invention rotates through each ninety degree quadrant, another four stroke Otto cycle is completed, thus, the invention, as described, has four power strokes per revolution of the engine. The invention is not limited in scope to four Otto cycles per revolution in that larger diameter designs could easily support more power strokes per revolution, an example being a 500 fixed porting cap having five or six sets of intake and exhaust ports supporting a five or six Otto cycles per revolution.

The 506 flange for the porting cap with its 512 holes for the vertical assembly bolts is the point of insertion for the 494 vertical assembly bolts for the interior fixed part stack. The bolts would pass through the clearance holes in the 508 bearing compressor plate and thread into the 521 gear box housing. The 466 bearing, center shaft, top location is shown in its provided recess in the 508 bearing compressor plate. Because the 512 holes for the vertical bolts are equidistant, there is a design flexibility as to how the pair of output drive shafts 516, 518 could be rotated to point in a direction other than shown in FIG. 22. The typical 521 drive shaft opening in the 521 gear box is also shown. Once the interior parts stack is finally assembled, the 496 horizontal are inserted from the outside of the 521 gear box and threaded into the provided 514 horizontal assembly holes to finalize the interior parts stack assembly. Since the spur gear can have one of two gear angles, the 516, 518 output gears could turn counterclockwise to each other, the directions be dependent on the normal counterclockwise direction as viewed from above and the gear angle of the spur gear, all of which adds flexibility to the invention.

FIG. 23 provides cross sectionalized and proportional views of the fixed 500 porting cap. The topmost drawing gives better visualization of the 522 outer tube portion, 524 mid tube portion and 526 inner tube portion of the porting cap. The 526 inner tube portion has a slightly longer dimension that is designed to be press fitted in the 528 recess for the inner tube in the 508 compressor plate. On the other side of the plate, the 530 recess for the 466 bearing is provided. The 530 recess, combined with the bearing recess in the 521 gear box housing, as seen in FIG. 22, provides a locationally secure nest for the top center shaft bearing. FIG. 23A is yet another proportional set of drawings of the parts already described.

Figure 24:
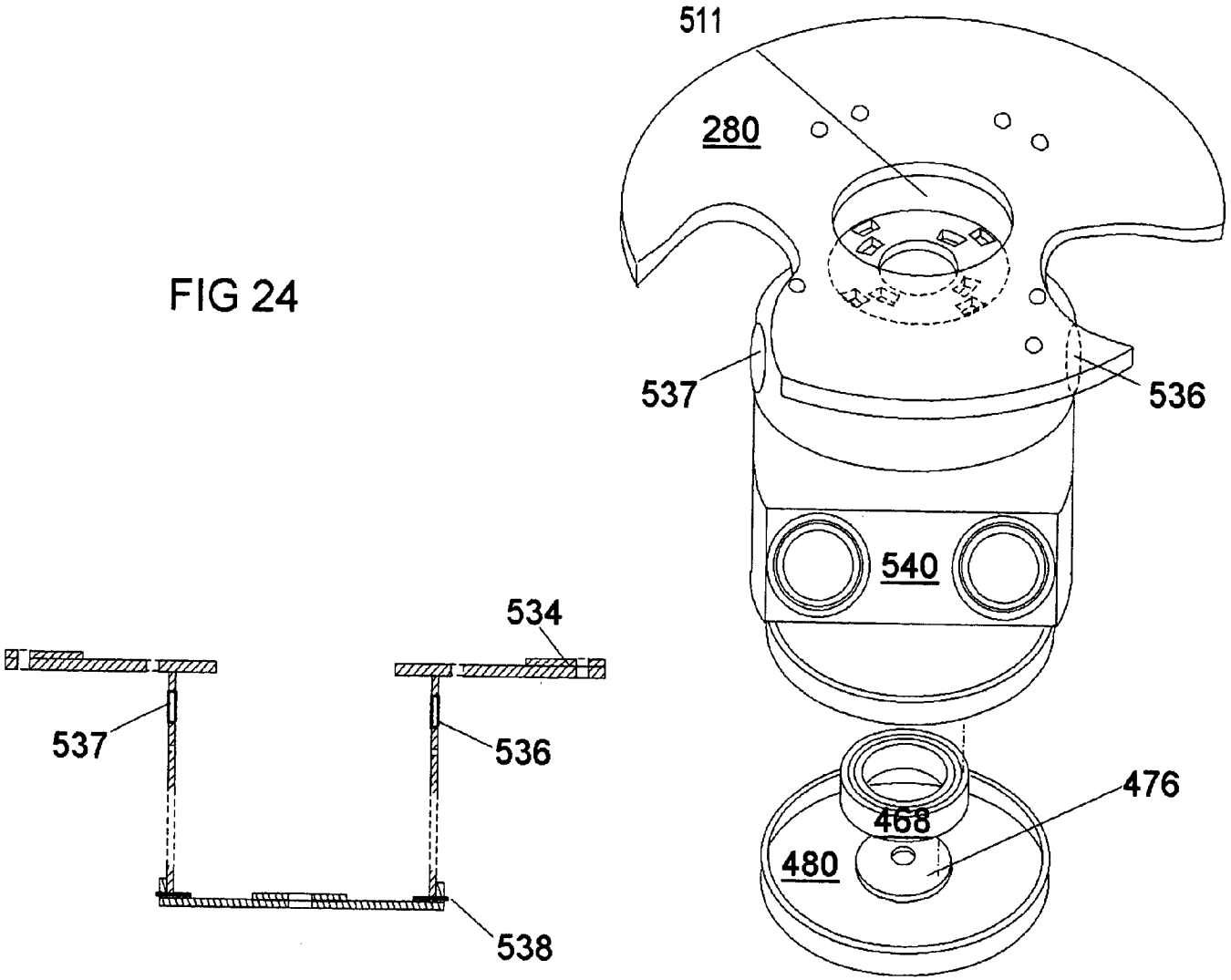
FIG. 24 is a combination of sectionalized drawings of the output drive shafts and the case for the output gear box while the top proportionalized drawing with breakaways of the output gear box and its lower cover plate and lower drive shaft bearing.

FIG. 24 is a final schematic and proportional view of the 521 gear box. 537 would be the intake port location for the 68 intake pipe and its 102 carburetor or fuel control which provides the proper fuel-air mixture to the engine. 536 would be the exhaust port location where the 74 engine exhaust pipe would be attached. 540 is the more detailed view of the 540 output shaft boss portion of the 521 gear box.

Figure 25A:
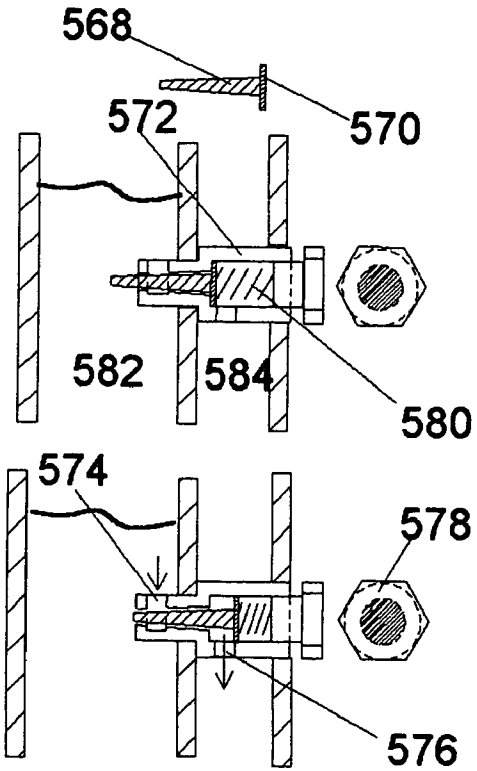
FIG. 25 is a combination of sectionalized drawings of the oil tubes, needle valve lever and low oil level warning functions while FIG. 25A gives greater detail of the oil needle valve as it is seated and when it is moved by the valve lever.
Figure 25:
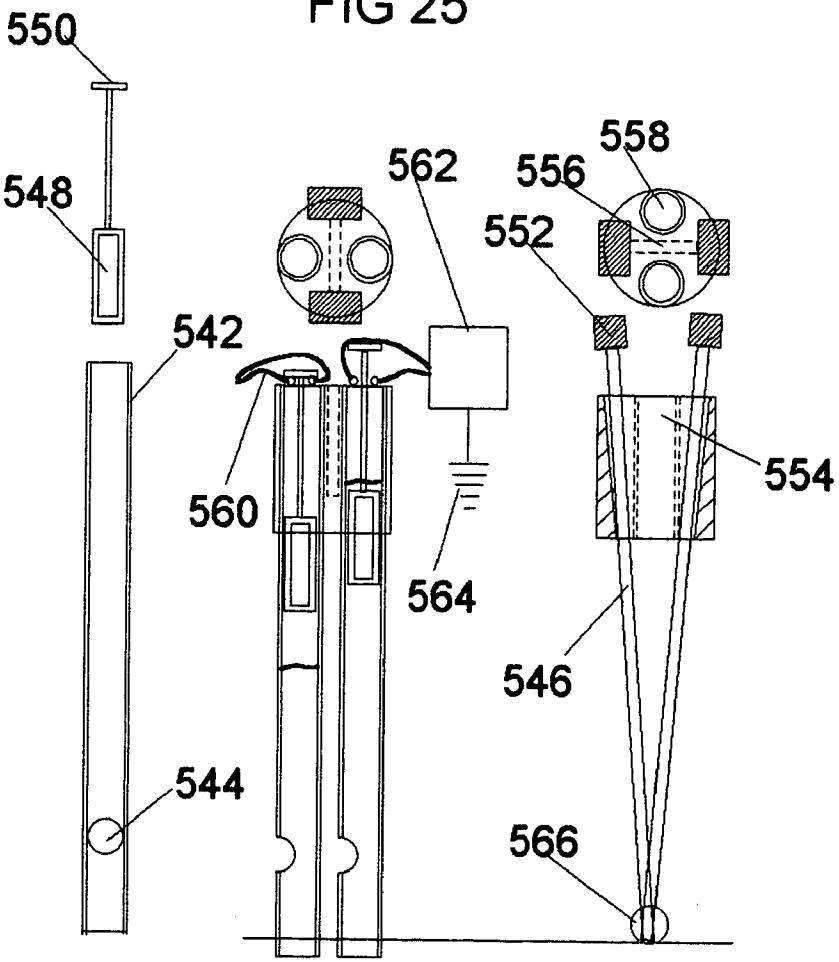

Although very simple in principle, FIG. 25 and FIG. 25A describes the redundant oil supply system which supports the operation of the engine by the natural, centrifugal force activated 546 operating arm for its respective oil needle valve assembly, each arm being mechanically 566 pivoted at the bottom of their respective 328, 342 oil chambers located in the lower 190 mid barrel. 554 shows the open and dosed travels of the 546 operating arm as it travels in its 556 slot which has 554 operating clearance within the oil chamber plug installed in the circular opening in the 104 top bearing plate. Further, the 556 slot provides atmospheric venting to the oil chambers so that oil flow is assured in all conditions. 558 shows the typical secondary and primary oil tube locations in the 554 oil plug. When the engine is not running, the 580 spring in the 572 oil needle valve housing is sufficiently strong enough to push the 546 operating arm to an inboard, dosed position. In setting up a particular air-oil mist lubricating system, the combination of the 552 counterweight on the top portion of the 546 operating arm, the 580 spring strength and the position of the 578 external adjusting nut pressing upon the needle valve spring are the various combinations that can be employed to fine tune the adjustment for the maximum oil seepage from the 572 oil needle valve at maximum revolutions of the engine. Because the preferred embodiment of the engine, particularly from an operational point of view, would have a self sustaining speed of perhaps 100 revolutions per minute and, perhaps, a maximum of 400 revolutions per minute, the need for excessive lubrication for a single cylinder must be considered during the air-oil mist adjustments. Although the described process of an operating arm controlling a 572 oil needle valve for lubrication requirements, the invention is not limited in scope in the descriptions that are given here or beyond this description and the invention is fully capable of other types of mechanisms to supply the lubricating oil to the engine.

The central purpose of the 546 operating arm and 572 oil needle valve combination is the need for automatic oil resupply without operator intervention. By means of simple series circuit designs, employing redundant electrical contacts, an 560 automatic oil resupply circuit is activated by the vertical position of the 548 oil level sense float mechanism as it floats in its 542 oil tube and when it gets to the point where the low oil level circuit is closed by the 550 electrical contact cap on the float stem, the 560 redundant low oil level contactors and its attached wires provides the electrical signal that activates the 562 remote oil resupply valve or oil resupply pump activates until the oil resupply cycle is completed and the circuit is once again opened. Each of the four submerged 542 oil tubes in the oil chambers 322, 328, 332, 342 has a 544 hole in the lower portion of the tube so as to allow oil to flow into the tube allowing the 548 oil float operate properly. The 564 electrical ground for the remote oil resupply valve or oil resupply pump is shown. The basic circuitry for the oil resupply system described here is purposefully simple and the electrical instrumentation for the lubrication system is for discussional and instructional purposes only and the scope of the invention with regard to this subject must not be limited to the descriptions given here. The invention is fully capable of more sophisticated electrical circuits for various oil system functions and of other types of mechanisms for oil system instrumentations. With the present invention, oil system operational indications can also provide additional features such as warning lights and other system features into the operator cab of the vehicle which are not detailed in the drawings.

FIG. 25A is a set of cross sectioned drawings; (a) the top drawing showing the dosed needle valve and no oil flow, and: (b) the bottom drawing showing a fully opened needle valve with oil flowing into the 574 oil inlet port of the needle valve housing, past the 568 needle valve, past the 570 flat face of the needle valve and out of the 576 oil outlet port in the needle valve housing. 582 depicts a typical oil chamber area with its oil level and 584 air-oil mist passage in the mid barrel assembly. The two drawings also show that the 572 needle valve housing is mechanically pressed into place in appropriately sized holes in the oil chamber and outer wall of the mid barrel housing. In this situation, the 578 spring adjusting nut is fully accessible from the interior of the engine rotor housing should there be need of needle valve spring tension adjustment. Although the two drawings just described do no show the 546 operating lever, the operating lever movements in FIG. 25 clearly show the relationship to the needle valve housing in FIG. 25A.

FIG. 26 and FIG. 26A are some final sectional views of the connective piping for the air-oil mist recirculation system where it can be seen that in FIG. 26, the top view illustrates the topmost position of the 178 pipe for the exhaust-intake chamber air cooling while in the bottom drawing, the 297 pipe for air-oil mist recirculation, right side and the 299 pipe for air-oil mist recirculation, left side are shown. The 334 chamber, exhaust-intake port area of the 190 mid barrel, lower half illustrates the 178 pipe penetration into that chamber with this side view. A typical 312 spark plug location is shown in its relative position for the 188 mid barrel upper half. Since the invention employs a dual ignition system which includes two spark plugs, the second spark plug would be in the identical relative position within the top 188 mid barrel portion. FIG. 26A is a differing, rotated view of FIG. 26, top view, which now shows the relative 178, 297, 299 pipe entry points on the 188, 190 mid barrel assembly. The bottom drawing of FIG. 26A points out the location of the 572 air-oil mist needle valve housing, typical.

Figure 27:
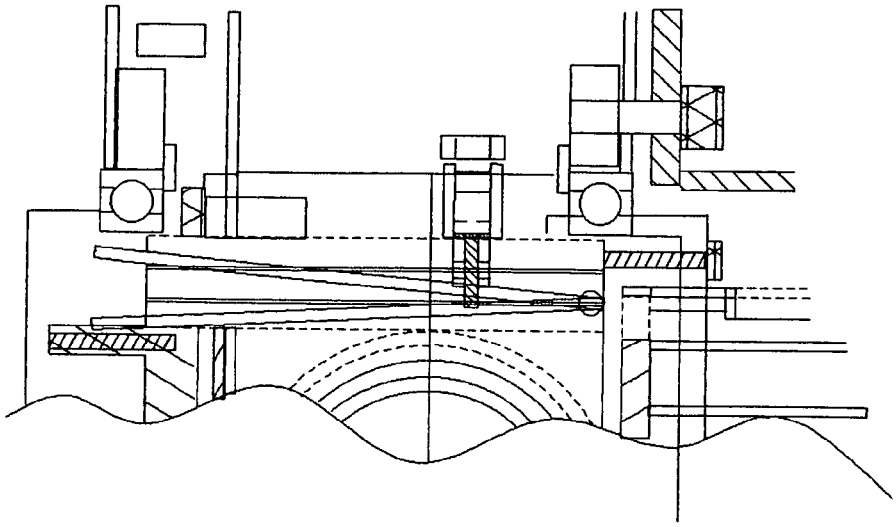
FIG. 27 is a combination of a top view of the top bearing plate with details on the oil system top plugs and operating levers while an accompanying sectionalized drawing gives an operational view of the movement of the lever.
Figure 27:
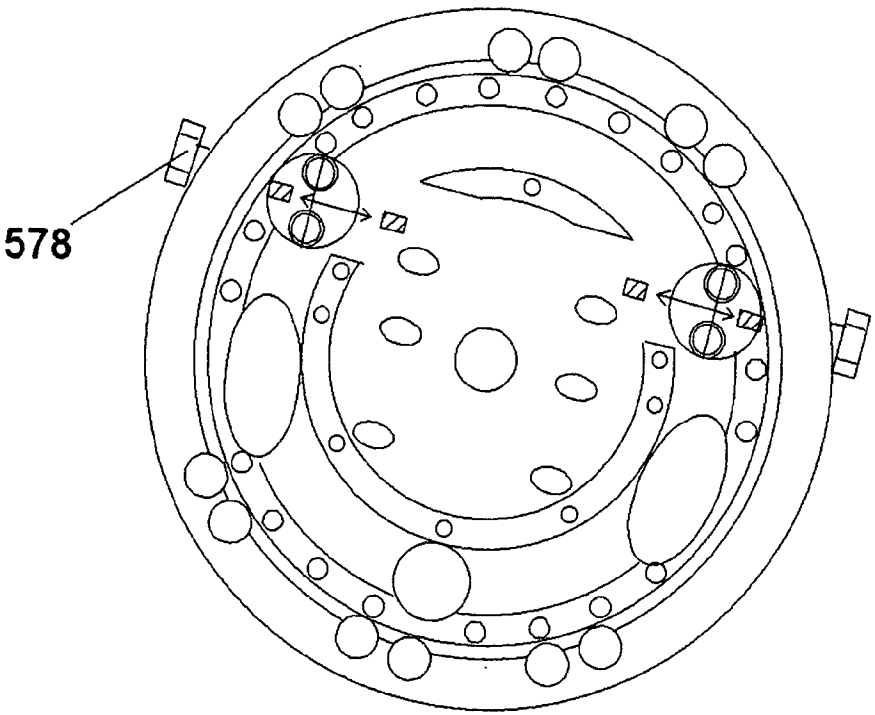

FIG. 27 is a final, top schematic view of the 578 adjusting nut for the 572 air-oil mist needle valve with its relative positions on the outside side surfaces of the 188, 190 mid barrel assembly.

Because every internal combustion engine type that uses a moderate compression ratio and burns gasoline as a fuel, the engine development industry has produced a dual curve internal combustion pressure chart that must be acknowledged by every designer of engines, particularly those engines that employ the standard piston design. Of particular importance is the fact that a 586 maximum efficiency pressure curve is higher and sharper in curvature than the lower, more flattened 588 combustion efficiency curve. As long acknowledged, the average maximum internal pressure in a cylinder is about 400 pounds per square inch with the sharper curve while the lower curve maximum pressure is about 275 pounds per square inch. In a sense, the dual curve chart can also be informally used to visualize the relationship of maximum revolutions and its relationship to torque output of a standard piston, connecting rod and crankshaft engine that uses the Otto cycle. Simply put, a conventional reciprocating engine is totally dependent on producing the highest possible level of revolutions within the span of one minute so as to create a maximum torque output which is why the PLANK power formula is consistently used for reciprocating engine designs.

It is clear that engines in this subclass have effective crank arms of one half the cylinder diameter or substantially less, the torque output, even at high revolutions, is excessively low and is totally incapable of being rescued because of the inherent mechanical designs employed. In the invention being described here and later in FIG. 29 through FIG. 36, the specific concept of outer periphery power piston cams which work in close conjunction with inner periphery head piston cams, the invention has the ability to produce effective crank arm dimensions that four to five times greater than the diameter of the piston, the result being enormous torque output once the engine reaches its self sustaining speed while still using the internal cylinder combustion pressures seen on the chart in FIG. 28. Because of the specific cam designs applied in this invention, the single, rotating cylinder design is effectively performs as a four cylinder engine within the confines of a single revolution of the engine, as opposed to one power stroke for every two revolutions of a conventional reciprocating engine. Thus, the invention described here is eight times more efficient at producing power strokes and because of that, the operational range of its revolutions is substantially less than when compared to other engines within this subclass.

During World War II, aircraft engine designers created powerful radial piston engines which produced the highest power outputs for all piston engines save the large diesel engines that were used in marine applications which had no weight restrictions, something that was crucial to aviation. Yet, the brake horsepower of the aviation engines, which would be roughly comparable to torque output, had effectively remained at a 1:1 ratio when compared to the weight of the engine. Up to this point in time, the 1:1 weight to power ratio has not been exceeded for aviation engines or engines in this engine subclass. In the present invention, it is estimated that a 50 inch case diameter engine would weigh about 350 pounds. Using an averaged 2358 torque output from the computations that will follow, a 350 pound engine would have a 1:6.7 weight to torque power ratio, or something like 6.7 times better than any engine design in the subclass of horizontally opposed radial engines.

Computing engine torque. Because of its very high torque output, the need for high revolutions is unnecessary which can be arithmetically pointed out by the computations that are to follow.

Figure 28:
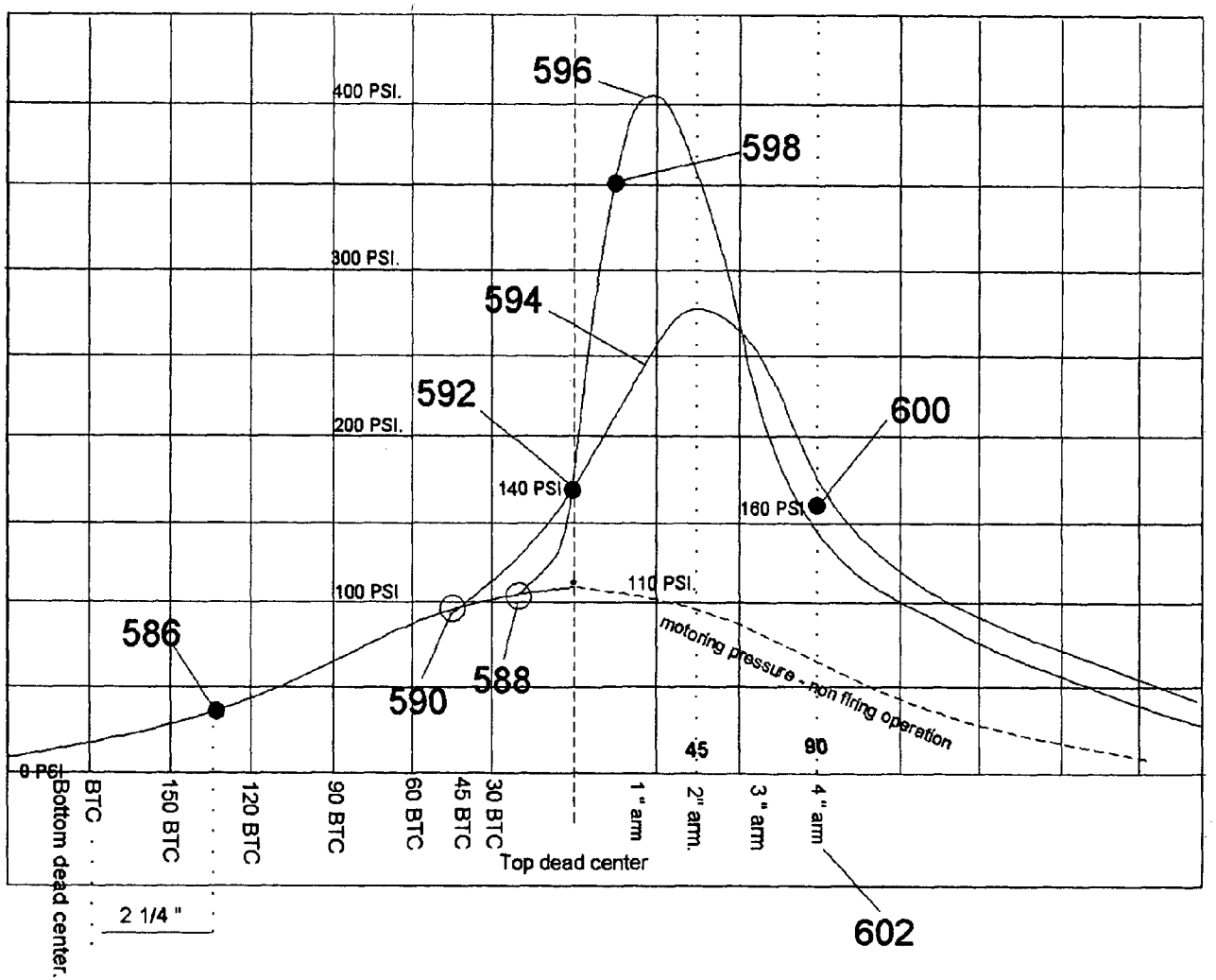
FIG. 28 is a chart of the standard internal combustion pressure curves for a medium compression ratio internal combustion piston engine fueled by gasoline.

Assuming that the engine described in FIG. 28 through FIG. 36 has a four inch diameter piston and that at the start of the power stroke, the effective crank arm is 16.65 inches and at the end of the power stroke the effective crank arm is 20.5 inches, the data given here, in combination with the chart pressures given in FIG. 28 will combine to demonstrate the torque output of the invention.

Start of power stroke computation.

(a) A four inch diameter piston will have an area of 12.56 square inches.

(b) Using a 598 moderate pressure of 350 pounds per square inch internal pressure at the start of the power stoke, (c) the force created by the piston would be 4398 pounds. (12.56×350)

(d) The torque created using the 16.65 inch arm at start of combustion would have an effective arm of 1.387 foot equivalent which would produce a computed torque of 6,100 foot pounds of torque. (1.387×4398). Because the piston bearings generally are contacting cam slopes that are around a 45 degree angle, the torque must be adjusted downward by one half, thus the adjusted torque at the start of the power stroke would be around 3,050 foot pounds of torque.

End of power stroke computation.

(e) A four inch diameter piston will have an area of 12.56 square inches.

(f) Using a 600 moderate pressure of 160 pounds per square inch internal pressure at the end of the power stoke, (g) the force created by the piston would be 2009 pounds. (12.56×160)

(h) The torque created using the 20.5 inch arm at end of combustion would have an effective arm of 1.71 foot equivalent which would produce a computed torque of 3435 foot pounds of torque. (1.71×2009). Because the piston bearings generally are contacting cam slopes that are around a 45 degree angle, the torque must be adjusted downward by one half, thus the adjusted torque at the end of the power stroke would be around 1,717 foot pounds of torque.

Averaging the torque output of a four inch diameter piston engine.

(j) The average internal combustion pressure would be 255 pounds per square inch producing an average torque output which would be 2373 foot pounds (3,030+1,717×0.5) which commences with the self sustaining speed.

Design flexibility—computing torque. For example, by using small dimensional changes for the invention, by increasing the overall engine case dimension by four inches, the computations for a 5 inch diameter piston having a 5 inch power stroke, using the same internal combustion pressure given in FIG. 28 would produce the computations below;

Start of power stroke computation.

(a) A five inch diameter piston will have an area of 19.64 square inches.

(b) Using a 598 moderate pressure of 350 pounds per square inch internal pressure at the start of the power stoke, (c) the force created by the piston would be 6874 pounds of force. (19.64×350)

(d) The original 16.65 inch crank arm would now be increased to 17.65 inches (16.65+1 inch or 1.47 foot) for the start of the power stroke.

(e) The torque created using the updated 17.65 inch arm at start of combustion would now have an effective arm of 1.47 foot equivalent (6,874×1.47) which would produce a computed torque of 10,104 foot pounds of torque. (1.47×6874). Because the piston bearings generally are contacting cam slopes that are around a 45 degree angle, the torque must be adjusted downward by one half, thus the adjusted torque at the start of the power stroke would be around 5,052 foot pounds of torque.

End of power stroke computation.

(f) A five inch diameter piston will have an area of 19.64 square inches.

(g) Using a 600 moderate pressure of 160 pounds per square inch internal pressure at the end of the power stoke, (h) the force created by the piston would be 3144 pounds of force. (19.65×160)

(i) The original 17.56 would now be increased to 23.65 inches (17.65+1+5 or 1.97 foot) at the end of the power stroke. (*Note: 1 inch is added to piston diameter—piston rod grows 1 inch.)

(h) The torque created using the 23.65 inch arm at end of combustion would have an effective arm of 1.97 foot equivalent which would produce a computed torque of 6194 foot pounds of torque. (1.97×3144) Because the piston bearings generally are contacting cam slopes that are around a 45 degree angle, the torque must be adjusted downward by one half, thus the adjusted torque at the end of the power stroke would be around 3,096 foot pounds of torque.

Computing the torque increase of a five inch diameter piston engine. It can be now seen that by increasing the overall diameter of the engine by only four inches, increasing the piston diameter by one inch and increasing the power stroke to five inches and starting the power stroke one inch beyond the starting point of a four inch cylinder engine, a substantial growth of engine torque is realized; the comparisons for the four inch diameter piston at the start of combustion being 3,050 foot pounds of torque versus 5,052 foot pounds of torque for a five inch piston. The comparisons for the four inch diameter piston at the end of combustion being 1,717 foot pounds of torque versus 3,096 foot pounds of torque for a five inch piston. On a percentage basis, an average torque increase of 1.65 at the start of combustion and an increase 1.8 at the end of the power stroke occurs with the change from a four inch wide piston to a five wide inch piston engine.

Looking at FIG. 28, the 598 350 pound per square inch figure for the start of the combustion stroke assumes that the top of the cited pressure curve is somewhat lower than the 596 maximum possible figure which shows to be slightly over 400 pounds per square inch. The 594 low efficiency curve continues and then generally parallels the pressure dropoffs of the 598 curve. The 160 pound per square inch remains at the 600 point on the chart. In any case, the 596 curve shows that if an ignition point of about 20 degrees before top center is used on the invention, the engine will not reverse direction in that in FIG. 29 it will be seen that both the 626 compression stroke flat for the power piston and the 630 compression stroke flat for the head piston can not impede the rotational inertia of the 52 engine rotor. Because of these two 626, 630 cam flats, an advanced ignition point can be utilized so as to achieve the 598 maximum internal cylinder pressure as depicted in FIG. 28. There has always been a popular misconception that the combustion that takes place within an internal combustion engine is instant is clearly contradicted by the information that is presented in FIG. 28 in that reciprocating engines that are, and have been, in common use must retard the ignition spark so that the peak pressure arrives at the proper time and place in the engine cycle, this fact confirmed by 588, 590.

To properly understand the engine cam design of the invention that will be discussed in FIG. 29 through FIG. 36, one must first understand the nature of the combustion event that takes place in a reciprocating engine and the mechanical forces that are placed on the rotating crankshaft. Since the crankshaft is always rotating, there is no unique method by which to mechanically adjust the engine to accommodate the slow buildup of combustion pressures, so ignition retardation has always been the fix for the problem. However, from a mechanical standpoint, 588 takes place somewhere around 25 before top dead center and 590 somewhere around 45 degrees before top dead center, this arrangement creating significant counter rotational forces upon the crankshaft as the engine operates, so there is a situation of diminishing returns when it comes to the conversion of heat energy into mechanical energy. All of this takes place during the compression stroke of the four stroke Otto cycle.

With the engine at its bottom dead center, which is 180 degrees away from top dead center, the pressure in the cylinder is roughly around atmospheric pressure in a normally aspirated or non-supercharged engine. Once the piston starts its compression cycle, the pressure increases at the rate shown by the low, smooth curve during the motoring or starting motor event. If ignition is not employed, the pressure will decrease at the same rate as the piston travels back to the bottom dead center position, shown in the curve by the dashed line portion. Therefore, it can be seen that at 590, the pressure in the cylinder has about 95 pounds per square inch acting on the piston and at 588 about 105 pounds per square inch acting upon the piston, both instances providing a substantial force on the crankshaft urging it to rotate backwards which is directly opposite to its main purpose. Once ignition occurs, the two curves generally intersect at 592 at the top dead center point which is roughly at the 140 pounds per square inch value. Even though the crankshaft finally arrives at its top dead center position at 592, the additional combustion pressures that are added after the 590, 588 points in the pressure curves are added to the counter rotational forces within the cylinder. When the piston arrives at its most effective point in its travel in the cylinder, 602, the crankshaft is at the 90 degree point after top dead center which is also shown by 600, a situation where each curve has substantially fallen off from its maximum pressure generations that were effectively left behind some 90 degrees earlier. This ineffective use of the standard internal pressure curves for the internal combustion engine using a standard crankshaft is presently, and always will, be unresolvable despite the continual and popular advertising claims that newer engines are more efficient.

Indeed, the faster the engine rotates, particularly at the 5000 to 6000 RPM range, the less time there is for a complete combustion cycle to be completed, time being the central subject of the curves presented in FIG. 28. Therefore, from a fundamental design point of view, an engine specifically designed to rotate at low speeds will totally avoid the second major problem of reciprocating engines which is incomplete time to take advantage of the pressure curves presented here. By way of example, because modern automotive engines are getting smaller and smaller in their size and engine displacements, the only way to extract whatever power that is available is for the engine to rotate at those 5000 to 6000 RPM speeds. Basically, it is a repeat situation when considering the Wankel rotary engine design.

Objectively, the present invention mechanically locks the pistons into a situation of virtually no movement at 586 which is about 2¼ inches upward movement from the bottom dead center position where the internal pressure in the cylinder is about 30 pounds per square inch as compared to the 95 to 105 pounds per square inch at the ignition points at 590 and 588 respectively. Consequently, the counter rotational forces on the invention is substantially less than that of a reciprocating engine or any engine in the engine subclass. The details of the power piston and head piston cams continues with FIG. 29.

Figure 29:
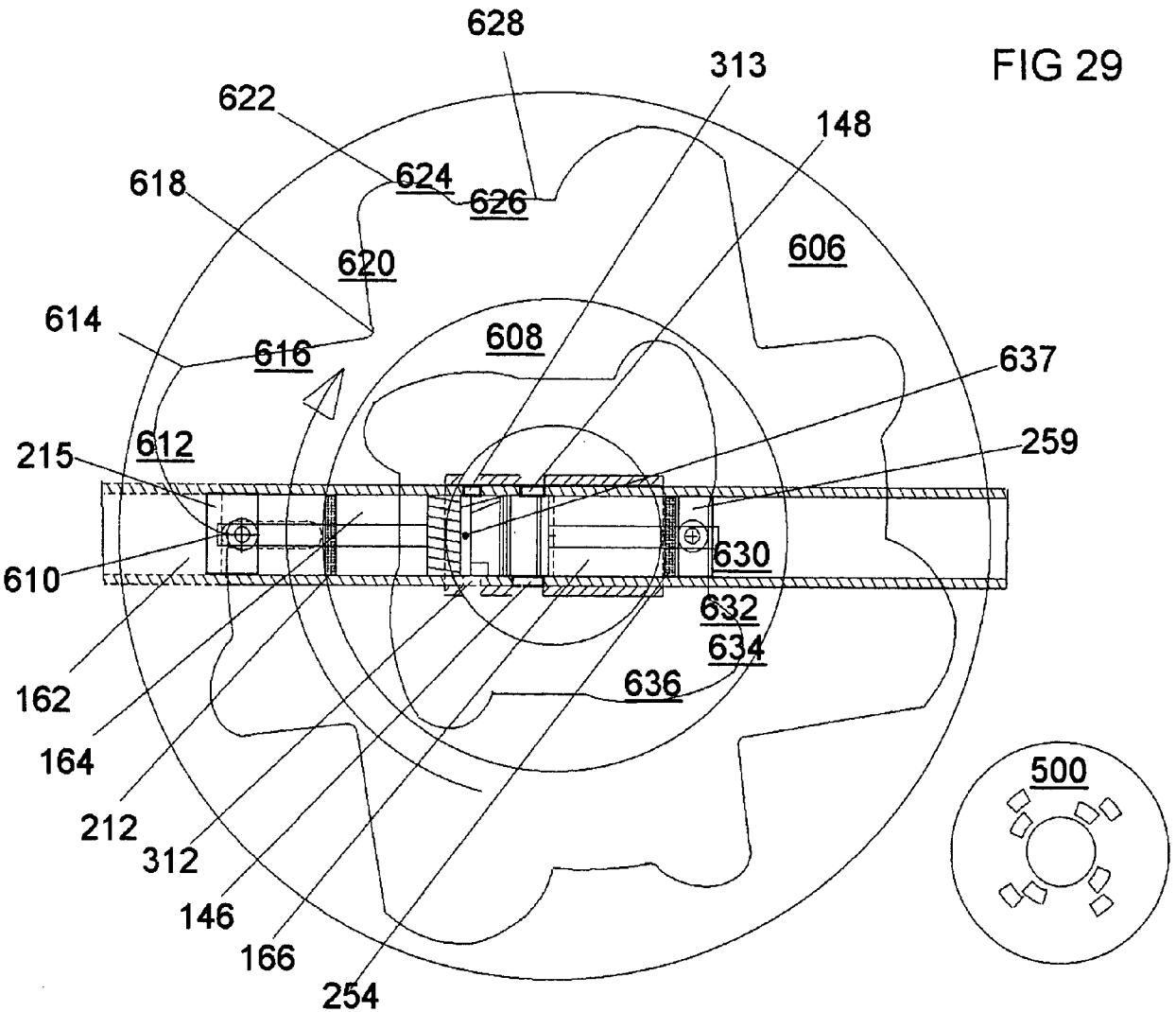
FIG. 29 is the first of a series of simplified, sectionalized top view of the power and head pistons as they rotated during engine operation. This view is the start of the combustion phase of combustion. The lower right hand side is a schematic of the fixed porting plate during the operation of the Otto cycle.

FIG. 29 shows the cam design features of the 606 outer periphery power piston cam and the 608 inner periphery head piston cam. Since the invention has upper and lower cam sets for the power and head pistons, the series of FIG's that are to follow precisely describe the cam sets used in the invention. The cam profiles, to be described, cause the independently moving power piston and head piston to move inwardly toward the center of rotation of the engine and with the combination of return springs and centrifugal force created during engine rotation, the power piston and head piston will always be in contact with the surfaces of their respective cam profiles. Further, the internal pressures in the cylinder during the compression and power strokes insure that the two pistons are mechanically separated. The 604 cylinder barrel assembly will be illustrated as it rotates during the key events of the Otto cycle.

The power piston and head piston cam slopes. For the power piston, 612 is the power stroke cam, 616 is the exhaust stroke cam, 620 is the intake stroke cam, 622 is the first stage compression stroke cam and is the 628 compression stroke flat which acts as the second stage for the compression stroke. The head piston acts in precise manner with respect to the power piston cam slopes, the cam slopes being 630 compression stroke flat, 632 end of power stroke cam slope, 634 end of exhaust stroke cam slope, 636 mid compression cam slope.

Fuel efficiency of the invention. As it can be clearly seen, there are four Otto cycle cam slopes for the inner and outer peripheral cams, thus, as the engine completes one rotation, four complete Otto cycles are accomplished. Because of this feature, the engine has the capability of rotating at very low speed while providing very high torque outputs as has been previously described. Compared to a conventional reciprocating engine, the invention is eight times more efficient in its power production. This, of course, is a critical design feature in the times of high fuel prices. Exemplified, an automobile engine which idles during traffic stops, rotates around 600 RPM. For a comparable four cylinder engine, that is 300 power strokes for each of the cylinders, the result being 1,200 power strokes in a period of one minute. The invention, having a generally self sustaining speed of 100 RPM, will have only 400 power strokes within one minute, the reciprocating engine thereby consuming three times the fuel at idle speeds. At the high end, a four cylinder reciprocating engine rotating at 5,000 RPM will have 2,500 power strokes for each of its four cylinders, the result being 10,000 power strokes within a period of one minute. With the invention, an anticipated 400 RPM maximum rotational range would produce 1,600 power strokes during the one minute period, or some 8,400 less power strokes for one minute of operation. At idle, the invention is 300 percent more efficient than the reciprocating engine and at maximum revolutions, 625 percent more efficient than the reciprocating engine.

Key operational points of the cam slopes during the Otto cycle. The power stroke starts with the power piston at 610 of the 612 power stroke cam and ends at 614. The 614 point is also the start of the exhaust stroke and continues on to 618 which is the end of the exhaust stroke and start of the intake stroke. In conventional terms, 618 would also be considered as the top dead center position for the power piston. Starting at 618 and continuing on to 622, the intake stroke is completed. In conventional terms, 622 would also be considered as the bottom dead center position for the power piston. It is important to understand at this point in the discussion that the compression stroke function are split into two distinct stages, the first being the curved upslope cam profile which is found between points 622 and 624. The second stage of the compression stroke for the power piston is the 626 compression stroke flat which occupies the space between 624 and the next 610 point in the rotation of the engine. Although the 626 compression stroke flat looks flat, it is actually a very low angle slope that eventually end s at the 610 point.

FIG. 29 shows the key operational points of the cam slopes during the Otto cycle. The power stroke starts with the power piston at 610 of the 612 power stroke cam and ends at 614. The 614 point is also the start of the exhaust stroke and continues on to 618 which is the end of the exhaust stroke and start of the intake stroke. In conventional terms, 618 would also be considered as the top dead center position for the power piston. Starting at 618 and continuing on to 622, the intake stroke is completed. In conventional terms, 622 would also be considered as the bottom dead center position for the power piston. It is important to understand at this point in the discussion that the compression stroke function are split into two distinct stages, the first being the curved upslope cam profile which is found between points 622 and 624. The second stage of the compression stroke for the power piston is the 626 compression stroke flat which occupies the space between 624 and the next 610 point in the rotation of the engine. Although the 626 compression stroke flat looks flat, it is actually a very low angle slope that eventually end s at the 610 point.

It must be also understood that the power piston independently works in close coordination with the independently movable head piston. As the power piston is at its 610 point, the head piston is at its 630 point which is its compression stroke flat. Because the inner periphery head piston cams are inboard of the power piston cams, the head piston cams have more mechanical advantage which is specifically employed during the two stage compression stroke. As the engine rotates, the head piston reaches the end of its compression stroke flat at 632 which has a sharp dropoff. This dropoff point at 632 is exactly the point where the power piston stroke ends and the exhaust stroke starts and it is here where the head piston is essentially unlocked from its fixed position. From 632 to 634 which is the equivalent point where the power piston comes to the end of its exhaust stroke at 618, the sharp head piston curve between 632 and 634 quickly flattens out to a very shallow cam curve. The shallow curve portion of 634 to 636 therefore has a high mechanical advantage because it is (a) inboard of the power piston cams, and (b) it has a low rate of incline, much like the two 626, 630 compression stroke flats which are equally shallow cam inclines.

FIG. 29 shows the two stage compression stroke of the power and head pistons. Unlike any designs in the prior art that may use a single cam slope or with reciprocating engines that employ crankshaft rotation for the compression stroke, the invention uses a combination of two stages of movement of the power and head pistons to accomplish the compression stroke for the reason that the energy required to compress the fuel-air mixture has always been detrimental to the overall power output of any engine and has not been successfully addressed by the existing engines in this subclass. The principal feature of the two stage compression stroke is to move the power piston upward for a minimum distance and then quickly lock it into a position on its 626 compression stroke flat where it will be essentially held in position as the internal cylinder pressures continues to increase during the compression stroke. As was demonstrated in FIG. 28, the piston moves upward for approximately 2¼ inches encountering only a 30 pounds per square inch opposing pressure. It then locks into relative non-movement on the 626 compression stroke flat.

At the 622 point in the power piston movement, the head piston compression rings have almost covered the intake and exhaust-intake ports and as the power piston starts its upward movement to point 624, the head piston compression rings completely cover the intake and exhaust-intake ports insuring a pressure tight cylinder during the compression stroke. In terms of the two stage compression stroke, both the power piston and the head piston continue to approach each other, the head piston doing most of the inward movement during the 634 to 636 points on its cam slopes. Since the power piston gets to the point where it is essentially locked into place on its 626 compression stroke flat, the high mechanical advantage of the head piston completes the final, second stage of the compression stroke.

As the engine rotates, the head piston now enters at the 636 point and effectively locks itself into a relatively motionless state on the 630 compression stroke flat for the head piston as the engine rotates to the 610 point where the start of combustion reoccurs, the power and head pistons now very slowly approaching each other due to the low incline of their respective compression stroke flats. Once the power piston enters at 624 onto its compression stroke flat, an advanced ignition can occur, that point being roughly 19 degrees before top dead center which would be the equivalent to 588 point shown in FIG. 28. However, because of the movement restrictions of the power and head piston cam flats, the pressure buildup during that combustion phase will not, in any, way cause any counter rotational forces on the engine rotor and the time it takes to achieve maximum internal combustion pressures, as per the curves found in FIG. 28, will generally occur at the 610 point when the next round of power strokes begins.

FIG. 29 shows the power piston and head piston chambers. 162 is the chamber where the cooling air for the exhaust-intake chamber is created during the power and intake strokes of the power piston. 164 is the chamber in the power piston where the air-oil mist is created during the reciprocating motion of the power piston. 166 is a similar chamber in the power piston where the air-oil mist is created during the reciprocating motion of the head piston. The 212 is the spring retainer for the power piston which effectively creates the power piston 164 chamber. 254 is the spring retainer for the head piston which effectively creates the head piston 166 chamber. As will be seen in FIG. 29 through FIG. 36, the 162, 164, 166 chambers are continually active as the engine operates and the 90, 124 cylinder barrel rotates with the 52 engine rotor.

Figure 31:
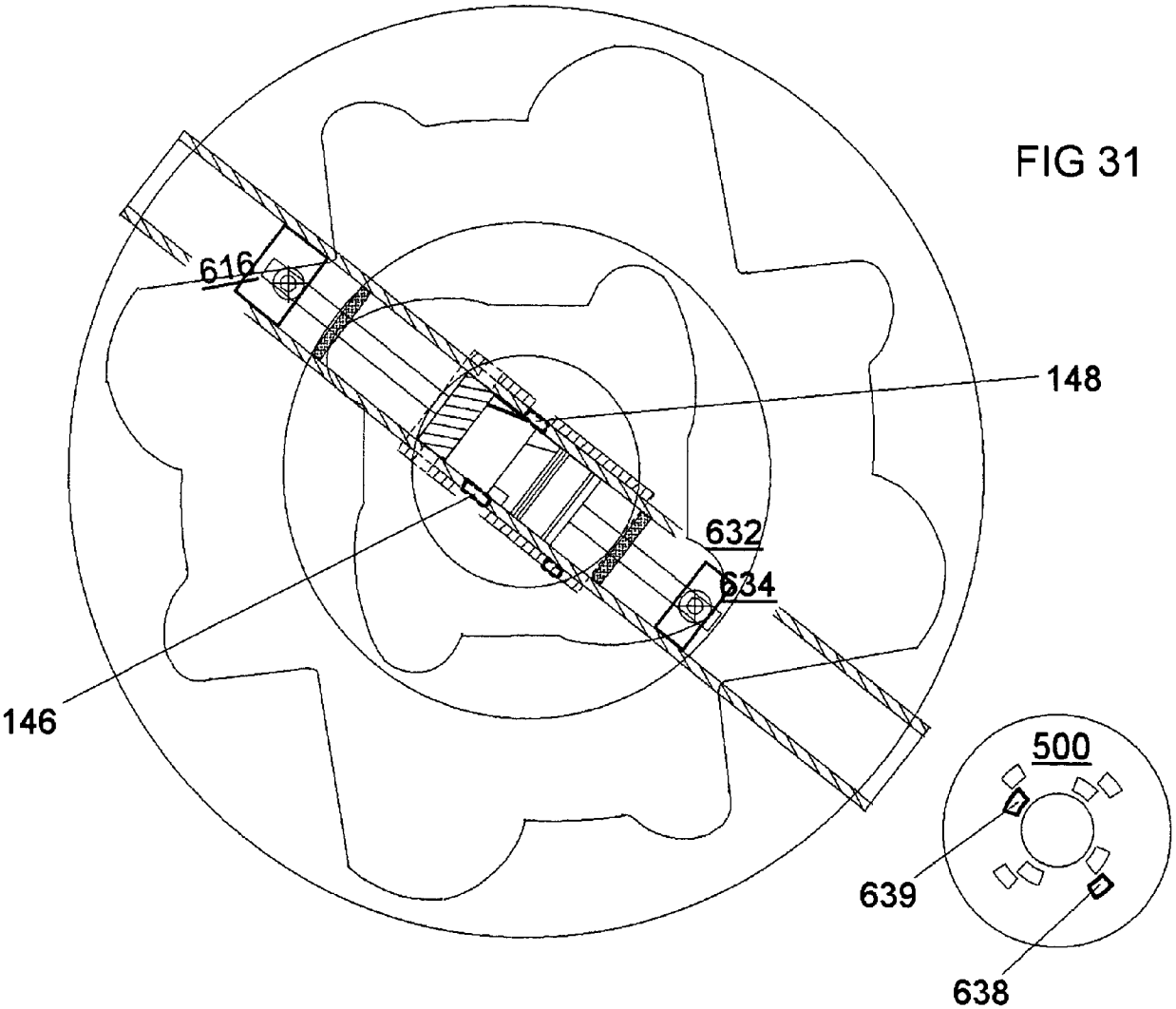
FIG. 31 is a view of the cylinder, power and head pistons and their relative contacts with their respective cams as the engine nears the end of the exhaust stroke. The fixed porting plate has its intake port open to the rotor.
Figure 32:
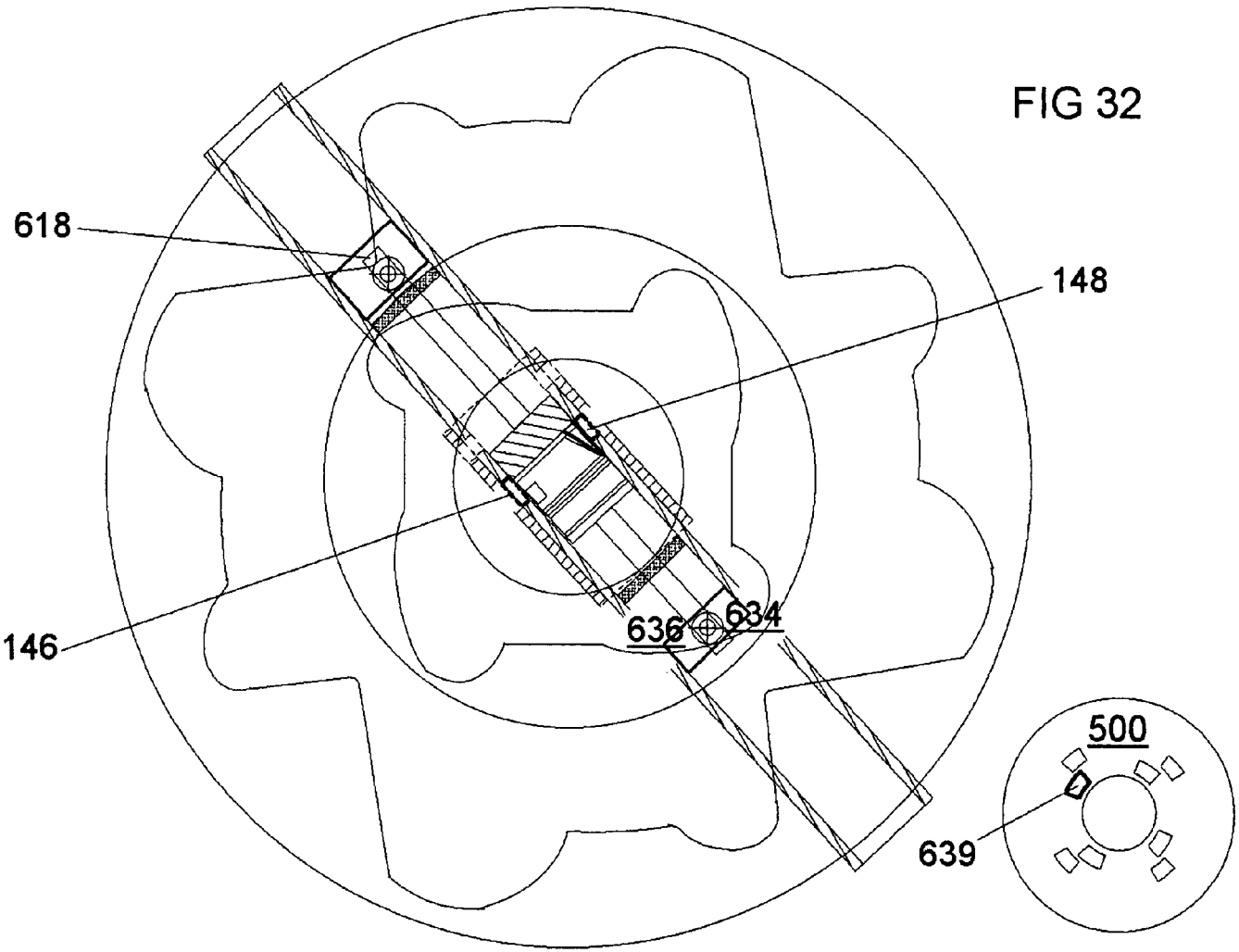
FIG. 32 is a view of the cylinder, power and head pistons and their relative contacts with their respective cams as the engine is at the start of the intake stroke.

The power piston web. The web for the power piston 198 has a function of cutting off all flow into the 340 chamber for the intake port at a particular point during the exhaust stroke. During this range of motion by the power piston during its exhaust stroke, as shown by FIG. 31 and FIG. 32, the exhaust gasses are exclusively forced into the 396 port of the exhaust-intake channel in the 190 lower portion of the mid barrel.

FIG. 29 is the informational starting point for the drawings that will follow, namely FIG. 30 through FIG. 36. The slotted intake port 146 and the slotted exhaust-intake port 148 along with the fixed porting cap 500 with its typical intake ports 504 and its typical exhaust ports 502 combine to describe the various cam slopes for both the outer periphery power piston cam plates 606, 607 and the inner periphery head piston cam plates 608, 609. FIG. 29 is the stage where ignition has already occurred during power piston bearing travels along the power piston second stage compression stroke flat 626. In the lower right hand corner of each sequential drawing is the symbolic fixed porting cap 500. As a matter of importance, the intake and exhaust sequences of the fixed porting cap 500 are informational in nature and the invention is not to be limited to the specific timing sequences that are to be described and the invention is capable of other alternatives, specifically with regard to the design of the various cam slopes for the outer periphery power piston cam plates, the various cam slopes for the inner periphery head piston cam plates and the size, profile and exact placement of the intake ports 504 and exhaust ports 502 that are machined into the fixed porting cap 500.

Since FIG. 29 is at its initial combustion stage, the ignition system, symbolized only by the spark plugs 312, 313, are given the properly timed electrical ignition impulses that creates the combustion event of this Otto cycle engine. By the time the power piston moves from its start of power stroke 610, the internal pressure in the closed ended cylinder 90 is now at point 598 in shown in FIG. 28, generally 350 pounds per square inch. The combustion event is indicated by 637. Further, particular attention must be paid to the chamber exhaust-intake port cooling air 162, power piston air-oil mist creation area 164 and the head piston air-oil mist creation area 166 as these chambers expand and shrink in area as the power and head pistons reciprocate in the closed ended cylinder 90.

Figure 30:
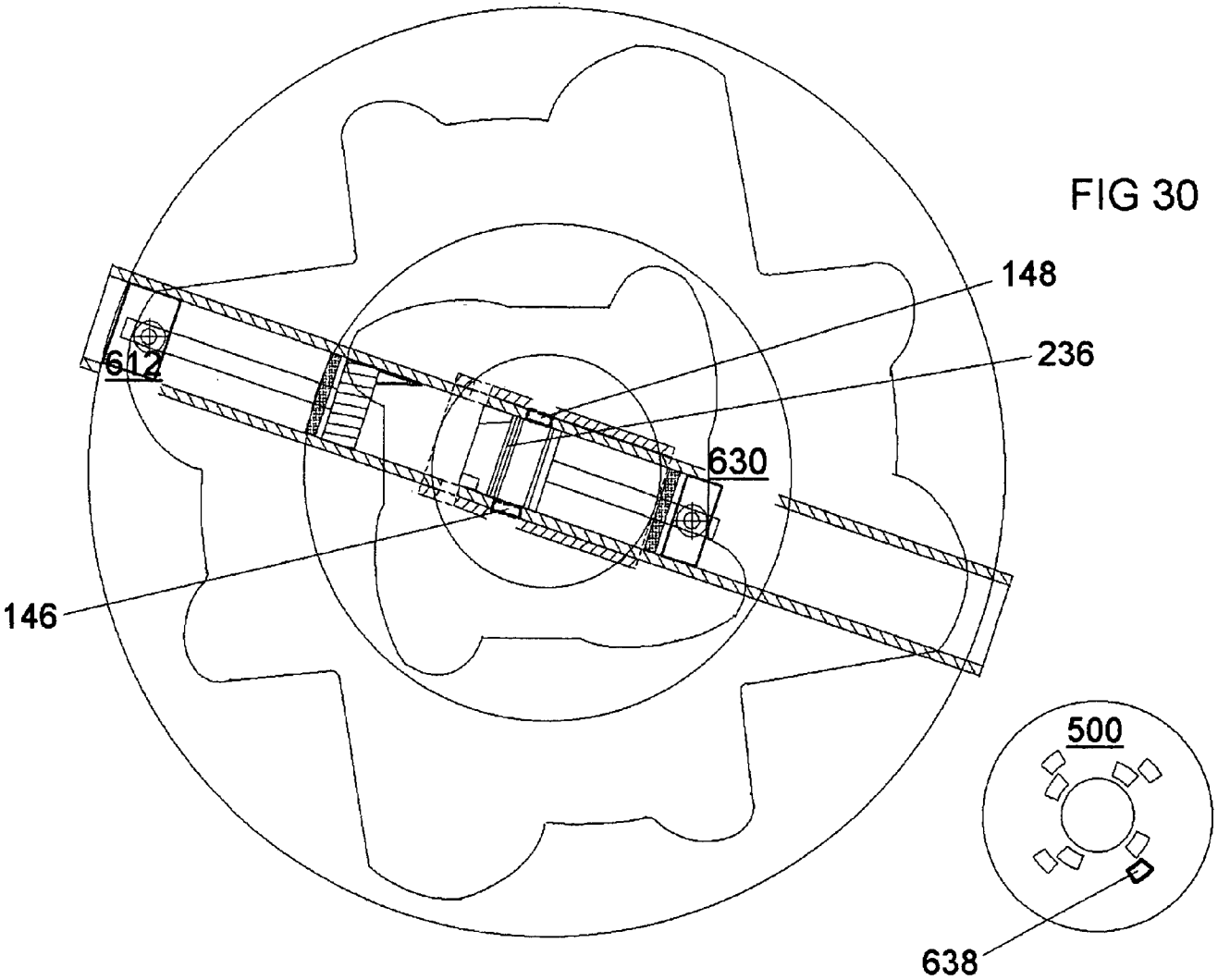
FIG. 30 is a view of the cylinder, power and head pistons and their relative contacts with their respective cams as the engine nears the end of the power stroke. The fixed porting plate now has its exhaust port open to the rotor.

FIG. 30 illustrates the power piston as it nears the end of the power stroke and the start of the exhaust stroke cam slope 614. The internal pressure is about 160 pounds per square inch as shown by point 600 in FIG. 28. The head piston assembly 222 is on its final portion of the power piston power stroke cam 612 while the head piston assembly 242 is at its final position on its head piston power stroke cam flat 630. At this point, the exhaust slot 638 in the fixed port cap 500 is just starting to open to the exhaust port 412 in the bottom bearing plate 450. The compression rings 236 seal off the cylinder slotted intake port 148 and the slotted exhaust-intake port 146.

FIG. 31 illustrates the power piston as it nears the end of the exhaust stroke and the start of the intake slope as it travels along the power piston exhaust stroke cam 616 while the head piston has by now rapidly dropped off of the head piston power stroke cam flat 630 and equally rapidly follows the head piston end of power stroke cam slope 632 and onto the shallower head piston end of exhaust stroke cam slope 634. During the exhaust stroke, the exhaust-intake port 638 in the fixed porting cap 500 is nearing its close-off point with the exhaust port 412 in the bottom bearing plate 450. As the power piston nears the start of the intake stroke, the intake port 639 in the fixed porting cap is now starting to open. At this point, it can be seen that the head piston has left the exhaust port 146 and intake port 148 open for flows during the coming intake stroke process. At this point the power piston intake port web 198 is just starting to close off the intake port 148 At this point, the exhaust gasses are exclusively driven out of the exhaust port 148. Since the chamber exhaust-intake port area 330 has already been pressurized with cooling air by the previous head piston power stroke, the cooling air and the exhaust gasses are in their last stage of being forced out the exhaust port 412 in the bottom bearing plate 450 and through the exhaust slot 638 in the fixed porting cap. During this exhaust stroke process, the exhaust-intake port cooling air has also surrounded and cooled off the exhaust port inner housing 400.

FIG. 32 illustrates the end of the exhaust stroke and start of the intake stroke for the power piston assembly 222. At this point the intake port 148 is closed off by the web for the power piston 198 while the intake port 639 in the fixed porting cap 500 is getting close to being fully opened in preparation for the intake stroke. Simultaneously, the remaining cooling air residing in the chamber exhaust-intake port area 330 and will be subsequently drawn into the closed ended cylinder 90 during the intake stroke along with the fuel-air mixture from the intake port 148. The head piston is continuing to travel along its head piston mid compression cam slope 636. Once beyond the peak of the exhaust slope 618, the compressed power piston spring 204 accelerates the power piston down the next slope.

Figure 33:
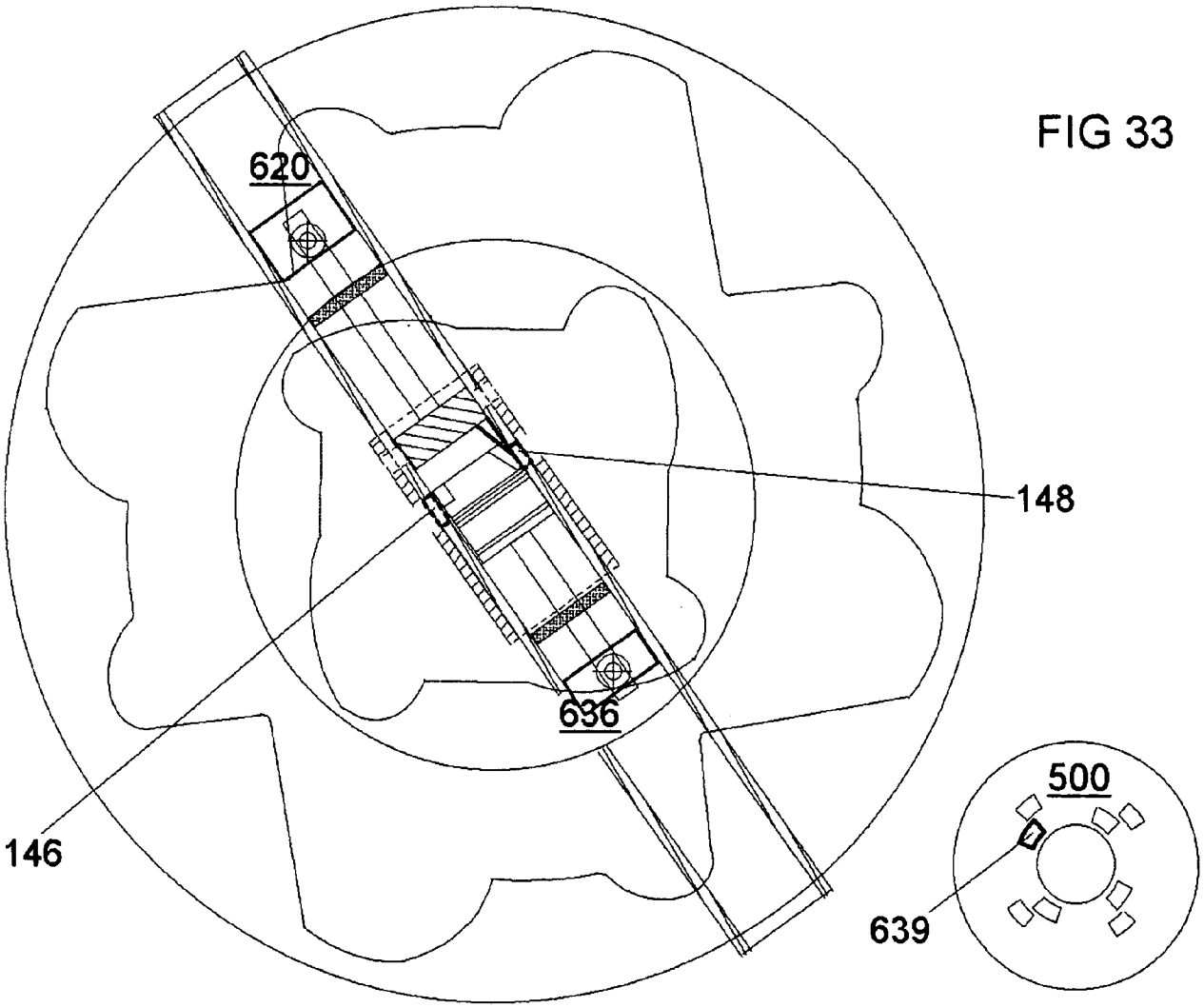
FIG. 33 is a view of the cylinder, power and head pistons and their relative contacts with their respective cams as the engine is in the early stage of the intake stroke.

FIG. 33 illustrates the early stages of the intake stroke by the power piston along the power piston intake stroke cam 620. The head piston is starting to move to the center of the closed ended cylinder 90 which will eventually close off the intake port 148 and the exhaust-intake port 146 as the intake stroke continues. The intake port 639 in the fixed porting cap 500 is about at its fully opened position and as the web for the power piston 198 draws away, the fuel-air mixture is now drawn into the closed ended cylinder 90. The head piston is continuing to travel along its head piston mid compression cam slope 636. During its travel down the intake stroke slope 620, the force of the compressed power piston spring 204, in combination with the centrifugal force imposed on the power piston, combine to create a secondary rotational force for the engine. Although there is no internal cylinder pressures as with the power piston power stroke, the combined spring and centrifugal forces on the power piston add to the torque output for this invention.

Figure 34:
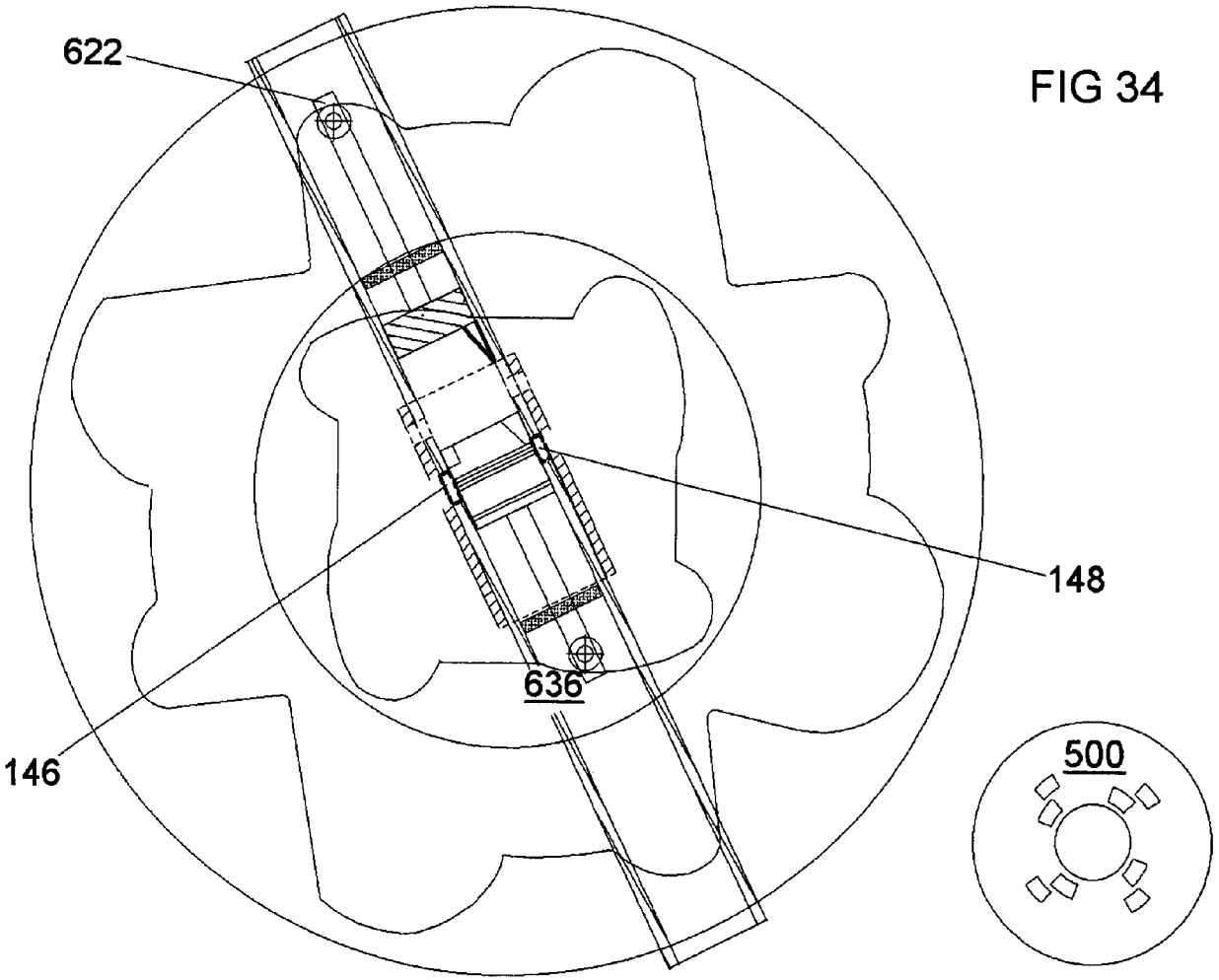
FIG. 34 is a view of the cylinder, power and head pistons and their relative contacts with their respective cams as the engine nears the end of the intake stroke.

FIG. 34 illustrates the power piston intake stroke end 622 and the start of power piston first stage mid compression slope cam 624. Once the power piston has fully climbed this cam slope, the power piston has only moved about two inches in cylinder travel and that is illustrated in FIG. 28 at point 586. FIG. 34 now shows that as the head piston assembly 242 continues along the head piston mid compression cam slope 636 the head piston compression rings have covered the intake port 148 and is close to covering the exhaust port 146. All this in preparation for the coming two stage compression stroke by the power piston assembly 222.

Figure 35:
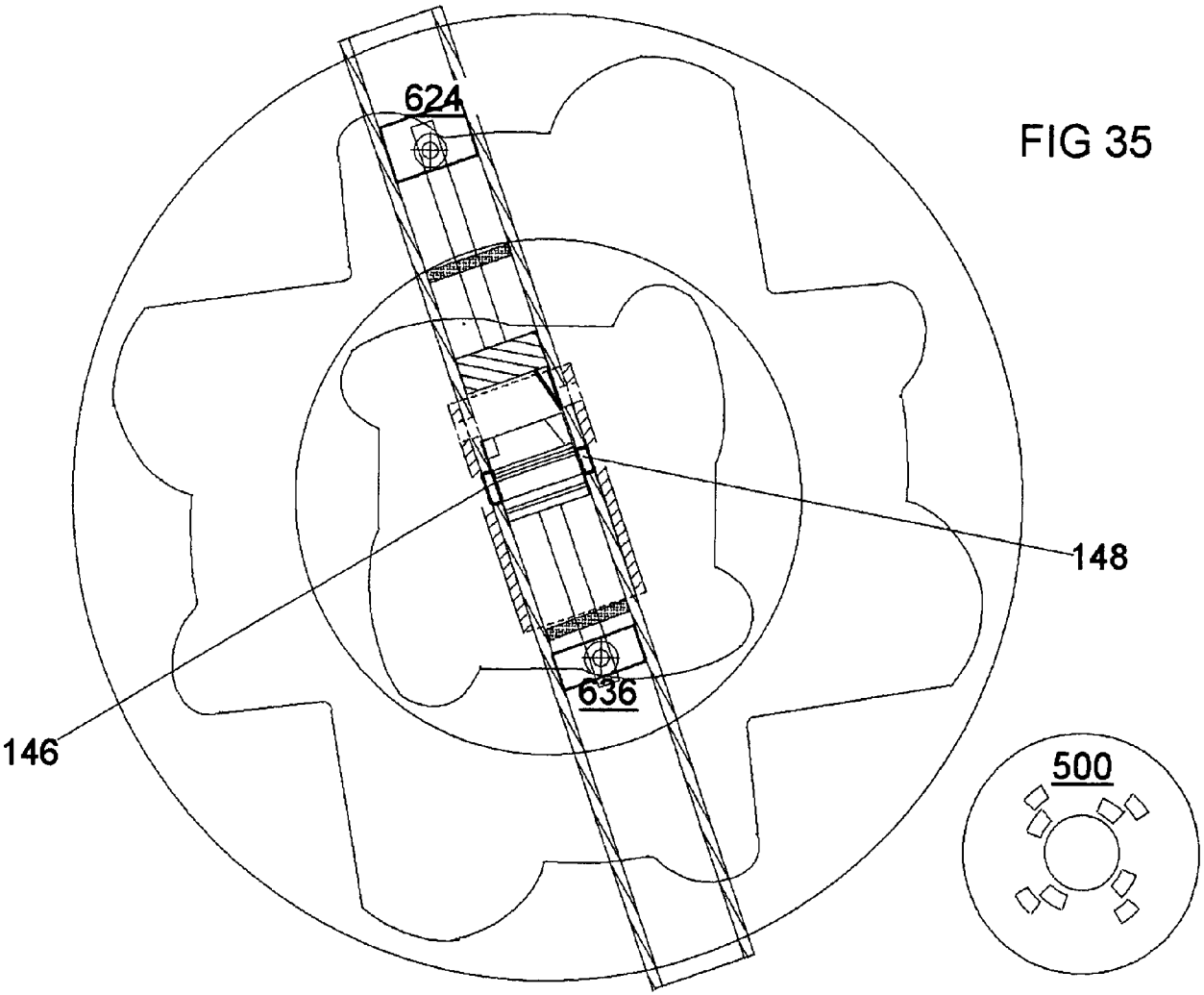
FIG. 35 is a view of the cylinder, power and head pistons and their relative contacts with their respective cams as the engine is at the mid-way point in the compression stroke.

FIG. 35 illustrates that the head piston assembly 242 has entered its last phase of travel upon the head piston mid compression cam slope 636 and that by now its compression rings have fully covered the intake port 148 and the exhaust port 146 as the power piston embarks upon its second stage of the compression stroke. The head piston is about to enter upon its head piston power stroke flat cam 630 in anticipation of the ignition event that occurs roughly at this point. FIG. 35 also demonstrates that by using the standard pressure curves on the chart in FIG. 28, it can be seen that the power piston only has to overcome a small pressure before it arrives at the start of the power piston second stage compression stroke flat 626. Looking at the head piston compression slope cam 636, the workload for the final stages for the compression stroke is now shifted to the head piston and its associated inner periphery head piston cam plates 608, 609 which have a superior mechanical advantage over the power piston outer periphery cam plates 606, 607 specifically during the compression stroke event.

Figure 36:
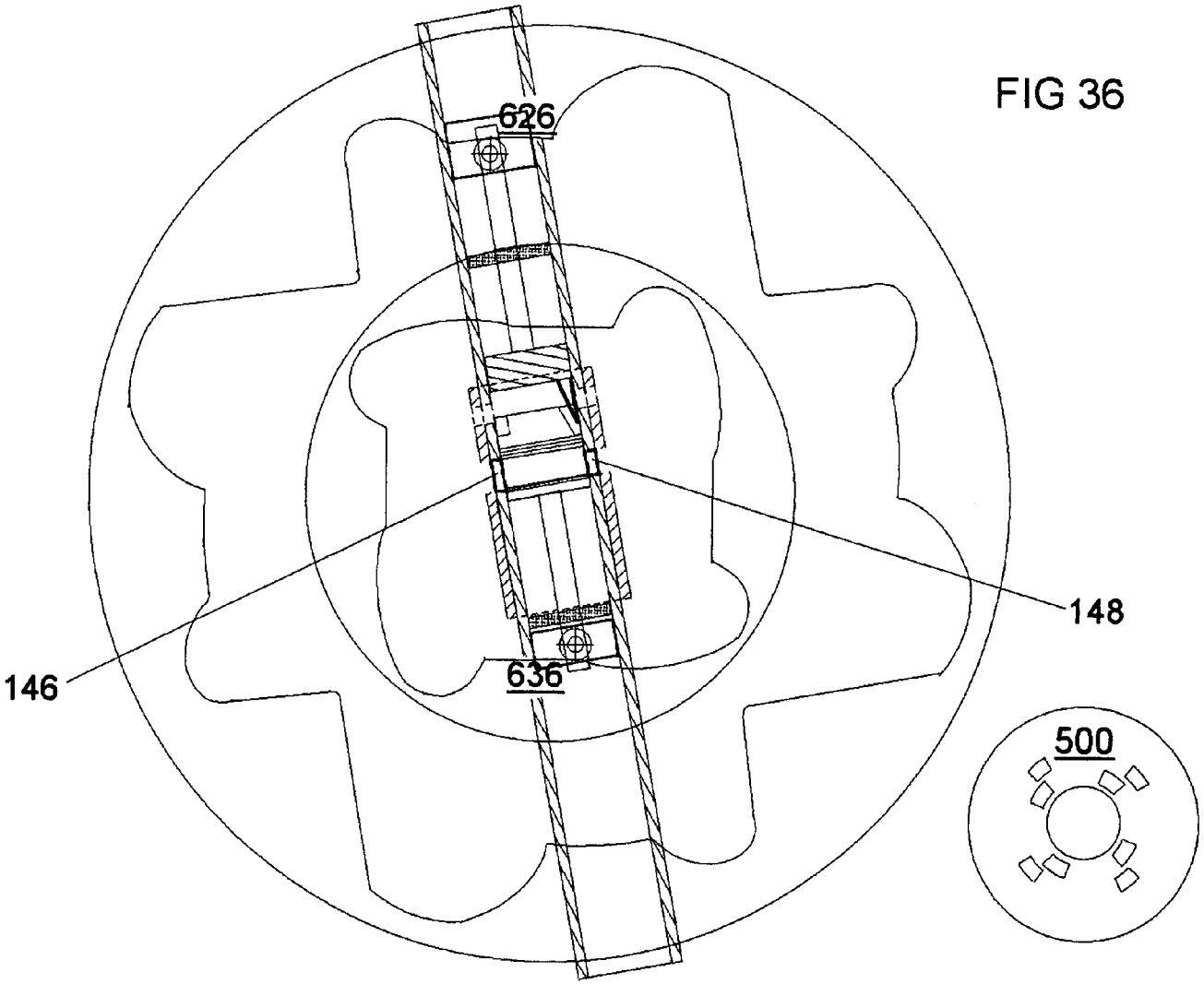
FIG. 36 is a view of the cylinder, power and head pistons and their relative contacts with their respective cams as the engine nears the end of its compression stroke.

FIG. 36 is the final drawing of the engine operational sequence. Travelling along the final portion of the power piston second stage compression stroke flat 626 it can be seen that the power piston is nearing the end of its two stage compression stroke 628. The head piston has now entered the mid portion of its head piston compression slope cam 636 and as the internal combustion pressure continues to increase within the dosed ended cylinder, the stage is set for the next power stroke of the engine.

Figure 37:
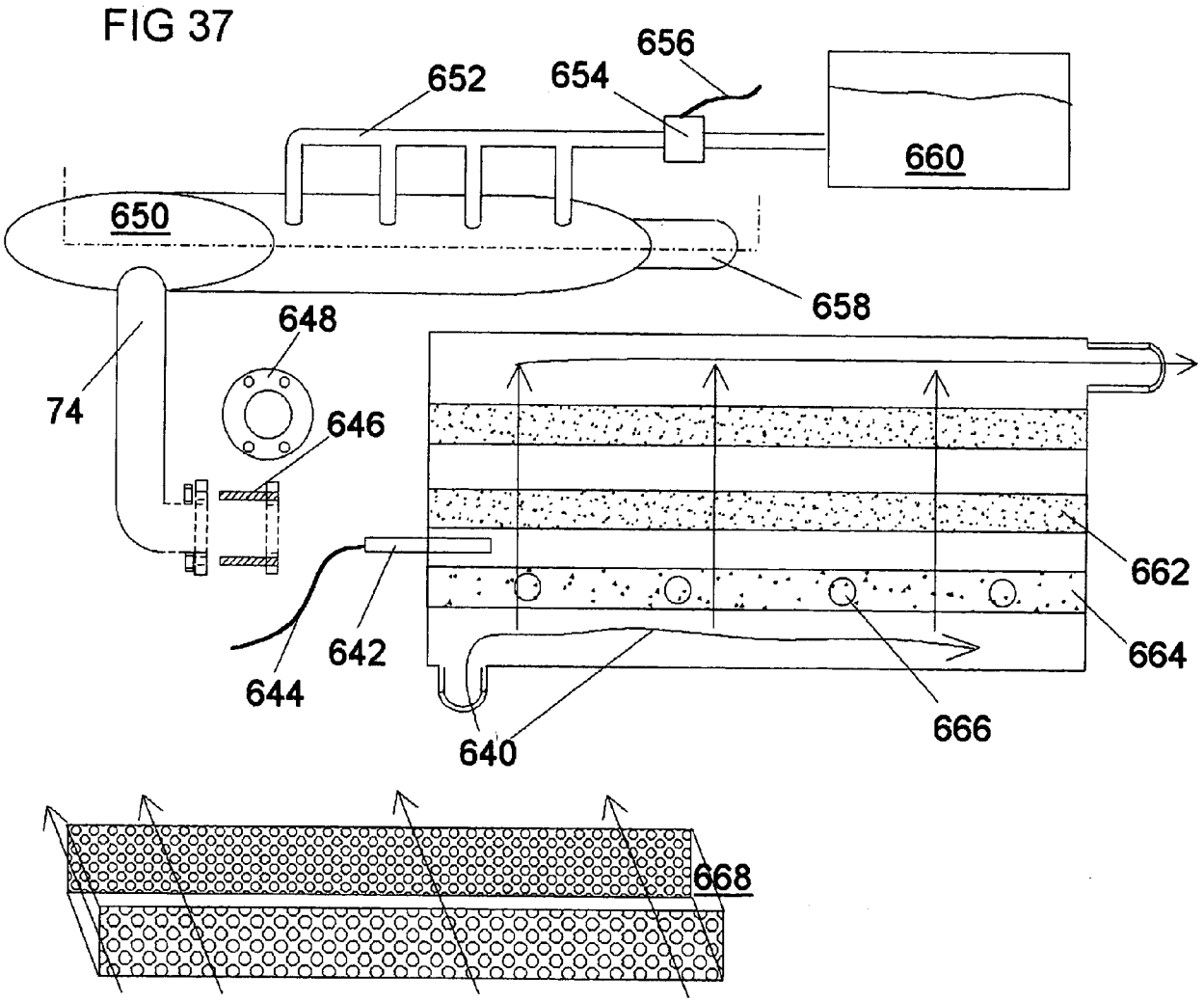
FIG. 37 is a combination proportional and sectionalized views of the exhaust gas filter canister along with interior sectionalized and proportional views of the canister filter stages.

FIG. 37 is a basic system representation of the canister exhaust gas filter 650 and the system should not be limited to the discussions and illustrations that follow in that alternate embodiments can be employed to achieve the same purpose. Since the invention is a low speed valveless horizontally opposed piston rotary internal combustion engine that is generally designed for a 100 revolutions per minute to 400 revolutions per minute envelope, it can be seen that the total heat energy that is sent out through the engine exhaust pipe 74 is considerably less than the exhaust gas flow from a reciprocating engine or any other engine that has a high end revolutions design, thus, the temperature buildup is significantly less for this invention making the canister design illustrated here a very practical and economical way to scrub exhaust emissions with a low technology process. The exterior and interior features are simple and many components can be manufactured from sheet metal, the preferred material being stainless steel which is highly corrosion resistant.

The engine exhaust port 648 is the frontal detail of the boss for the exhaust port 536 found on the output gear box 540. A side sectioned view shows the exhaust port pipe attach studs 646 onto which the engine pipe 74 is attached. The engine exhaust pipe may be attached to the canister in various fashions but the drawing shows a welded pipe installation. Even though the exhaust gasses are low flow, the exhaust gas heat absorptive filter stage takes the exhaust gas as it is dispersed within the canister 640 and spreads it out for this first filter stage. The materials in this first filter stage should be lightweight and impervious to heat yet porous enough to not cause a major pressure buildup as the canister functions. Just after the first filter stage is a filter interstage exhaust temperature probe 642 which can be used to control cooling water flow as well as source of temperature indication within the vehicle cabin which can be seen by an operator, this portion of the system not being in the drawing. The subsequent filter stages 662 can use materials that can absorb the pollutants from the exhaust gas and have the same temperature resistant and gas flow characteristics as the first filter stage. The system is designed not to use the cooling water system in normal engine operating conditions, however, should the engine be installed in a vehicle that operates in a very hot desert climate, the cooling system that will be described will be activated automatically.

The remainder of the system components are detailed as the water supply tank with connective piping 660, a manifold valve for gravity feed or a water pump 654 depending on the specific system design, appropriate wiring 656 to the external portions of the cooling water control system which are not shown in the drawings, and the canister water cooling manifold 652 with its related internal canister interior cooling inlet locations 666. The exhaust system terminates with the canister exhaust pipe 658.

The inlet air aspect of the basic environmental design for the invention is shown in FIG. 1 with a typical case side plate air filter 72, one being available for each side of the engine case assembly 50. With this configuration, ambient air is always available to the engine interior case yet the exterior dust and other particulates are kept from entering. FIG. 2 shows the typical rotor guide block 82 which has the appropriate clearances for the engine rotor upper plate 272 and the engine rotor lower plate 276 which keeps the engine rotor assembly precisely aligned as it turns and also provides the appropriate distances between the engine case upper plate 270 and the engine case lower plate 280 which will provide the proper fits for the case side plates 70.

I claim:

1. (a) a engine case assembly (50) having a centralized vertical axis of rotation (106) having provision for a engine rotor assembly (52) said engine case assembly having engine mount holes (604) for detachable support on the frame of a vehicle said engine case assembly having a detachable a upper bearing cover plate (54) on the top surface of said engine case upper plate (268) a detachable gear box housing (520) on the bottom surface of a engine case lower plate (280) affixed to the lower surface of said engine case upper plate (268) a outer periphery power piston cam plate (606) a inner periphery head piston cam plate (608) affixed to the top surface of a engine case lower plate (280) said outer periphery power piston cam plate (606) a inner periphery head piston cam plate (608);

(b) said engine rotor assembly (52) having a centralized vertical axis of rotation having provision for a engine rotor upper plate (272) a upper roller bearing (270) a cylinder barrel assembly (90,124) sandwiched between a lower roller bearing (278) a engine rotor lower plate (276);

(c) said Outer periphery power piston cam plate (606) having a plurality of a power piston power stroke cam (612) a power piston exhaust stroke cam (616) a power piston intake stroke cam (620) a power piston first stage mid compression slope cam (624) a power piston second stage compression stroke flat (626);

(d) said Inner periphery head piston cam plate (608) having a plurality of a head piston power stroke cam flat (630) a head piston end of power stroke cam slope (632) a head piston end of power stroke cam slope (634);

(e) a top bearing plate (104) having said centralized vertical axis of rotation (106) provision for a commutator assembly (422) on its top surface said upper roller bearing (270) being surrounded by said top bearing plate and a support pad (406) said upper roller bearing outer race being sandwiched between said engine case upper plate (268) and said support pad said upper roller bearing inner race being sandwiched between the top bearing plate and a upper bearing clamp ring (266) said top bearing plate having said commutator assembly (422) affixed to a commutator unit mounting boss (298) said commutator assembly (422) operatively connected to a commutator cover assembly (424) said upper cover bearing plate;

(f) a mid barrel assembly (188, 190) centrally sandwiching said cylinder barrel assembly (90, 124) along its longitudinal axis the said top bearing plate (104) sandwiching said mid barrel assembly (188, 190) between said bottom bearing plate (450) said bottom bearing plate having a bottom bearing plate center shaft (454) said shaft axis of rotation being coincident with said centralized vertical axis of rotation (106) said bottom bearing plate center shaft having a spur drive gear (462) at its lower end said spur drive gear being rotably interconnected with a pair of parallel mounted said output drive shafts (464) said output drive shafts having a horizontal axis of rotation said mid barrel assembly (188, 190) having internal redundant a oil chambers (322, 328, 332, 342) a air-oil mist entry chambers (336, 338) a vacuum chambers (320, 324) a oil needle valves (572, 573) said passage air-oil recirculating (326, 334) (344, 346) said cutouts for a spark plugs (418, 420) said holes oil resupply for a oil chambers (372, 374) a holes spark plug fuel primer fuel injection port (376, 378) and individual a chamber exhaust-intake port area (330) said chamber intake port area;

(g) said bottom bearing plate (450) said lower roller bearing (278) being surrounded by said bottom bearing plate and said support pad (406) said lower roller bearing outer race being sandwiched between said engine case lower plate (280) and said support pad said lower roller bearing inner race sandwiched between the bottom bearing plate and said lower bearing damp ring (276) a bottom bearing plate center shaft (454) being journaled by a bearings center shaft (466, 468) said center shaft rotably urged along said centralized vertical axis of rotation (106) interconnects said center shaft spur gear (462) with horizontally rotable a output drive shafts (516, 518);

(h) said cylinder barrel assembly (90, 124) having a chamber for a exhaust-intake port cooling air (162) said chamber admitting engine compartment air on the inward strokes of said power piston assembly (222) as said engine rotor assembly (52) operatively rotates said chamber compressing engine compartment air on the outward strokes of said power piston assembly (222) as said engine rotor assembly (52) operatively rotates said exhaust-intake being forced out a pair a cylinder cooling air outlet ports (143, 145) said ports being interconnected by a connecting pipe exhaust-intake chamber air cooling (178) said pipe having its open end disposed within the interior of the a chamber exhaust-intake port area (334) said cylinder barrel assembly having a power piston air-oil mist creation area (164) said area ingesting and expelling air-oil mist said area recirculating the air-oil mist from a cylinder port for power piston air-oil mist (143, 145) said ports being interconnected with a connecting pipe air-oil mist recirculation (186, 187) said pipes entering a access hole air-oil system pipe (356, 358) said access holes being located in a mid barrel lower half (190) said cylinder barrel assembly having a head piston air-oil mist creation area (166) said area ingesting and expelling air-oil mist from a cylinder air-oil mist slots (129, 131, 139, 141) through a barrel air-oil mist slots (128, 130, 142, 144) said slots distributing air-oil mist into a passage right side air-oil recirculation system (326, 330) and said passage left side air-oil recirculation system (344, 346) said cylinder barrel assembly being closed at each end by a cylinder power piston end cap (88) and a cylinder head piston end cap;

(i) said power piston assembly (222) a interconnecting with a power piston piston head (194) said power piston piston head (194) having a projecting intake port web (198) a plurality of a piston rings in grooves (196) said power piston piston head (194) interconnecting with a power piston piston rod (192) being disposed within a non-abrasive spring sleeve (202) said spring sleeve supporting a slidably operative a power piston spring (204) said power piston spring having one end abutting a fixed a power piston spring retainer (212) the opposite spring end abutting the face of the a power piston bearing retainer assembly (215) said power piston bearing retainer assembly providing a pivotal attachment for a power piston upper cam bearing (98) and a power piston lower cam bearing (218) said bearings having a vertical axis of rotation as they slidably contact said outer periphery power piston cam plate (606);

(j) a head piston assembly (242) interconnecting with a head piston piston head (258) said head piston piston head (258) having a web cutout portion a exhaust-intake port cutout (234) a plurality of a piston rings in grooves (236) said head piston piston head (258) interconnecting with a head piston piston rod (256) being disposed within a non-abrasive spring sleeve (244) said spring sleeve supporting a slidably operative a head piston spring (246) said head piston spring having one end abutting a fixed a head piston spring retainer (254) the opposite spring end abutting the face of the a head piston bearing retainer assembly (259) said head piston bearing retainer assembly providing a pivotal attachment for a head piston upper can bearing (94) and a head piston lower cam bearing (238) said bearings having a vertical axis of rotation as they slidably contact said inner periphery head piston cam plate (608);

(k) a means of a fuel induction system being a carburetor (102) a fuel control unit (102) a engine intake pipe (68) interconnecting a inner tube portion porting cap (522) a fixed porting cap (500) having a plurality of a intake ports (504) moving into juxtaposed relationship with rotating said bottom bearing plate (450) said mid barrel assembly (188, 190) communicates a fuel air mixture to a chamber intake port area lower mid barrel (340);

(l) a means of expelling exhaust gasses from a combustion event (637) and cooling a exhaust port inner housing (400) by a closed ended cylinder (90) having said centralized vertical axis of rotation (106) operatively interconnected by a port exhaust-intake channel lower mid barrel (396) said exhaust port inner housing (400) a exhaust port lower mid barrel (412) operatively interconnected with said exhaust port in said bottom bearing plate (450) interconnected with said fixed porting cap (500) having a plurality of a exhaust ports (502) interconnecting with annulus exhaust manifold connection pipe interior connecting to a pipe interior exhaust annulus (474) a boss exhaust port said engine exhaust pipe (74) a canister exhaust gas filter said canister exhaust pipe (658);

(m) a means of extracting said engine case assembly (50) interior vapors and cooling said engine case assembly (50) a plurality of a case side plate (70) said case side plates having a plurality of a case side plate air filter (72) allowing outside air to circulate within said engine case assembly (50) said engine rotor assembly (52) operatively rotating causing a rotor air vane (82) to circulate cooling air within said engine case assembly (50) said closed ended cylinder (90) ingesting interior air from within said engine case assembly (50) by said chamber exhaust-intake port cooling air (162) a vacuum sleeve (118) being sealed and surrounding said closed ended cylinder (90) a exterior source of vacuum being operatively interconnected to said upper bearing cover plate (54) said commutator assembly (422) a hose fitting commutator fluid output port (440) a fluid hose (442) a hole vacuum supply to vacuum chamber in mid barrel upper portion (300) said vacuum chamber in mid barrel upper section (302) a hole vacuum supply communicating with vacuum space in sleeve (304);

(m) a canister exhaust gas filter (650) operatively connected to said engine exhaust pipe (74) said canister exhaust gas filter having a exhaust gas absorptive filter stages (644) a canister water cooling manifold (652) a plurality of a canister interior cooling inlet locations (666) operatively connected by a water supply tank with connective piping (660) a manifold valve water pump (656) a electrical connection exhaust temperature probe (642).

2. A low speed valveless horizontally opposed piston rotary internal combustion engine according to claim 1, wherein said power piston assembly (222) is slidably disposed within said single closed ended cylinder assembly (90, 124) said closed ended cylinder assembly (90, 124) said power piston assembly (222) operatively connected to said outer peripheral power piston cam plate (606) said outer peripheral power piston cam plate (606) affixed to lower surface of said engine case upper plate (268) said power piston assembly (222) operatively connected to said outer peripheral power piston cam plate (606) said outer peripheral power piston cam plate (606) affixed to top surface of said engine case lower plate (280) said power piston assembly (222) slidably interconnected with said power piston piston rod (192) and said power piston bearing retainer assembly (215) whereby linear reciprocation of said power piston assembly (222) in said single closed ended cylinder assembly (90, 124) affects rotation of said engine rotor assembly (52) the axis of rotation of said engine rotor assembly (52) being coincident with said vertical axis of rotation (106).

3. A low speed valveless horizontally opposed piston rotary internal combustion engine according to claim 1, wherein said head piston assembly (242) is slidably disposed within said single closed ended cylinder assembly (90, 124) said closed ended cylinder assembly (90, 124) a head piston assembly (228) operatively connected to said inner peripheral head piston cam plate (608) said inner peripheral head piston cam plate (608) affixed to lower surface of said engine case upper plate (268) said head piston assembly (228) operatively connected to said inner peripheral head piston cam plate (606) said inner peripheral head piston cam plate (608) affixed to top surface of said engine case lower plate (280) said power piston assembly (228) slidably interconnected with said head piston piston rod (256) and said head bearing retainer assembly (259) whereby linear reciprocation of said head piston assembly (228) in said single closed ended cylinder assembly (90, 124) affects rotation of said engine rotor assembly (52) the axis of rotation of said engine rotor assembly (52) being coincident with said vertical axis of rotation (106).

4. A low speed valveless horizontally opposed piston rotary internal combustion engine according to claim 1, wherein said combustion event (637) surrounding a piston surface (230) a power piston surface (200) said head piston surface (230) juxtaposed heads of said pistons are slidably driven apart during the power stroke.

* * * * *